US006022655A

United States Patent [19]

Kondo et al.

[11] Patent Number: 6,022,655

[45] Date of Patent: Feb. 8, 2000

[54] PHOTORECEPTOR FOR ELECTROPHOTOGRAPHY, BISHYDRAZONE COMPOUND AND INTERMEDIATE THEREOF, AND METHOD FOR PRODUCING BISHYDRAZONE COMPOUND AND INTERMEDIATE THEREOF

[75] Inventors: Akihiro Kondo, Nara; Hiroshi Sugimura, Habikino; Yuko Inoue, Tenri; Takatsugu Obata, Nara, all of Japan

[73] Assignee: Sharp Kabushiki Kaisha, Japan

[21] Appl. No.: 09/053,728

[22] Filed: Apr. 2, 1998

[30] Foreign Application Priority Data

| | | | |
|---|---|---|---|
| Apr. 8, 1997 | [JP] | Japan | 9-089742 |
| Jul. 22, 1997 | [JP] | Japan | 9-195906 |
| Jul. 24, 1997 | [JP] | Japan | 9-198321 |

[51] Int. Cl.[7] ..... G03G 5/047; G03G 5/09

[52] U.S. Cl. ..... 430/58.45; 430/83

[58] Field of Search ..... 430/58.4, 58.45, 430/83

[56] References Cited

U.S. PATENT DOCUMENTS

| | | | |
|---|---|---|---|
| 4,123,269 | 10/1978 | Von Hoene et al. | 430/60 |
| 4,150,987 | 4/1979 | Anderson et al. | 430/58.45 |
| 4,594,304 | 6/1986 | Watarai et al. | 430/58.45 |
| 4,814,245 | 3/1989 | Horie et al. | 430/58.45 |
| 5,389,480 | 2/1995 | Ono et al. | 430/58.6 |
| 5,492,786 | 2/1996 | Sugimura et al. | 430/58.4 |
| 5,763,126 | 6/1998 | Miyauchi et al. | 430/58.4 |

FOREIGN PATENT DOCUMENTS

| | | |
|---|---|---|
| 54-59143 | 5/1979 | Japan . |
| 55-46761 | 4/1980 | Japan . |
| 55-74547 | 6/1980 | Japan . |
| 7-19780 B2 | 4/1982 | Japan . |
| 58-32372 B2 | 7/1983 | Japan . |
| 58-46018 B2 | 10/1983 | Japan . |
| 58-198043 | 11/1983 | Japan . |

*Primary Examiner*—Roland Martin
*Attorney, Agent, or Firm*—Nixon & Vanderhye

[57] ABSTRACT

A photoreceptor for electrophotography of the present invention includes a photosensitive layer provided on a conductive support, the photosensitive layer containing a bishydrazone compound represented by the following general formula (Ia):

(Ia)

where:

$R^1$ and $R^2$ each represent a substituted or unsubstituted aryl group, a substituted or unsubstituted aralkyl group, a heterocyclic group, or an alkyl group which has 1 to 4 carbon atoms;

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring.

22 Claims, 34 Drawing Sheets

$^1$H-NMR spectrum of a tricyclic compound which is the first intermediate for synthesizing Exemplary compound No.1

Normal $^{13}C$–NMR spectrum of a tricyclic compound which is the first intermediate for synthesizing Exemplary compound No.1

DEPT135 $^{13}$C–NMR spectrum of a tricyclic compound which is the first intermediate for synthesizing Exemplary compound No.1

$^1$H-NMR spectrum of 2,5-bisformylbenzo[b]furan which is the second intermediate for synthesizing Exemplary compound No.1

Normal $^{13}$C-NMR spectrum of 2,5-bisformylbenzo[b]furan which is the second intermediate for synthesizing Exemplary compound No.1

FIG. 11A DEPT135 $^{13}$C-NMR spectrum of 2,5-bisformylbenzo[b]furan which is the second intermediate for synthesizing Exemplary compound No.1

PHOTORECEPTOR FOR ELECTROPHOTOGRAPHY, BISHYDRAZONE COMPOUND AND INTERMEDIATE THEREOF, AND METHOD FOR PRODUCING BISHYDRAZONE COMPOUND AND INTERMEDIATE THEREOF

BACKGROUND OF THE INVENTION

1. Field of the Invention

The present invention relates to a photoreceptor for electrophotography used in an electrophotographic process, bishydrazone compounds and intermediates thereof which are suitably used therefor, and a method for producing the bishydrazone compound and the intermediate thereof.

2. Description of the Related Art

There are various methods for the electrophotographic process. Typical examples thereof which have been conventionally known include a direct method and a latent image transfer method. In a photoreceptor for electrophotography used in such an electrophotographic process, a material of a photosensitive layer with a photoconduction function is required to have the following basic properties:

(1) high chargeability by a corona discharge in a dark place;

(2) little loss of an electric charge obtained by a corona discharge in a dark place;

(3) quick diffusion of an electric charge by photoirradiation;

(4) little residue charge after photoirradiation;

(5) minimal increase in the residue charge and minimal decrease in the initial charge in a repeated use; and (6) minimal variation in the electrophotographic characteristics due to temperature and humidity.

As a material having such properties, inorganic photoconductive materials have been conventionally used, such as zinc oxide (Japanese Patent Publication for Opposition No. 57-19780), cadmium sulfide (Japanese Patent Publication for Opposition No. 58-46018), and an amorphous selenium alloy. However, the following problems have been recently pointed out associated with the inorganic materials: in the case of the zinc oxide type material, due to a sensitizing agent, the chargeability by the corona discharge deteriorates and light fading occurs by exposure to light, and therefore a stable image cannot be obtained for a long term; in the case of the cadmium sulfide type material, a stable image cannot be obtained under humid conditions; and the selenium type material has problems such as thermal instability, characteristics deterioration due to crystallization, and difficulty in production.

Thus, from a long-term perspective, researches have been actively conducted for a photoreceptor made of an organic material rather than the inorganic material which has production-related problems due to possible exhaustion of the source materials, and raises a pollution concern due to the toxicity and other environmental problems. As a result, photoreceptors for electrophotography using various organic compounds have been researched. Especially, recently, the function-separated photosensitive layers have been positively researched and developed. Among others, a dominant method has been to negatively charge a charge transfer surface by successively forming, on a conductive support, a charge generation layer and a charge transfer layer which has a positive hole transferring property.

Such function separation has enabled independent development of a material having the charge generation function and a material having the charge transfer function. As a result, various charge generation substances and charge transfer substances have been developed with various molecular structures. Typical examples of such a charge transfer substance which have been developed may be classified as follows by their structural characteristics: a hydrazone type compound (Japanese Laid-open Publication No 54-59143); a stilbene/styryl type compound (Japanese Laid-open Publication No. 58-198043); a triarylamine type compound (Japanese Patent Publication for Opposition No. 58-32372); a phenothiazine type compound; a triazole type compound; a quinoxaline type compound; an oxadiazole type compound; an oxazole type compound; a pyrazoline type compound; a triphenylmethane type compound; a dihydronicotinamide compound; an indoline compound; a semicarbazone compound; etc.

A photoreceptor for electrophotography using such organic compounds is produced by applying a photosensitive layer on a conductive support. A baker applicator, a bar coater, and the like, are known as means for producing a sheet-form photoreceptor, and a spraying method, a vertical ring method, a dip-coat method, and the like, are known for producing a drum-form photoreceptor. The dip-coat method requires only a simple apparatus and thus has been typically employed.

Although various organic compounds have been developed for use as the charge transfer substance, as described above, no organic compound has been developed which can solve all of the following problems:

(a) poor compatibility with a binding agent;

(b) being easily precipitated as crystals;

(c) variation in photosensitivity as a result of repeated use;

(d) poor chargeability and poor repeatability; and (e) poor residue potential characteristic.

Moreover, no organic compound has been developed which satisfies the above (1)–(6) basic properties required for a photoreceptor for electrophotography, or those which satisfy further requirements such as mechanical strength or durability.

The inventors of the present invention have conducted a research for a photoconductive material having high sensitivity and high durability, and found that it is effective to use a bishydrazone compound represented by the following general formula (Ia), (Ib) or (Ic) into a photosensitive layer:

SUMMARY OF THE INVENTION

According to one aspect of this invention, a photoreceptor for electrophotography includes a photosensitive layer provided on a conductive support, the photosensitive layer containing a bishydrazone compound represented by the following general formula (Ia):

(Ia)

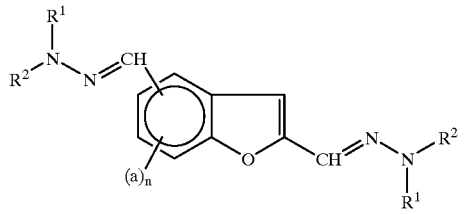

where:

$R^1$ and $R^2$ each represent a substituted or unsubstituted aryl group, a substituted or unsubstituted aralkyl group, a heterocyclic group, or an alkyl group which has 1 to 4 carbon atoms;

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring.

In one embodiment of the invention, the bishydrazone compound represented by the general formula (Ia) is a compound represented by the following general formula (IIa):

(IIa)

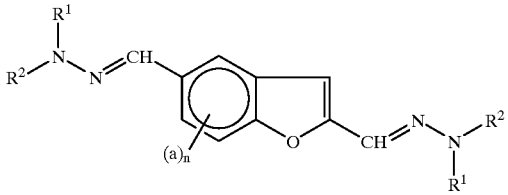

In another embodiment of the invention, the bishydrazone compound represented by the general formula (Ia) is a compound represented by the following general formula (IIIa):

(IIIa)

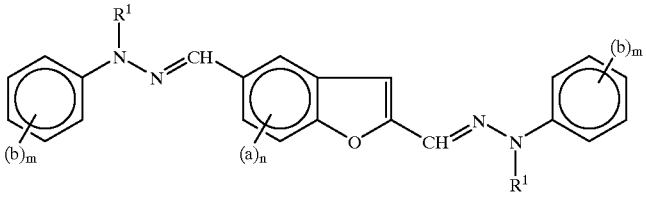

where:

"b" represents an alkyl group which has 1 to 3 carbon atoms, an alkoxy group which has 1 to 3 carbon atoms, a dialkylamino group which has 1 to 3 carbon atoms, a halogen atom, or a hydrogen atom;

and m represents an integer of 1 to 5, wherein, if m is 2 or greater, a plurality of "b" substituents may be identical to or different from one another, or the substituents may form a ring.

In still another embodiment of the invention, the photosensitive layer is formed in a layered structure of a charge generation layer containing a charge generation substance and a charge transfer layer containing a charge transfer substance, and the charge transfer substance contains the bishydrazone compound.

In still another embodiment of the invention, the photosensitive layer is a single layer containing a charge generation substance and a charge transfer substance, and the charge transfer substance contains the bishydrazone compound.

According to another aspect of this invention, there is provided a bishydrazone compound represented by the following general formula (Ia):

(Ia)

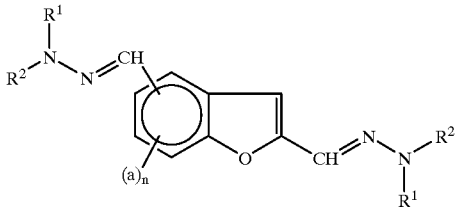

where:

$R^1$ and $R^2$ each represent a substituted or unsubstituted aryl group, a substituted or unsubstituted aralkyl group, a heterocyclic group, or an alkyl group which has 1 to 4 carbon atoms;

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring.

According to still another aspect of this invention, there is provided an intermediate for producing a bishydrazone compound represented by the following general formula (Ia):

(Ia)

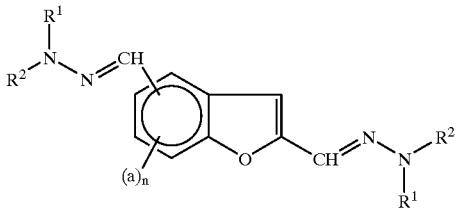

where:

$R^1$ and $R^2$ each represent a substituted or unsubstituted aryl group, a substituted or unsubstituted aralkyl group, a heterocyclic group, or an alkyl group which has 1 to 4 carbon atoms;

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring, wherein the intermediate is a compound represented by the following general formula (IVa):

(IVa)

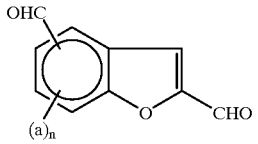

According to still another aspect of this invention, there is provided an intermediate for producing a bishydrazone compound represented by the following general formula (Ia):

(Ia)

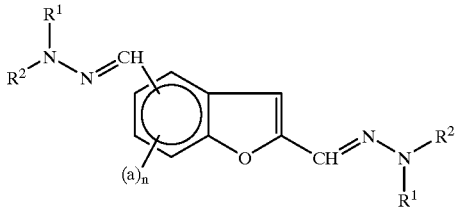

where:

$R^1$ and $R^2$ each represent a substituted or unsubstituted aryl group, a substituted or unsubstituted aralkyl group, a heterocyclic group, or an alkyl group which has 1 to 4 carbon atoms;

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring.

wherein the intermediate is a compound represented by the following general formula (Va):

(Va)

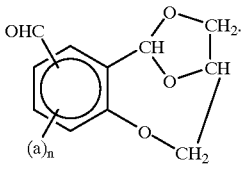

According to still another aspect of this invention, there is provided a method for producing an intermediate of a bishydrazone compound which is a compound represented by the following general formula (Va):

(Va)

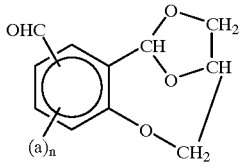

where:

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring.

The method includes the step of reacting a compound represented by the following general formula (VIa):

(VIa)

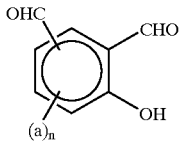

with a compound represented by the following general formula (VIIa):

(VIIa)

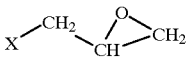

where X represents a chlorine atom or a bromine atom.

According to still another aspect of this invention, there is provided a method for producing an intermediate of a bishydrazone compound which is a compound represented by the following general formula (IVa):

(IVa)

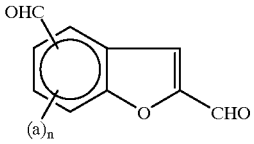

where:

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring.

The method includes the steps of: cleaving a compound represented by the following general formula (Va):

(Va)

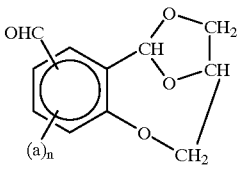

with a periodate under acidic conditions; and effectuating an intramolecular aldol cyclization reaction.

According to still another aspect of this invention, there is provided a method for producing a bishydrazone compound represented by the following general formula (Ia):

(Ia)

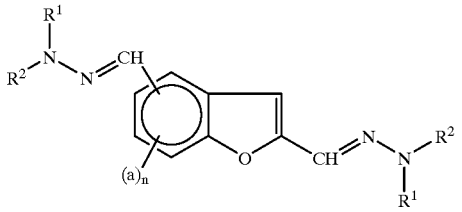

where:

$R^1$ and $R^2$ each represent a substituted or unsubstituted aryl group, a substituted or unsubstituted aralkyl group, a heterocyclic group, or an alkyl group which has 1 to 4 carbon atoms;

"a" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and n represents an integer of 1 to 3, wherein, if n is 2 or greater, a plurality of "a" substituents may be identical to or different from one another, or the substituents may form a ring.

The method includes the step of reacting a compound represented by the following general formula (IVa):

(IVa)

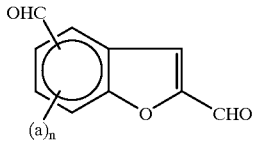

with a hydrazine reagent represented by the following general formula (VIIIa):

(VIIIa)

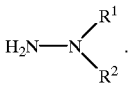

According to still another aspect of this invention, a photoreceptor for electrophotography includes a photosensitive layer provided on a conductive support, the photosensitive layer containing a bishydrazone compound represented by the following general formula (Ib):

(Ib)

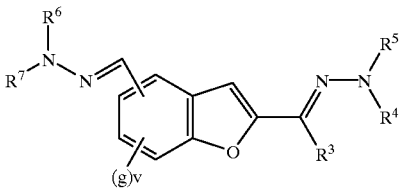

where:

$R^4$, $R^5$, $R^6$ and $R^7$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, or $R^4$ and $R^5$ or $R^6$ and $R^7$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

In one embodiment of the invention, the bishydrazone compound represented by the general formula (Ib) is a compound represented by the following general formula (IIb):

(IIb)

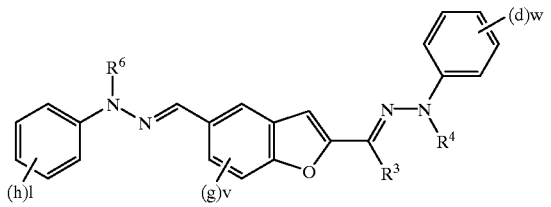

where:

"h" and "d" each represent a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and l and w each represent an integer of 1 to 5, wherein, if l is 2 or greater, a plurality of "h" substituents may be identical to or different from one another, or the substituents may form a ring and, if w is 2 or greater, a plurality of "d" substituents may be identical to or different from one another, or the substituents may form a ring.

In another embodiment of the invention, the bishydrazone compound represented by the general formula (Ib) is a compound represented by the following general formula (IIIb):

(IIIb)

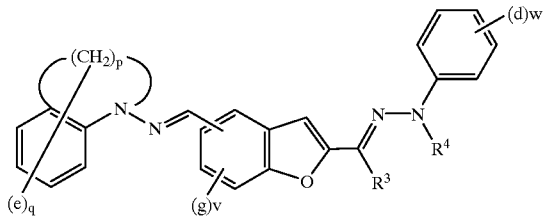

where:

"e" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

q represents an integer of 1 to 14, wherein, if q is 2 or greater, a plurality of "e" substituents may be identical to or different from one another, or the substituents may form a ring; and p represents an integer of 2 to 5.

In still another embodiment of the invention, the bishydrazone compound represented by the general formula (Ib) is a compound represented by the following general formula (IVb):

(IVb)

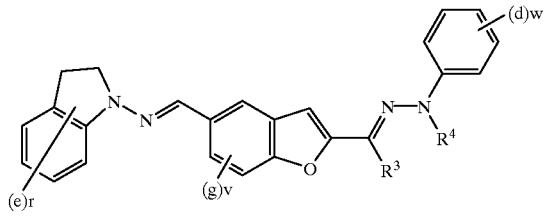

where:

"e" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and r represents an integer of 1 to 8, wherein, if r is 2 or greater, a plurality of "e" substituents may be identical to or different from one another, or the substituents may form a ring.

In still another embodiment of the invention, the bishydrazone compound represented by the general formula (Ib) is a compound represented by the following general formula (Vb):

(Vb)

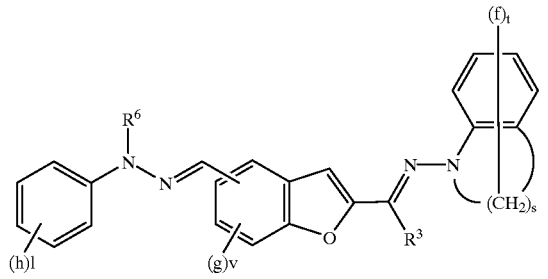

where:

"f" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

t represents an integer of 1 to 14, wherein, if t is 2 or greater, a plurality of "f" substituents may be identical to or different from one another, or the substituents may form a ring; and s represents an integer of 2 to 5.

In still another embodiment of the invention, the bishydrazone compound represented by the general formula (Ib) is a compound represented by the following general formula (VIb):

(VIb)

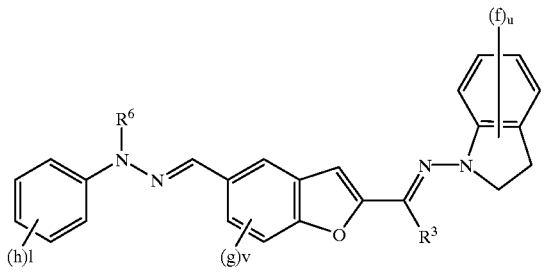

where:

"f" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and u represents an integer of 1 to 8, wherein, if u is 2 or greater, a plurality of "f" substituents may be identical to or different from one another, or the substituents may form a ring.

In still another embodiment of the invention, the bishydrazone compound represented by the general formula (Ib) is a compound represented by the following general formula (VIIb):

(VIIb)

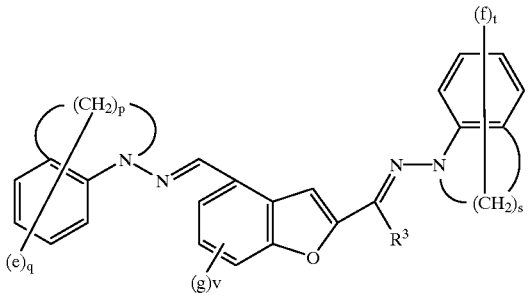

where:

"e" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

q represents an integer of 1 to 14, wherein, if q is 2 or greater, a plurality of "e" substituents may be identical to or different from one another, or the substituents may form a ring;

p represents an integer of 2 to 5;

"f" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

t represents an integer of 1 to 14, wherein, if t is 2 or greater, a plurality of "f" substituents may be identical to or different from one another, or the substituents may form a ring; and s represents an integer of 2 to 5.

In still another embodiment of the invention, the bishydrazone compound represented by the general formula (Ib) is a compound represented by the following general formula (VIIIb):

(VIIIb)

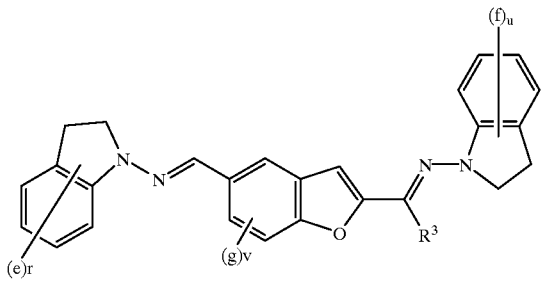

where:

"e" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

r represents an integer of 1 to 8, wherein, if r is 2 or greater, a plurality of "e" substituents may be identical to or different from one another, or the substituents may form a ring;

"f" represents a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and u represents an integer of 1 to 8, wherein, if u is 2 or greater, a plurality of "f" substituents may be identical to or different from one another, or the substituents may form a ring.

In still another embodiment of the invention, the bishydrazone compound represented by the general formula (Ib) is a compound represented by the following general formula (IXb):

(IXb)

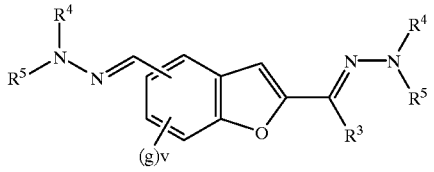

In still another embodiment of the invention, the photosensitive layer is formed in a layered structure of a charge generation layer containing a charge generation substance and a charge transfer layer containing a charge transfer substance, and the charge transfer substance contains the bishydrazone compound.

In still another embodiment of the invention, the photosensitive layer is a single layer containing a charge generation substance and a charge transfer substance, and the charge transfer substance contains the bishydrazone compound.

According to still another aspect of this invention, there is provided a bishydrazone compound represented by the following general formula (Ib):

(Ib)

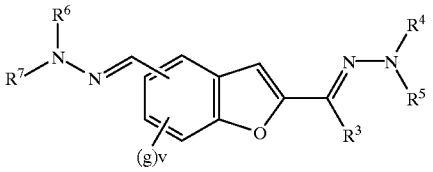

where:

$R^4$, $R^5$, $R^6$ and $R^7$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, or $R^4$ and $R^5$ or $R^6$ and $R^7$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

According to still another aspect of this invention, there is provided a bishydrazone compound represented by the following general formula (IXb):

(IXb)

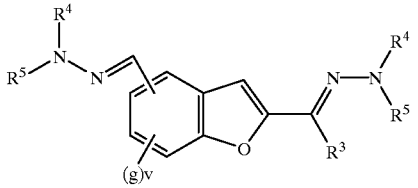

where:

$R^4$ and $R^5$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, wherein $R^4$ and $R^5$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

According to still another aspect of this invention, there is provided an intermediate for producing a bishydrazone compound represented by the following general formula (Ib) or (IXb):

(Ib)

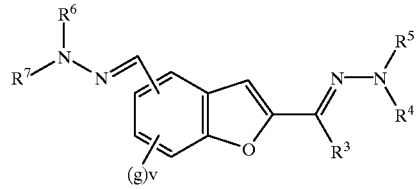

(IXb)

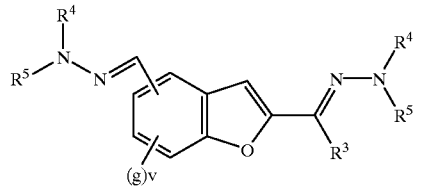

where:

$R^4$, $R^5$, $R^6$ and $R^7$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, or $R^4$ and $R^5$ or $R^6$ and $R^7$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

The intermediate is a compound represented by the following general formula (Xb):

(Xb)

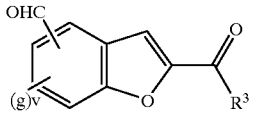

According to still another aspect of this invention, there is provided an intermediate for producing a bishydrazone compound represented by the following general formula (Ib):

(Ib)

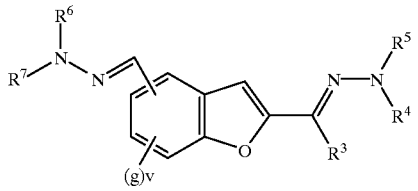

where:

$R^4$, $R^5$, $R^6$ and $R^7$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, or $R^4$ and $R^5$ or $R^6$ and $R^7$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

The intermediate is a compound represented by the following general formula (XIb):

(XIb)

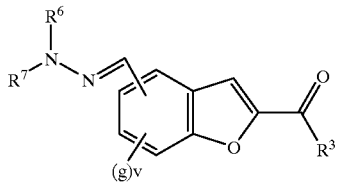

According to still another aspect of this invention, there is provided a method for producing a first intermediate of a bishydrazone compound which is a compound represented by the following general formula (Xb):

(Xb)

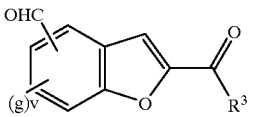

where:

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

The method includes the step of reacting a compound represented by the following general formula (XIIb):

(XIIb)

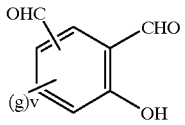

with a compound represented by the following general formula (XIIIb):

(XIIIb)

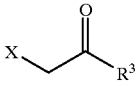

where X represents a halogen atom.

According to still another aspect of this invention, there is provided a method for producing a second intermediate of a bishydrazone compound which is a compound represented by the following general formula (XIb):

(XIb)

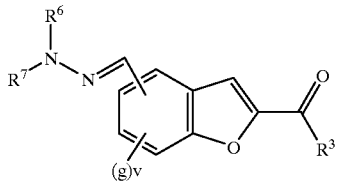

where:

$R^6$ and $R^7$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, wherein $R^6$ and $R^7$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

The method includes the step of reacting a compound represented by the following general formula (Xb):

(Xb)

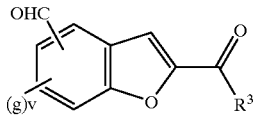

with a compound represented by the following general formula (XIVb):

(XIVb)

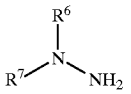

According to still another aspect of this invention, there is provided a method for producing a bishydrazone compound represented by the following general formula (Ib):

(Ib)

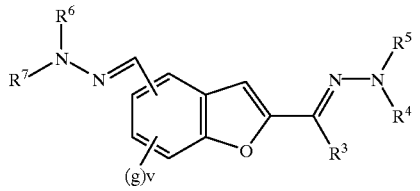

where:

$R^4$, $R^5$, $R^6$ and $R^7$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, or $R^4$ and $R^5$ or $R^6$ and $R^7$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

The method includes the step of reacting a compound represented by the following general formula (XIb):

(XIb)

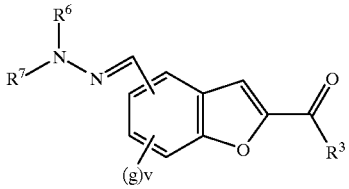

with a compound represented by the following general formula (XVb):

(XVb)

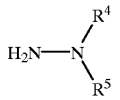

According to still another aspect of this invention, there is provided a method for producing a bishydrazone compound represented by the following general formula (IXb):

(IXb)

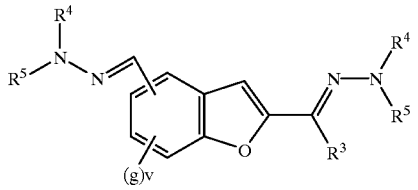

where:

$R^4$ and $R^5$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, wherein $R^4$ and $R^5$ may form a ring structure via an atom, an atomic group, a substituted or unsubstituted alkylene group, a substituted or unsubstituted vinylene group, or a bivalent linking group;

$R^3$ represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v represents an integer of 1 to 3, wherein, if v is 2 or greater, a plurality of "g" substituents may be identical to or different from one another, or the substituents may form a ring.

The method includes the step of reacting a compound represented by the following general formula (Xb):

(Xb)

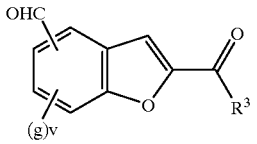

with a compound represented by the following general formula (XVb):

(XVb)

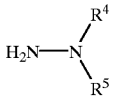

According to still another aspect of this invention, a photoreceptor for electrophotography includes a photosensitive layer provided on a conductive support, the photosensitive layer containing a cyclic bishydrazone compound represented by the following general formula (Ic):

(Ic)

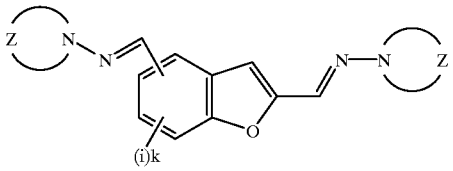

where:

"Z" represents a substituted or unsubstituted heterocycle, a substituted or unsubstituted atomic group which has a bivalent group for forming a condensed heterocycle;

"i" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and k represents an integer of 1 to 3, wherein, if k is 2 or greater, a plurality of "i" substituents may be identical to or different from one another, or the substituents may form a ring.

In one embodiment of the invention, the cyclic bishydrazone compound represented by the general formula (Ic) is a compound represented by the following general formula (IIc):

(IIc)

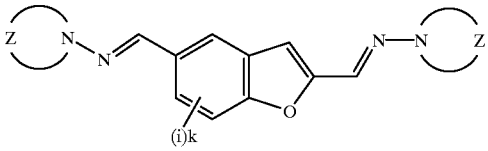

In another embodiment of the invention, the cyclic bishydrazone compound represented by the general formula (Ic) is a compound represented by the following general formula (IIIc):

(IIIc)

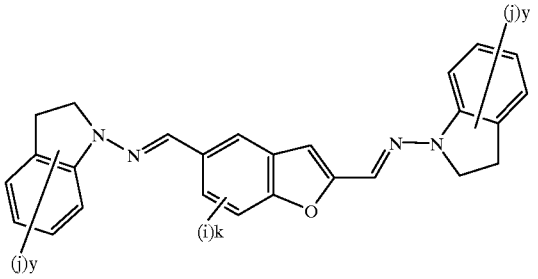

where:

"j" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and y represents an integer of 1 to 8, wherein, if y is 2 or greater, a plurality of "j" substituents may be identical to or different from one another, or the substituents may form a ring.

In still another embodiment of the invention, the cyclic bishydrazone compound represented by the general formula (Ic) is a compound represented by the following general formula (IVc):

(IVc)

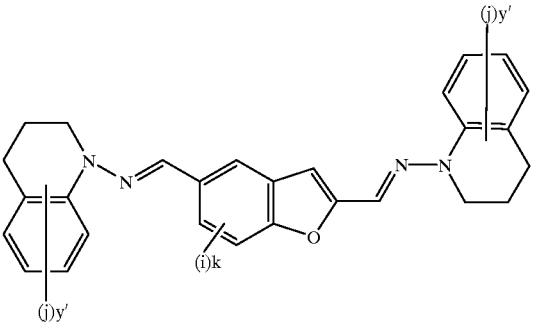

where:

"j" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and y' represents an integer of 1 to 10, wherein, if y' is 2 or greater, a plurality of "j" substituents may be identical to or different from one another, or the substituents may form a ring.

In still another embodiment of the invention, the photosensitive layer is formed in a layered structure of a charge generation layer containing a charge generation substance and a charge transfer layer containing a charge transfer substance, and the charge transfer substance contains the cyclic bishydrazone compound.

In still another embodiment of the invention, the photosensitive layer is a single layer containing a charge generation substance and a charge transfer substance, and the charge transfer substance contains the cyclic bishydrazone compound.

According to still another aspect of this invention there is provided a cyclic bishydrazone compound represented by the following general formula (Ic):

(Ic)

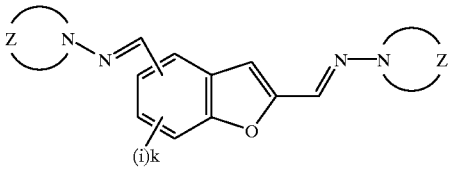

where:

"Z" represents a substituted or unsubstituted heterocycle, a substituted or unsubstituted atomic group which has a bivalent group for forming a condensed heterocycle;

"i" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and k represents an integer of 1 to 3, wherein, if k is 2 or greater, a plurality of "i" substituents may be identical to or different from one another, or the substituents may form a ring.

According to still another aspect of this invention there is provided a method for producing a cyclic bishydrazone compound represented by the following general formula (Ic):

(Ic)

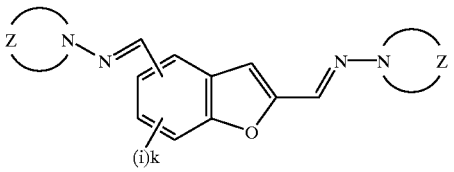

where:

"Z" represents a substituted or unsubstituted heterocycle, a substituted or unsubstituted atomic group which has a bivalent group for forming a condensed heterocycle;

"i" represents an alkyl group which has 1 to 3 carbon atoms, an alkoxy group which has 1 to 3 carbon atoms, a dialkylamino group which has 1 to 3 carbon atoms, a halogen atom, or a hydrogen atom; and k represents an integer of 1 to 3, wherein, if k is 2 or greater, a plurality of "i" substituents may be identical to or different from one another, or the substituents may form a ring.

The method includes the step of reacting a compound represented by the following general formula (Vc):

(Vc)

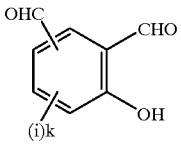

with a cyclic hydrazine reagent represented by the following general formula (VIc):

(VIc)

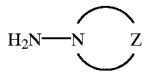

Hereinafter, the effect of the present invention will be described.

The bishydrazone compound of the present invention is a novel compound, which has a wide conjugated system, as shown in the general formulae (Ia), (Ib), (IXb) and (Ic). Therefore, it is possible to increase the charge mobility and improve the residue potential characteristics. Moreover, the bishydrazone compound of the present invention is superior in terms of the compatibility with a binding agent. Therefore, a large amount of the bishydrazone compound can be contained in a photoreceptor for electrophotography, so as to improve the photosensitivity thereof. Furthermore, the bishydrazone compound of the present invention does not easily precipitate in crystals. Therefore, it is possible to stabilize the characteristics of the photoreceptor in repeated use.

By the method of the present invention for producing the bishydrazone compound and the intermediate thereof, it is possible to produce the bishydrazone compound of the present invention and the necessary intermediates at an extremely high yield.

Thus, the invention described herein makes possible the advantages of: (1) providing a photoreceptor for electrophotography which has high sensitivity and high durability as well as high chargeability whose photosensitivity is scarcely lowered in repeated use; (2) providing a novel bishydrazone compound suitable for use in such a photoreceptor; (3) providing an intermediate necessary for producing such a bishydrazone compound; (4) providing a method for producing such a bishydrazone compound; and (5) providing a method for producing such an intermediate.

These and other advantages of the present invention will become apparent to those skilled in the art upon reading and understanding the following detailed description with reference to the accompanying figures.

BRIEF DESCRIPTION OF THE DRAWINGS

FIG. 11A shows a DEPT135 $^{13}$C-NMR spectrum of 2,5-bisformylbenzo[b]furan which is the second intermediate for synthesizing Exemplary compound No. 1.

DESCRIPTION OF THE PREFERRED EMBODIMENTS

Embodiment 1

Figure 1:
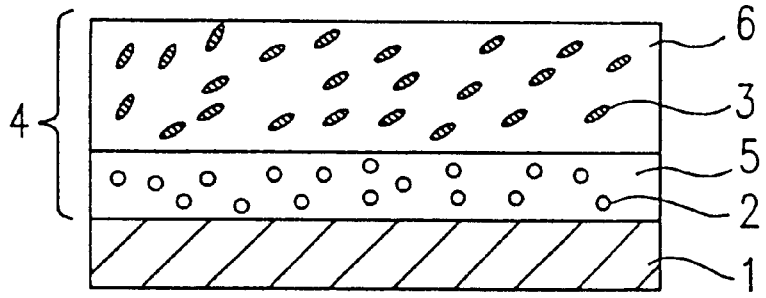
FIG. 1 is a cross sectional view illustrating a photoreceptor for electrophotography according to an embodiment of the present invention.

Hereinafter, Embodiment 1 of the present invention will be described.

The bishydrazone compound according to the present embodiment of the invention is represented by the following general formula (Ia):

(Ia)

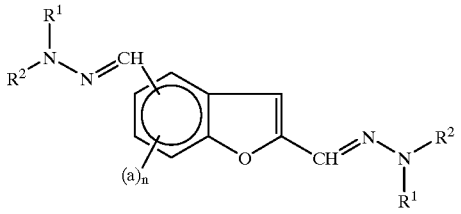

In the general formula (Ia), $R^1$ and $R^2$ each represent a substituted or unsubstituted aryl group, a substituted or unsubstituted aralkyl group, a heterocyclic group, or an alkyl group which has 1 to 4 carbon atoms. Specific examples of $R^1$ and $R^2$ include: an aryl group such as a phenyl group, a 1-naphthyl group and a p-tolyl group; an aralkyl group such as a p-methylbenzyl group and a 1-thienylmethyl group; a heterocyclic group such as a 1-pyridyl group; and an alkyl group such as a methyl group, an ethyl group, an n-propyl group and an iso-propyl group.

Moreover, "a" in the general formula (Ia) represents an alkyl group which has 1 to 3 carbon atoms, an alkoxy group which has 1 to 3 carbon atoms, a dialkylamino group which has 1 to 3 carbon atoms, a halogen atom, or a hydrogen atom. Specific examples of the "a" substituents include: an alkyl group such as a methyl group, an ethyl group, an n-propyl group and an iso-propyl group; an alkoxy group such as a methoxy group, an ethoxy group and a propoxy group; a dialkylamino group such as a dimethylamino group, a diethylamino group, a di-iso-propylamino group and a di-n-butyl group; a halogen atom such as fluorine and chlorine; a hydrogen atom. Generally, it is preferable that the substituent is an electron donative substituent.

Furthermore, "n" in the general formula (Ia) represents an integer of 1 to 3. Herein, if n is 2 or greater, a plurality of the "a" substituents may be identical to or different from one another, or the substituents may form a ring.

Particularly, the bishydrazone compounds represented by the general formula (Ia), which are superior in terms of the electrophotographic characteristics, cost and production, include those where one of $R^1$ and $R^2$ is a phenyl group, a p-methylphenyl group, a 1-naphthyl group or a 1-thienylmethyl group while the other is a methyl group, an ethyl group, an n-butyl group, a phenyl group or a p-methylphenyl group.

Specific examples of the bishydrazone compound represented by the general formula (Ia) will be provided in Tables 1 to 4 below, though the bishydrazone compound of the present invention is not limited thereto.

TABLE 1

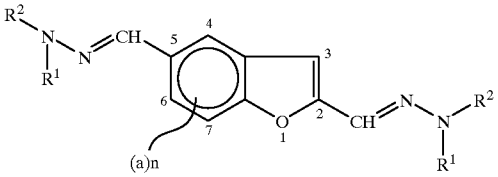

| Cpd. No | $R^1$ | $R^2$ | a | n |
|---|---|---|---|---|
| 1 | —$CH_3$ | 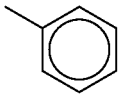 | —H | 3 |
| 2 | —$C_2H_5$ | 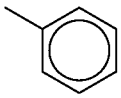 | —H | 3 |
| 3 | -n$C_4H_9$ | 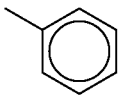 | —H | 3 |

TABLE 1-continued
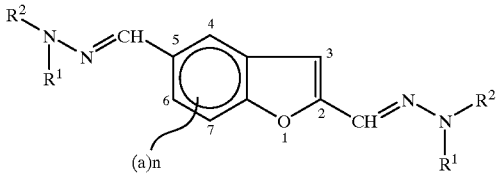
| Cpd. No | $R^1$ | $R^2$ | a | n |
|---|---|---|---|---|
| 4 | $—CH_3$ | 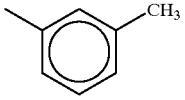 | —H | 3 |
| 5 | $—C_2H_5$ | 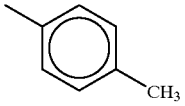 | —H | 3 |
| 6 | $—C_2H_5$ | 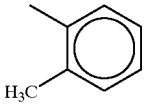 | —H | 3 |
| 7 | 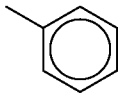 | 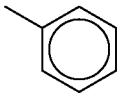 | —H | 3 |
| 8 | 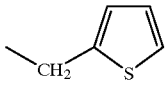 | 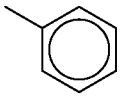 | —H | 3 |
| 9 | $—CH_3$ | 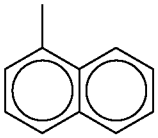 | —H | 3 |
| 10 | 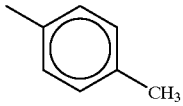 | 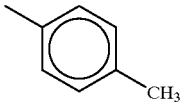 | —H | 3 |
| 11 | $—CH_3$ | 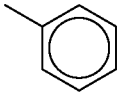 | 7-$OCH_3$ | 1 |
| 12 | 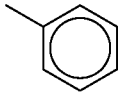 | 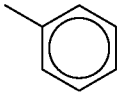 | 7-$OCH_3$ | 1 |
| 13 | 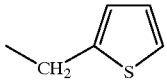 | 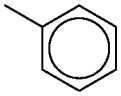 | 7-$OCH_3$ | 1 |
TABLE 2
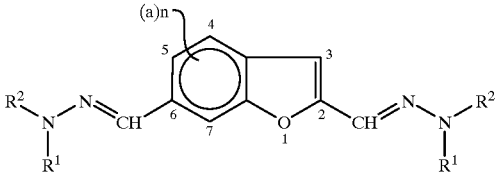
| Cpd. No | $R^1$ | $R^2$ | a | n |
|---|---|---|---|---|
| 14 | $—CH_3$ | 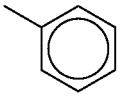 | —H | 3 |
| 15 | $—C_2H_5$ | 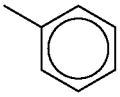 | —H | 3 |
| 16 | $-nC_4H_9$ | 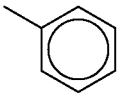 | —H | 3 |
| 17 | $—CH_3$ | 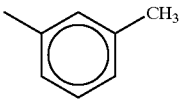 | —H | 3 |
| 18 | $—C_2H_5$ | 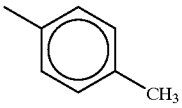 | —H | 3 |
| 19 | 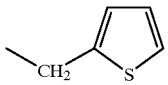 | 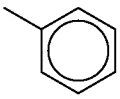 | —H | 3 |
| 20 | $—CH_3$ | 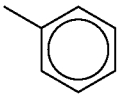 | 5-$CH_3$ | 1 |
| 21 | 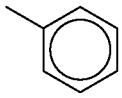 | 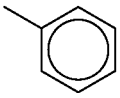 | 5-$CH_3$ | 1 |
| 22 | 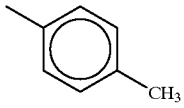 | 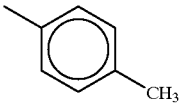 | 5-$CH_3$ | 1 |
| 25 | $—CH_3$ | 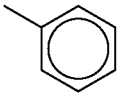 | 5-$OCH_3$ | 1 |
| 24 | 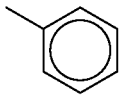 | 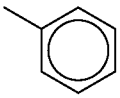 | 5-$OCH_3$ | 1 |

TABLE 2-continued
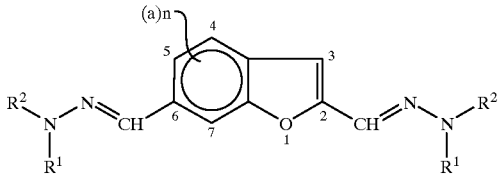
| Cpd. No | $R^1$ | $R^2$ | a | n |
|---|---|---|---|---|
| 25 | 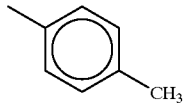 | 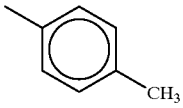 | 5-$OCH_3$ | 1 |
| 26 | $—C_2H_5$ | 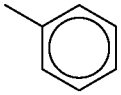 | 5-$OCH_3$ | 1 |
TABLE 3
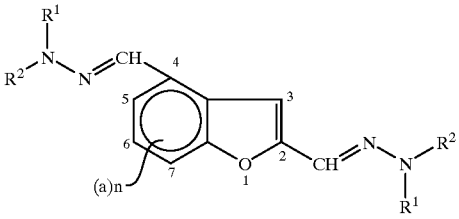
| Cpd. No | $R^1$ | $R^2$ | a | n |
|---|---|---|---|---|
| 27 | $—CH_3$ | 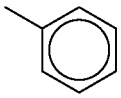 | —H | 3 |
| 28 | $—C_2H_5$ | 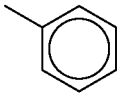 | —H | 3 |
| 29 | $-nC_4H_9$ | 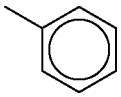 | —H | 3 |
| 30 | $—CH_3$ | 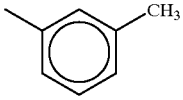 | —H | 3 |
| 31 | $—C_2H_5$ | 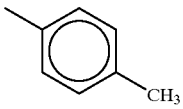 | —H | 3 |
TABLE 3-continued
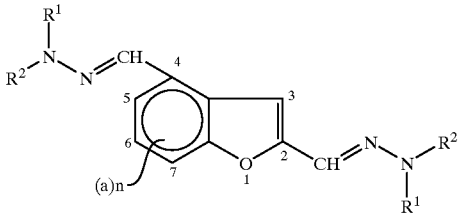
| Cpd. No | $R^1$ | $R^2$ | a | n |
|---|---|---|---|---|
| 32 | $—C_2H_5$ | 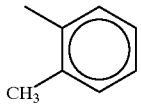 | —H | 3 |
| 33 | 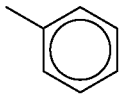 | 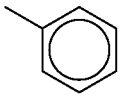 | —H | 3 |
| 34 | 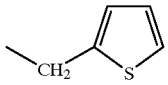 | 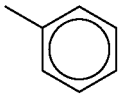 | —H | 3 |
| 35 | $—CH_3$ | 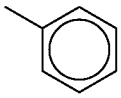 | 5-$CH_3$ | 1 |
| 36 | 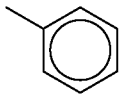 | 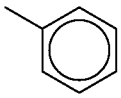 | 5-$CH_3$ | 1 |
| 37 | $—C_2H_5$ | 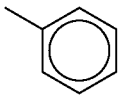 | 5-$CH_3$ | 1 |
| 38 | 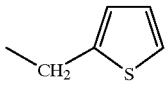 | 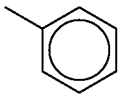 | 5-$CH_3$ | 1 |
| 39 | $—CH_3$ | 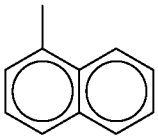 | 5-$CH_3$ | 1 |

TABLE 4

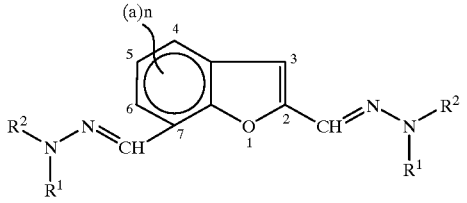

| Cpd. No | $R^1$ | $R^2$ | a | n |
|---|---|---|---|---|
| 40 | $—CH_3$ | 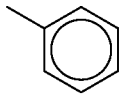 | —H | 3 |
| 41 | $—C_2H_5$ | 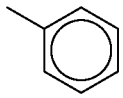 | —H | 3 |
| 42 | $-nC_4H_9$ | 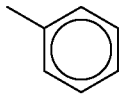 | —H | 3 |
| 43 | $—C_2H_5$ | 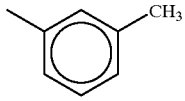 | —H | 3 |
| 44 | $—C_2H_5$ | 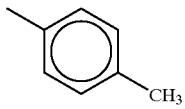 | —H | 3 |
| 45 | $—C_2H_5$ | 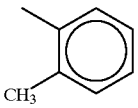 | —H | 3 |
| 46 | 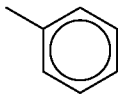 | 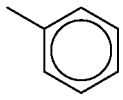 | —H | 3 |
| 47 | 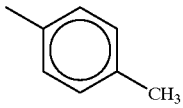 | 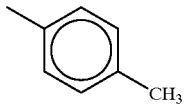 | —H | 3 |
| 48 | 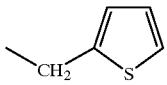 | 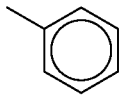 | —H | 3 |

TABLE 4-continued

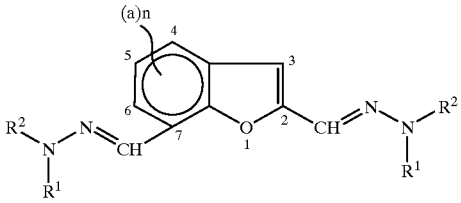

| Cpd. No | $R^1$ | $R^2$ | a | n |
|---|---|---|---|---|
| 49 | $—CH_3$ | 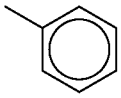 | $5\text{-}OCH_3$ | 1 |
| 50 | 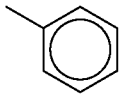 | 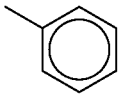 | $5\text{-}OCH_3$ | 1 |
| 51 | $—C_2H_5$ | 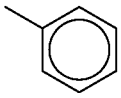 | $5\text{-}OCH_3$ | 1 |
| 52 | 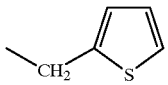 | 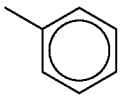 | $5\text{-}OCH_3$ | 1 |

In Tables 1 to 4, "n" represents the number of the "a" substituents, which may be a hydrogen atom or may be another substituent. In the bishydrazone compounds having a substituent at position 5, as those in Table 1, if "a" is not a hydrogen atom, e.g., an alkyl group, it is preferable, from a synthetic view point, that "a" is at position 7 among the possible positions 4, 6 and 7. Moreover, in the bishydrazone compounds having a substituent at position 6, as those in Table 2, if "a" is not a hydrogen atom, e.g., an alkyl group, it is preferable, from a synthetic view point, that "a" is at position 5 among the possible positions 4, 5 and 7. Furthermore, in the bishydrazone compounds having a substituent at position 4, as those in Table 3, if "a" is not a hydrogen atom, e.g., an alkyl group, it is preferable, from a synthetic view point, that "a" is at position 5 among the possible positions 5, 6 and 7. Furthermore, in the bishydrazone compounds having a substituent at position 7, as those in Table 4, if "a" is not a hydrogen atom, e.g., an alkyl group, it is preferable, from a synthetic view point, that "a" is located at position 5 among the possible positions 4, 5 and 6.

Among the bishydrazone compounds represented by the general formula (Ia), those represented by the following general formula (IIa) are most suitable for mass-production since the synthesis materials thereof are currently easily available:

(IIa)

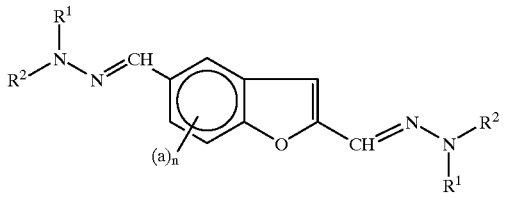

In the general formula (IIa), $R^1$, $R^2$, "a" and n each represent the same as above.

Moreover, among the bishydrazone compounds represented by the general formula (Ia), for those represented by the following general formula (IIIa), the hydrazine reagent, which is necessary for synthesizing the bishydrazone compound of the present invention, is available in wide variety.

(IIIa)

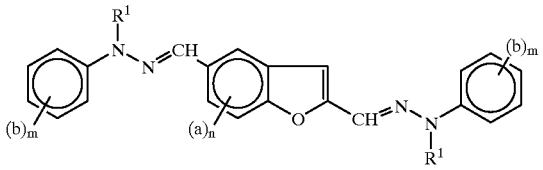

In the general formula (IIIa), "b" represents an alkyl group which has 1 to 3 carbon atoms, an alkoxy group which has 1 to 3 carbon atoms, a dialkylamino group which has 1 to 3 carbon atoms, a halogen atom, or a hydrogen atom. The specific examples of the "b" substituents may be the same as those of the "a" substituents above.

Moreover, "m" in the general formula (IIIa) represents an integer of 1 to 5. Herein, if m is 2 or greater, a plurality of the "b" substituents may be identical to or different from one another, or the substituents may form a ring.

$R^1$, $R^2$, a and n in the general formula (IIIa) each represent the same as above.

The bishydrazone compounds according to the present embodiment of the invention, which are represented by the general formula (Ia), can be easily produced by, for example, the following.

First, a compound represented by the following general formula (VIa):

(VIa)

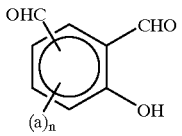

is reacted with a compound represented by the following general formula (VIIa):

(VIIa)

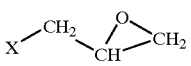

so as to produce a compound represented by the following general formula (Va):

(Va)

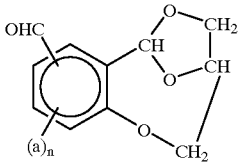

In the general formulae (Va) and (VIa), "a" and n each represent the same as above. In the general formula (VIIa), X represents a halogen atom such as a chlorine atom or a bromine atom. Particularly, when X is a chlorine atom or a bromine atom, the compound is superior in terms of the reactivity and the handling property of the reagent.

This reaction may be effectuated by, for example, heating while stirring (at about 80° C. to 130° C. for about 2 to 8 hours, using a solvent such as diethyl ether, tetrahydrofuran, ethylene glycol dimethyl ether and 1,4-dioxane, or without using a solvent) 1.0 equivalent of the compound represented by the general formula (VIa) and about 1.0 to 20.0 equivalents of the compound represented by the general formula (VIIa), along with about 0.01 to 2.00 equivalents of an organic amine base such as triethylamine, diisopropylethylamine, pyridine, 1,8-diazabicyclo[5.4.0]undec-7-en and 1,5-diazabicyclo[4.3.0]non-5-en, or an inorganic base such as potassium carbonate, sodium carbonate, calcium carbonate, sodium acetate, potassium acetate, calcium acetate, potassium oxalate and sodium oxalate.

Then, after the resultant compound represented by the general formula (Va) is cleaved with a periodate under an acidic condition, an intramolecular aldol cyclization reaction is effectuated, thereby producing a compound represented by the general formula (IVa):

(IVa)

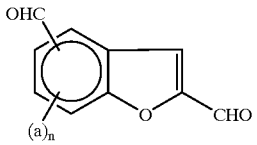

In the general formula (IVa), "a" and n each represent the same as above.

This reaction may be effectuated by, for example: heating while stirring (at about 60° C. to 90° C. for about 2 to 4 hours, using a mixed solvent containing an organic solvent, such as acetonitrile, tetrahydrofuran, ethylene glycol dimethyl ether and 1,4-dioxane, and water at a mixing ratio of about 1:4 to 4:1, under an acidic condition such as those with acetic acid, hydrochloric acid, sulfuric acid or nitric acid) 1.0 equivalent of the compound represented by the general formula (Va) and about 1.0 to 2.0 equivalents of perchlorate or periodate; thereafter, diluting the resultant solution with an organic solvent such as dichloromethane and chloroform; adding about 1.00 to 5.00 equivalents of an organic amine base such as triethylamine, diisopropylethylamine, pyridine, 1,8-diazabicyclo[5.4.0]undec-7-en and 1,5-diazabicyclo[4.3.0]non-5-en, or an inorganic base such as potassium carbonate, sodium carbonate, calcium carbonate, sodium acetate, potassium acetate, calcium acetate, potassium oxalate and sodium oxalate; and heating while stirring the resultant solution at about 30° C. to 50° C. for about 3 to 6 hours.

Then, the resultant compound represented by the general formula (IVa) is reacted with a hydrazine reagent represented by the following general formula (VIIIa):

(VIIIa)

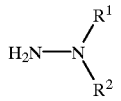

thereby obtaining the bishydrazone compound of the present invention represented by the general formula (Ia).

In the general formula (VIIIa), $R^1$ and $R^2$ each represent the same as above.

This reaction may be effectuated by, for example, heating while stirring (at about 40° C. to 80° C. for 3 to 10 hours, using an organic solution such as ethanol, methanol, acetonitrile, tetrahydrofuran and 1,4-dioxane) 1.0 equivalent of the compound represented by the general formula (IVa) and about 2.00 to 2.40 equivalents of a hydrazine reagent represented by the general formula (VIIIa), using about 0.0001 to 0.001 equivalent of a catalyst such as acetic acid, potassium acetate, calcium acetate and sodium acetate.

Embodiment 2

Hereinafter, Embodiment 2 of the present invention will be described.

The bishydrazone compound according to the present embodiment of the invention is represented by the following general formula (Ib) or (IXb):

(Ib)

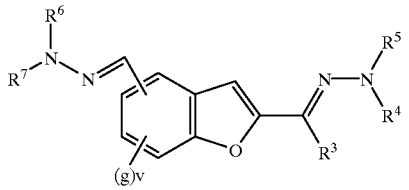

(IXb)

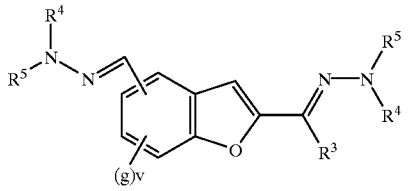

In the general formulae (Ib) and (IXb), $R^4$, $R^5$, $R^6$ and $R^7$ each represent a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms. Alternatively, $R^4$ and $R^5$ or $R^6$ and $R^7$ may form a ring structure via an atom, an atomic group, a substituted or unsubstituted alkylene group, a substituted or unsubstituted vinylene group, or a bivalent linking group. Specific examples of $R^4$, $R^5$, $R^6$ and $R^7$ include: an aryl group such as phenyl, tolyl, methoxyphenyl, naphthyl, pyrenyl, biphenyl; a heterocyclic group such as benzofuryl, benzothiazolyl, benzoxazolyl and N-ethylcarbazolyl; an aralkyl group such as methylbenzyl, methoxybenzyl and 2-thienylmethyl; an alkyl group such as methyl, ethyl and n-propyl; a perfluoroalkyl group such as trifluoromethyl; and a fluoroalkyl group such as 1,1,1-trifluoroethyl.

Moreover, $R^3$ in the general formulae (Ib) and (IXb) represents a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms. Specific examples of $R^3$ include: an aryl group such as phenyl, tolyl, methoxyphenyl, naphthyl, pyrenyl, biphenyl; a heterocyclic group such as benzofuryl, benzothiazolyl, benzoxazolyl and N-ethylcarbazolyl; an aralkyl group such as methylbenzyl, methoxybenzyl and 2-thienylmethyl; an alkyl group such as methyl, ethyl and n-propyl; a perfluoroalkyl group such as trifluoromethyl; and a fluoroalkyl group such as 1,1,1-trifluoroethyl.

Furthermore, "g" in the general formulae (Ib) and (IXb) represents a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom. Specific examples of the "g" substituent include: an alkyl group such as methyl, ethyl, n-propyl and iso-propyl; an alkoxy group such as methoxy, ethoxy, n-propoxy and iso-propoxy; a dialkylamino group such as dimethylamino, diethylamino and di-iso-propylamino; and a halogen atom such as fluorine, chlorine and bromine. Generally, it is preferable that the substituent is an electron donative substituent.

Furthermore, "v" in the general formulae (Ib) and (IXb) represents an integer of 1 to 3. Herein, if v is 2 or greater, a plurality of the "g" substituents may be identical to or different from one another, or the substituents may form a ring.

Particularly, the bishydrazone compounds represented by the general formula (Ib) or (IXb), which are superior in terms of the electrophotographic characteristics, cost and production, include those where: one of $R^4$ and $R^5$ is a phenyl group, a p-methylphenyl group or a 2-thienylmethyl group while the other is a methyl group, an ethyl group or a phenyl group; one of $R^6$ and $R^7$ is a phenyl group, a p-methylphenyl group or a 2-thienylmethyl group while the other is a methyl group, an ethyl group or a phenyl group; $R^3$ is a methyl group or a trifluoromethyl group; and "g" is a hydrogen atom.

Next, the specific examples of the bishydrazone compounds represented by the general formula (Ib) or (IXb) include those having a structure as shown in Tables 5 to 8 below, though the bishydrazone compound of the present invention is not limited thereto.

TABLE 5

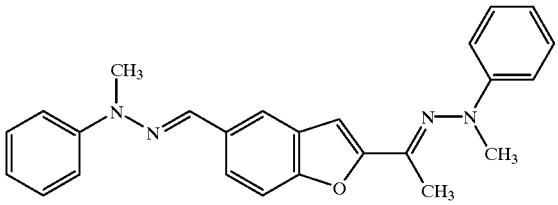

Cpd. No. 61

TABLE 5-continued
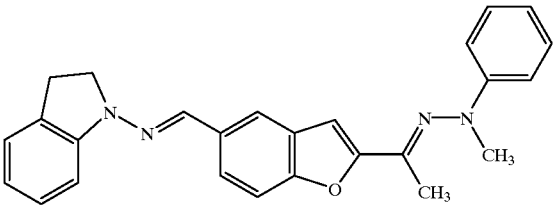
Cpd. No. 62
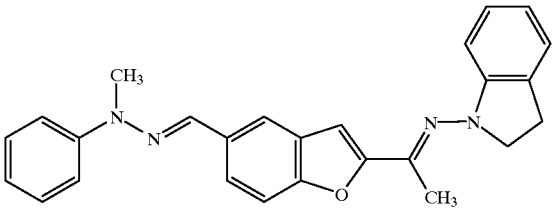
Cpd. No. 63
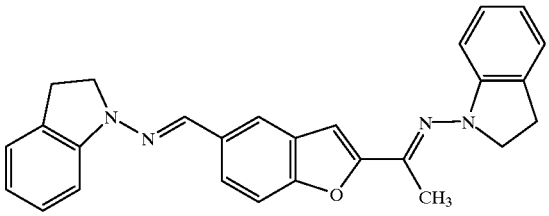
Cpd. No. 64
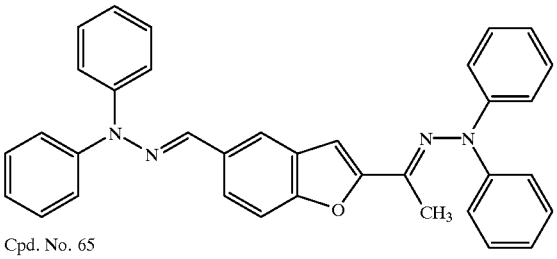
Cpd. No. 65
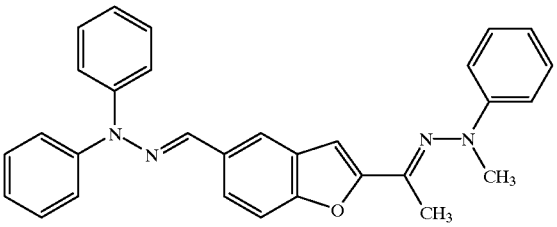
Cpd. No. 66
TABLE 5-continued
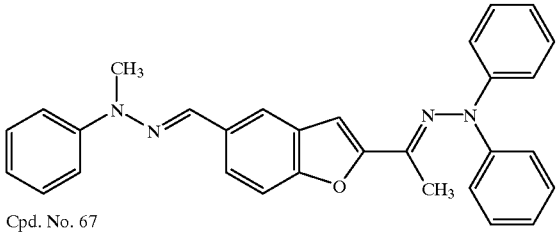
Cpd. No. 67
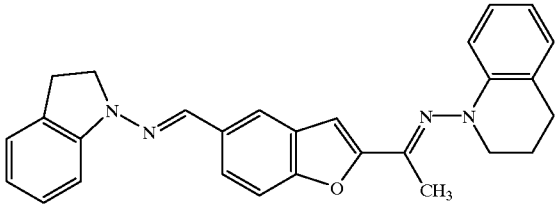
Cpd. No. 68
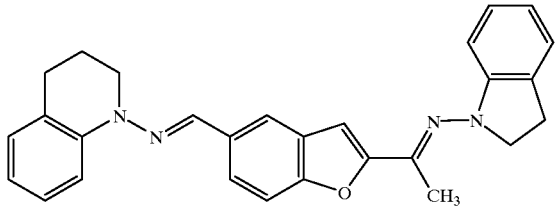
Cpd. No. 69
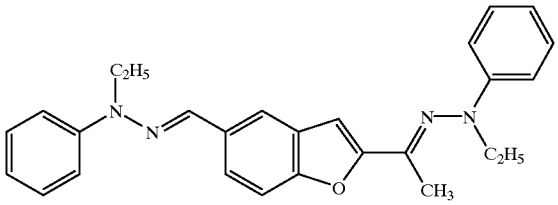
Cpd. No. 70
TABLE 6
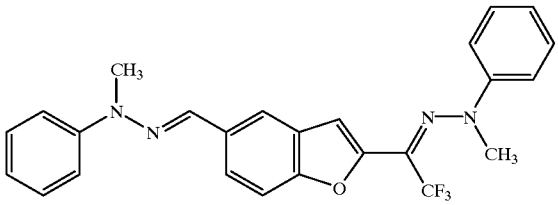
Cpd. No. 71

TABLE 6-continued
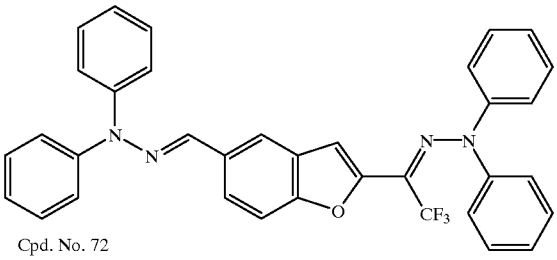
Cpd. No. 72
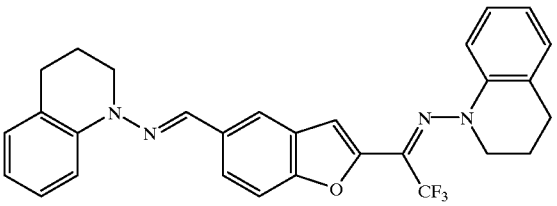
Cpd. No. 73
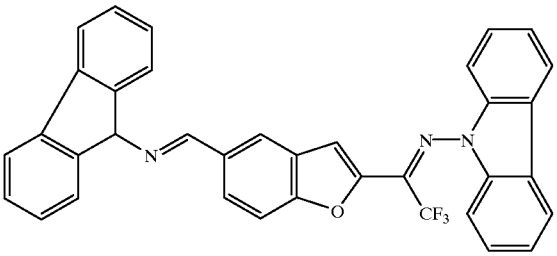
Cpd. No. 74
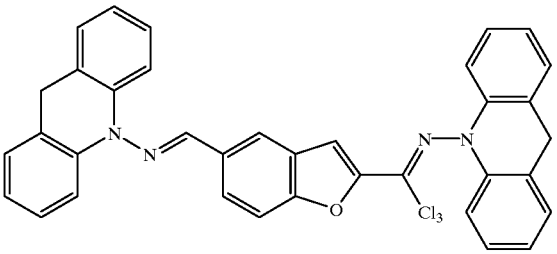
Cpd. No. 75
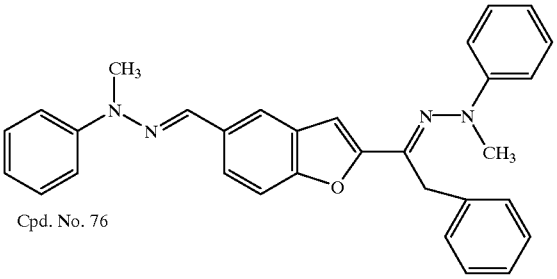
Cpd. No. 76
TABLE 6-continued
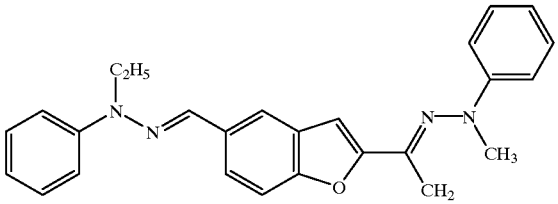
Cpd. No. 77
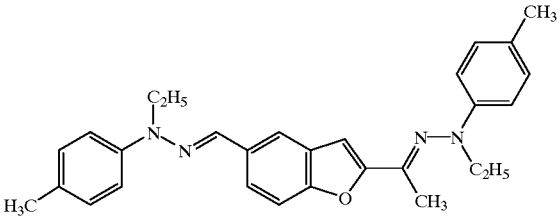
Cpd. No. 78
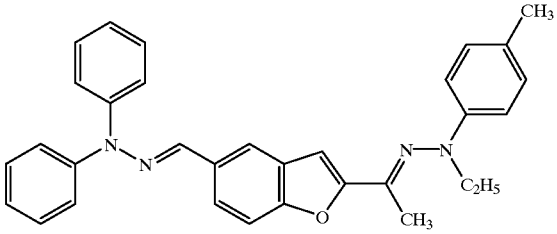
Cpd. No. 79
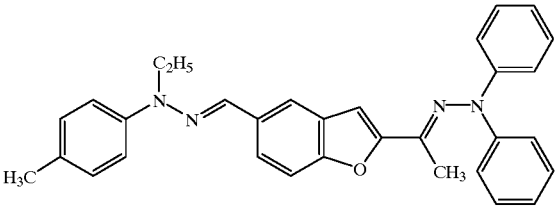
Cpd. No. 80
TABLE 7
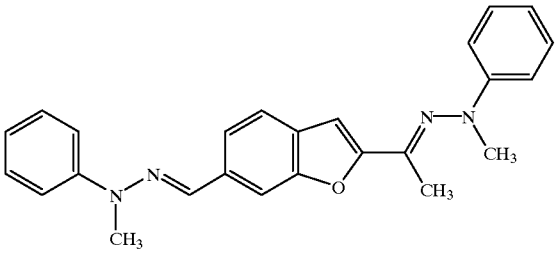
Cpd. No. 81

TABLE 7-continued
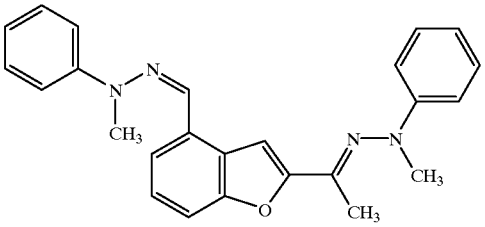
Cpd. No. 82
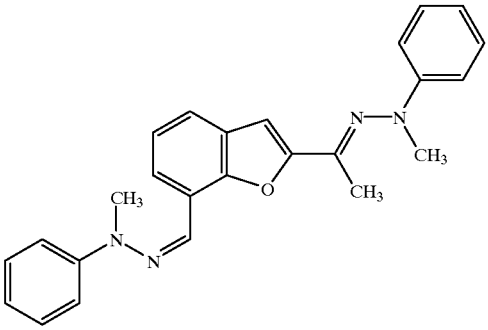
Cpd. No. 83
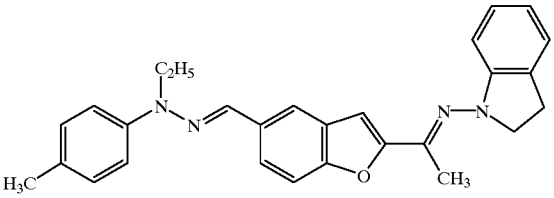
Cpd. No. 84
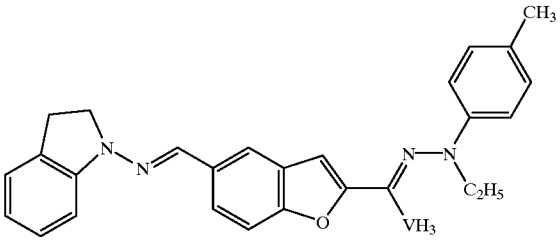
Cpd. No. 85
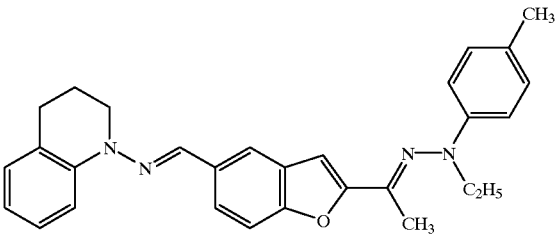
Cpd. No. 86
TABLE 7-continued
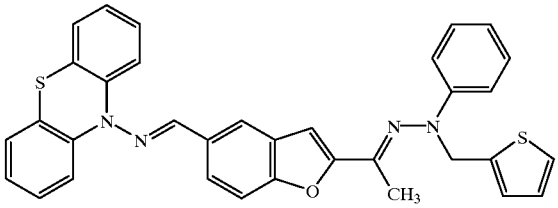
Cpd. No. 87
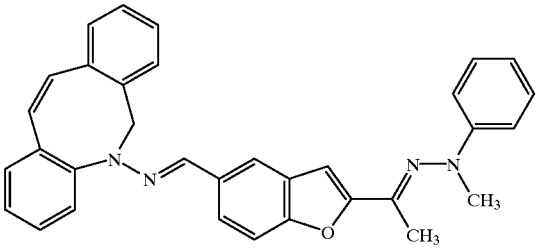
Cpd. No. 88
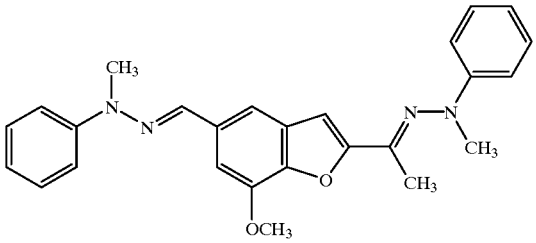
Cpd. No. 89
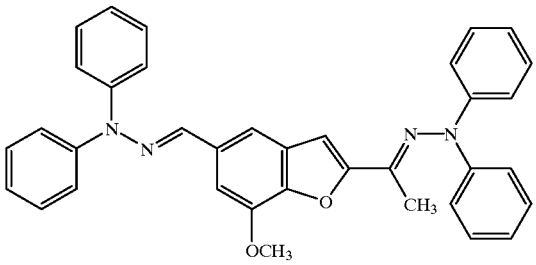
Cpd. No. 90

TABLE 8
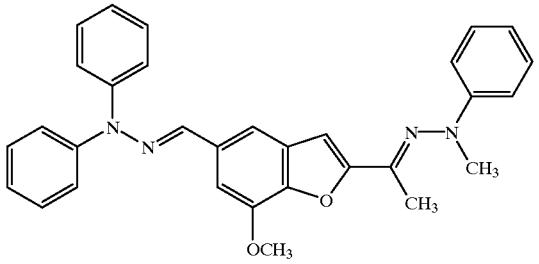
Cpd. No. 91
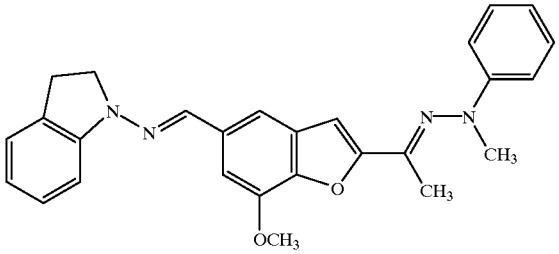
Cpd. No. 92
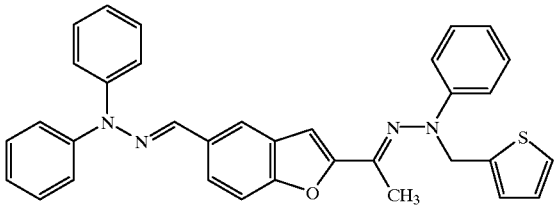
Cpd. No. 93
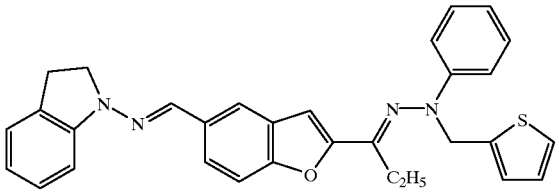
Cpd. No. 94
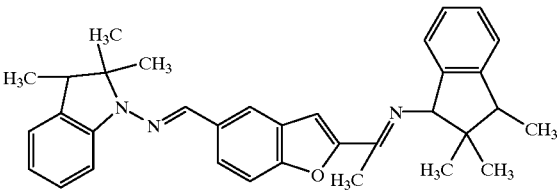
Cpd. No. 95

TABLE 8-continued
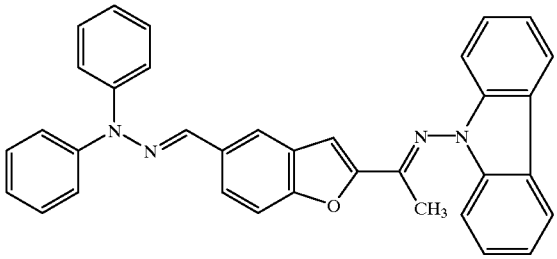
Cpd. No. 96
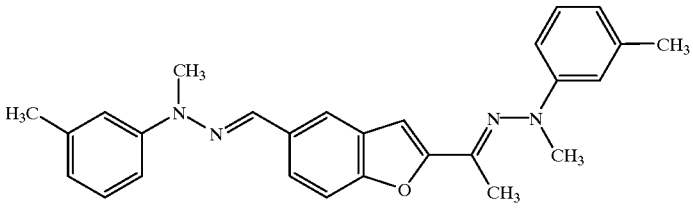
Cpd. No. 97
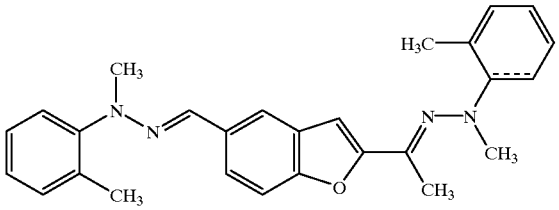
Cpd. No. 98
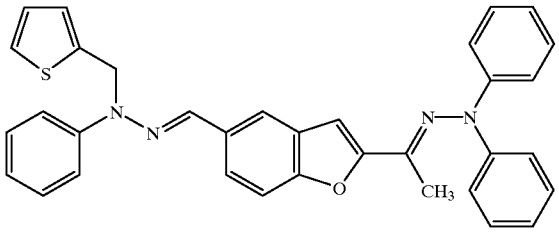
Cpd. No. 99
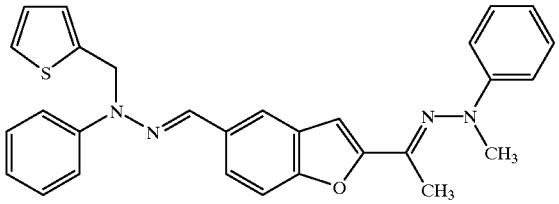
Cpd. No. 100

TABLE 8-continued

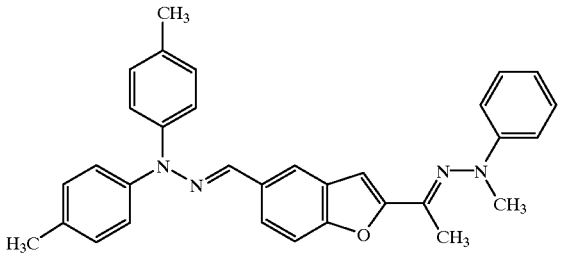

Cpd. No. 101

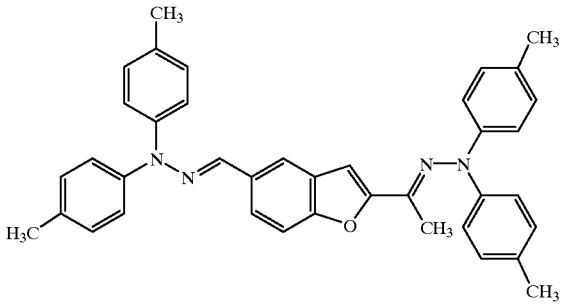

Cpd. No. 102

The bishydrazone compound according to the present embodiment of the invention, which is represented by the general formula (Ib), can be easily produced by, for example, the following.

First, a compound represented by the following general formula (XIIb):

(XIIb)

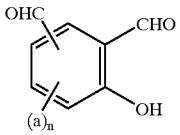

is reacted with a compound represented by the following general formula (XIIIb):

(XIIIb)

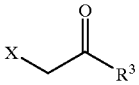

so as to produce a compound represented by the following general formula (Xb):

(Xb)

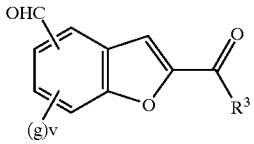

In the general formulae (Xb), (XIIb) and (XIIIb), X represents a halogen atom such as a chlorine atom or a bromine atom, and $R^3$, "g" and v each represent the same as above. Particularly, when X is a chlorine atom or a bromine atom, the compound is advantageous in terms of the handling property of the reagent and the reactivity.

This reaction may be effectuated by, for example, heating while stirring (at about 80° C. to 130° C. for about 2 to 8 hours, using a solvent such as diethyl ether, tetrahydrofuran, ethylene glycol dimethyl ether and 1,4-dioxane, or without using a solvent) 1.0 equivalent of the compound represented by the general formula (XIIb) and about 1.0 to 20.0 equivalents of the compound represented by the general formula (XIIIb), along with about 0.01 to 4.00 equivalents of an organic amine base such as triethylamine, diisopropylethylamine, pyridine, 1,8-diazabicyclo[5.4.0]undec-7-en and 1,5-diazabicyclo-[4.3.0]non-5-en, or an inorganic base such as potassium carbonate, sodium carbonate, calcium carbonate, sodium acetate, potassium acetate, calcium acetate, potassium oxalate and sodium oxalate.

Then, the resultant compound represented by the following general formula (Xb):

(Xb)

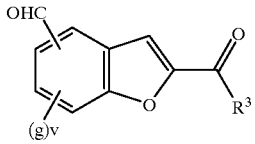

is reacted with a hydrazine reagent represented by the following general formula (XIVb):

(XIVb)

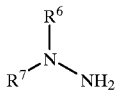

thereby obtaining the compound represented by the following general formula (XIb):

(XIb)

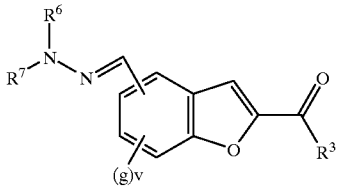

In the general formulae (Xb), (XIVb) and (XIb), $R^3$, $R^4$, $R^5$, "g" and v each represent the same as above.

This reaction may be effectuated by, for example, heating while stirring (at about 0° C. to 30° C. for about 2 to 8 hours, using a solvent such as ethanol, methanol, tetrahydrofuran, ethylene glycol dimethyl ether and 1,4-dioxane) 1.0 equivalent of the compound represented by the general formula (Xb) and about 0.9 to 1.1 equivalents of a hydrazine reagent represented by the general formula (XIVb) or a hydrochloride thereof, using about 0.001 to 0.1 equivalent of a catalyst of an organic acid such as acetic acid or an organic acid salt such as sodium acetate and potassium acetate.

Then, the resultant compound represented by the following general formula (XIb):

(XIb)

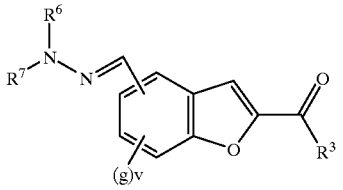

is reacted with a hydrazine reagent represented by the following general formula (XVb):

(XVb)

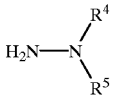

thereby obtaining the bishydrazone compound of the present invention represented by the following general formula (Ib):

(Ib)

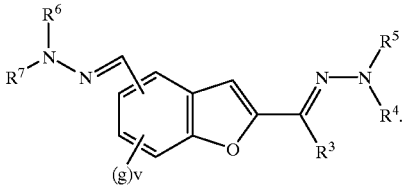

In the general formulae (XIb), (XVb) and (Ib), $R^3$, $R^4$, $R^5$, $R^6$, $R^7$, "gg" and v each represent the same as above.

This reaction may be effectuated by, for example, heating while stirring (at about 60° C. to 110° C. for about 2 to 8 hours, using a solvent such as ethanol, methanol, tetrahydrofuran, ethylene glycol dimethyl ether and 1,4-dioxane) 1.0 equivalent of the compound represented by the following general formula (XIb) and about 1.0 to 1.5 equivalents of a hydrazine reagent represented by the general formula (XVb) or a hydrochloride thereof, using about 0.001 to 0.1 equivalent of a catalyst of an organic acid such as acetic acid or an organic acid salt such as sodium acetate and potassium acetate.

The bishydrazone compound according to the present embodiment of the invention, which is represented by the general formula (IXb), can be easily produced by, for example, the following.

First, a compound represented by the following general formula (Xb):

(Xb)

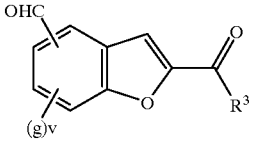

is reacted with the hydrazine reagent represented by the following general formula (XVb):

(XVb)

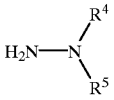

so as to produce the bishydrazone compound of the present invention represented by the following general formula (IXb):

(IXb)

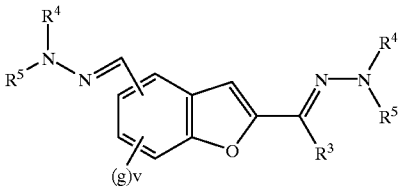

In the general formulae (Xb), (XVb) and (IXb), $R^3$, $R^4$, $R^5$, "g" and v each represent the same as above.

This reaction may be effectuated by, for example, heating while stirring (at about 60° C. to 110° C. for about 2 to 8 hours, using a solvent such as ethanol, methanol, tetrahydrofuran, ethylene glycol dimethyl ether and 1,4-dioxane) 1.0 equivalent of the compound represented by the general formula (Xb) and about 2.0 to 3.0 equivalents of a hydrazine reagent represented by the general formula (XVb) or a hydrochloride thereof, along with about 0.001 to 0.1 equivalent of a catalyst of an organic acid such as acetic acid or an organic acid salt such as sodium acetate and potassium acetate.

A photoreceptor for electrophotography according to the present embodiment is obtained by using one or more of the above-described bishydrazone compounds. Moreover, in some cases, in addition to the above-described bishydrazone compounds, another charge transfer substance may also be used including: a styryl compound such as β-phenyl-[4-(benzylamino)]stilbene, β-phenyl-[4-(N-ethyl-N-phenylamino)]stilbene, and 1,1-bis(4-diethylaminophenyl)-4,4-diphenylbutadiene; a hydrazone compound such as 4-(dibenzylamino)benzaldehyde-N,N-diphenylhydrazone, 4-(ethylphenylamino)benzaldehyde-N,N-diphenylhydrazone, 4-di(p-tolylamino)benzaldehyde-N,N-diphenylhydrazone, and 3,3-bis-(40-diethylaminophenyl) acrolein-N,N-diphenylhydrazone; and a triphenylamine compound such as 4-methoxy-4'-(4-methoxystyryl) triphenylamine and 4-methoxy-4'-styryltriphenylamine.

Embodiment 3

Hereinafter, Embodiment 3 of the present invention will be described.

The cyclic bishydrazone compound according to the present embodiment of the invention is represented by the following general formula (Ic):

(Ic)

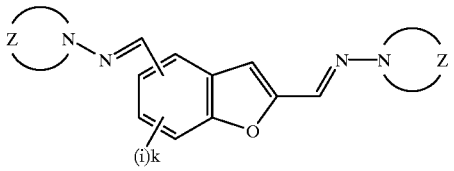

In the general formula (Ic), "Z" represents a substituted or unsubstituted heterocycle, a substituted or unsubstituted atomic group which has a bivalent group necessary for forming a condensed heterocycle. Specific examples of the "Z" substituent include a 2,3-dihydroindolyl group, a 1,2,3,4-tetrahydroquinolyl group, a carbazolyl group and a 1,2,3,4-tetrahydrocarbazolyl group. Generally, it is preferable that the substituent is the 2,3-dihydroindolyl group or the 1,2,3,4-tetrahydrocarbazolyl group.

Moreover, "i" in the general formula (Ic) represents an alkyl group which has 1 to 3 carbon atoms, an alkoxy group which has 1 to 3 carbon atoms, a dialkylamino group which has 1 to 3 carbon atoms, a halogen atom, or a hydrogen atom. Specific examples of the "i" substituent include: an alkyl group such as a methyl group, an ethyl group, an n-propyl group and iso-propyl group; an alkoxy group such as a methoxy group, an ethoxy group and a propoxy group; a dialkylamino group such as a dimethylamino group, a diethylamino group, a di-iso-propylamino group and di-n-butyl amino group; a halogen atom such as fluorine and chlorine; and a hydrogen atom. Generally, it is preferable that the substituent is an electron donative substituent.

Furthermore, "k" in the general formula (Ic) represents an integer of 1 to 3. Herein, if k is 2 or greater, a plurality of the "i" substituents may be identical to or different from one another, or the substituents may form a ring.

Specific examples of the cyclic bishydrazone compound represented by the general formula (Ic) will be provided in Tables 9 to 12 below, though the cyclic bishydrazone compound of the present invention is not limited thereto.

TABLE 9

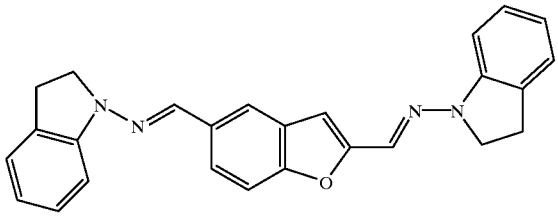

Cpd. No. 111

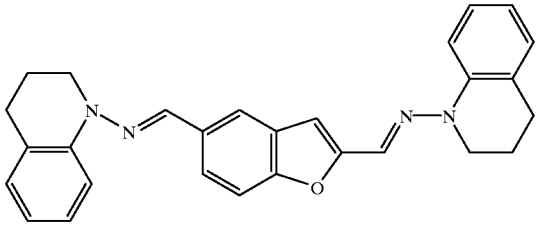

Cpd. No. 112

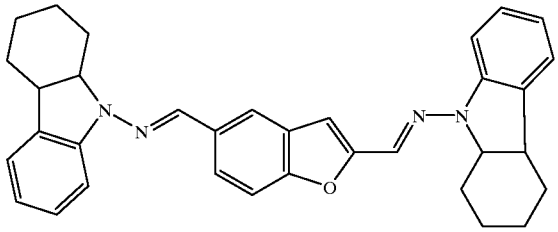

Cpd. No. 113

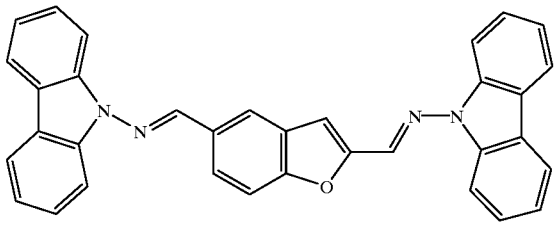

Cpd. No. 114

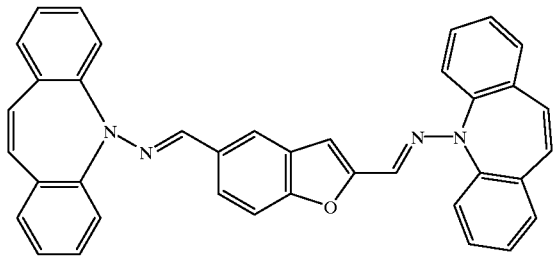

Cpd. No. 115

TABLE 9-continued
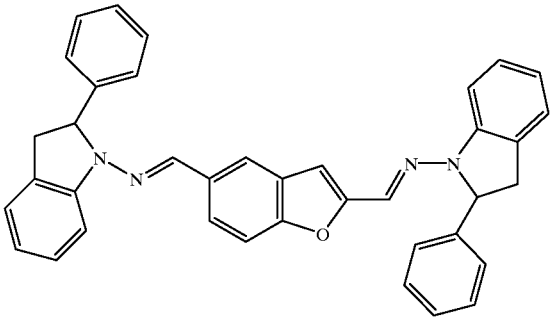
Cpd. No. 116
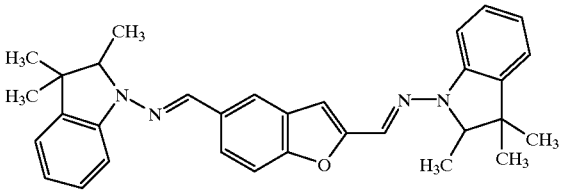
Cpd. No. 117
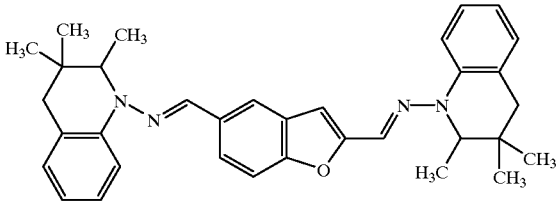
Cpd. No. 118
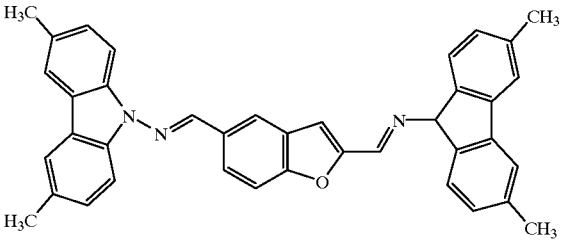
Cpd. No. 119
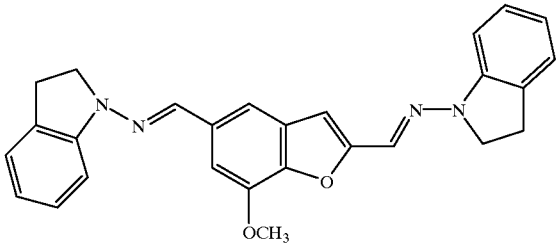
Cpd. No. 120
TABLE 10
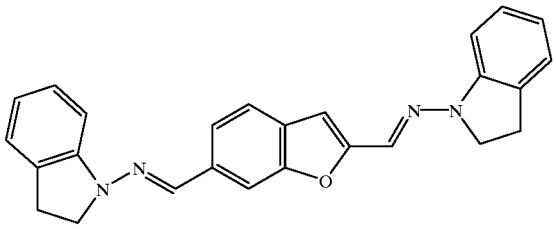
Cpd. No. 121
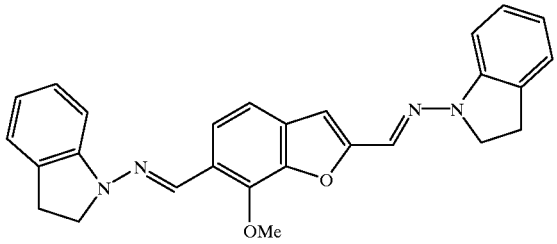
Cpd. No. 122
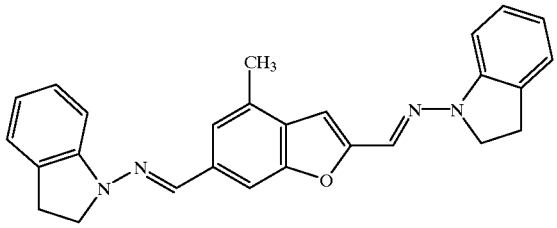
Cpd. No. 123
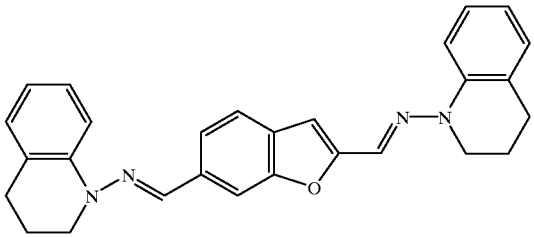
Cpd. No. 124
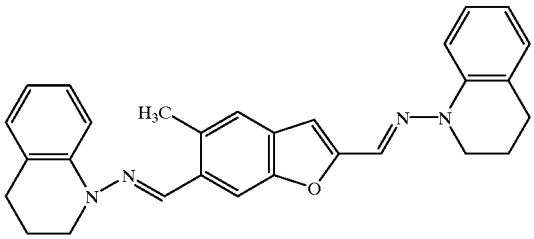
Cpd. No. 125

TABLE 10-continued
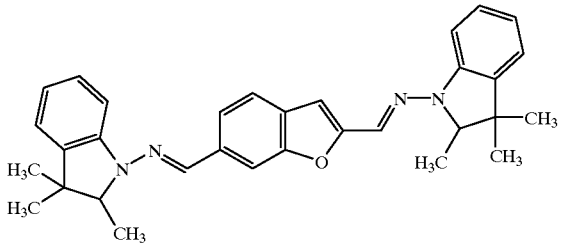
Cpd. No. 126
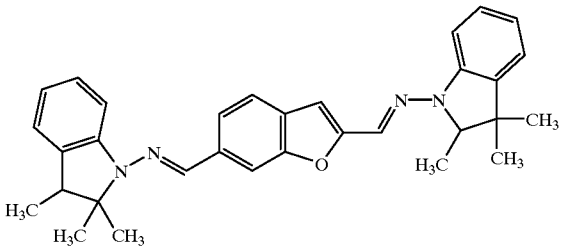
Cpd. No. 127
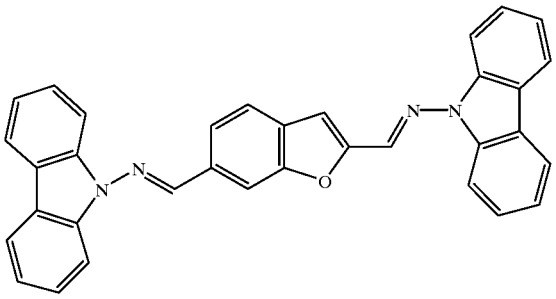
Cpd. No. 128
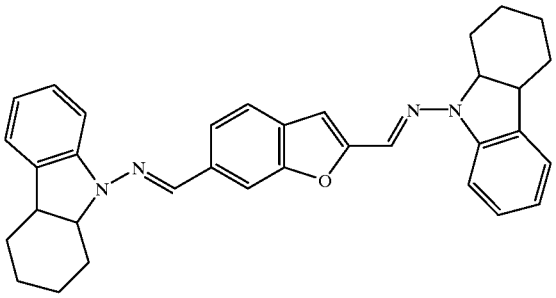
Cpd. No. 129
TABLE 10-continued
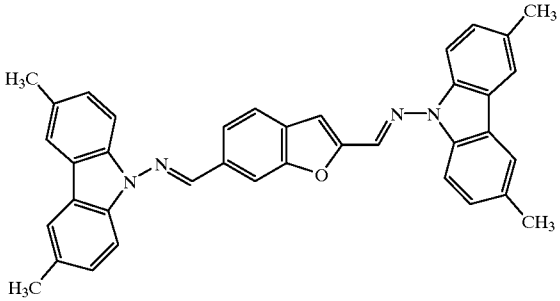
Cpd. No. 130
TABLE 11
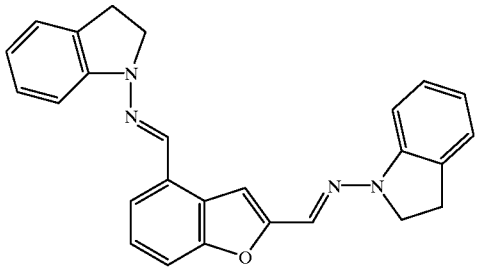
Cpd. No. 131
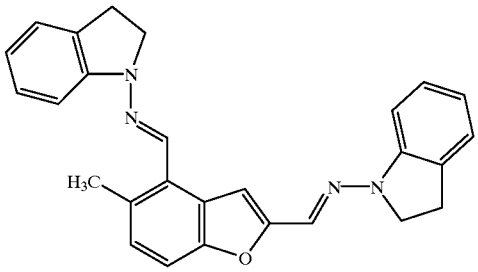
Cpd. No. 132
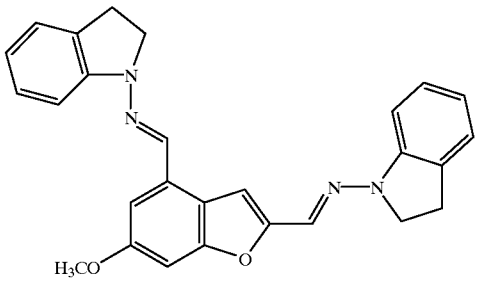
Cpd. No. 133

TABLE 11-continued
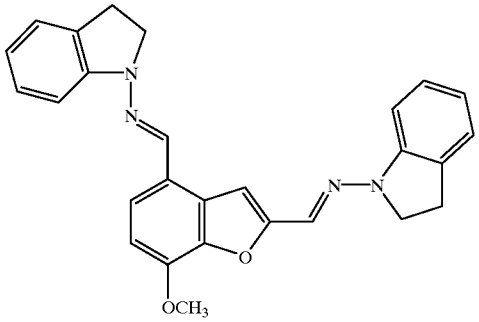
Cpd. No. 134
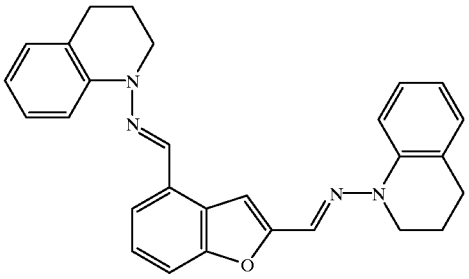
Cpd. No. 135
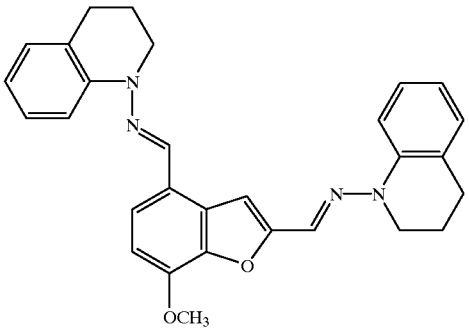
Cpd. No. 136
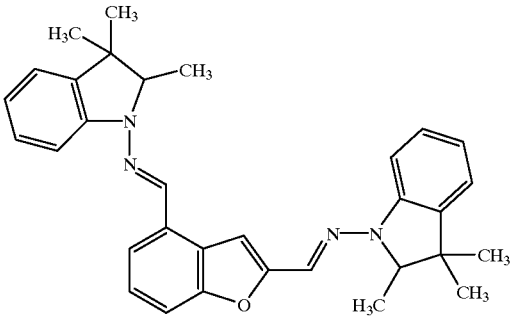
Cpd. No. 137
TABLE 11-continued
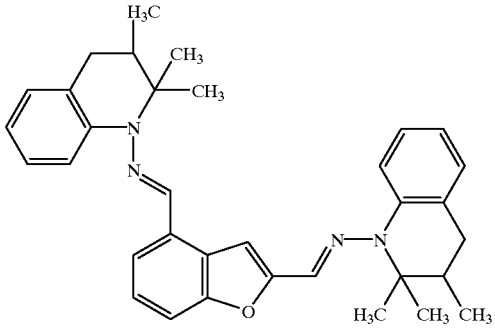
Cpd. No. 138
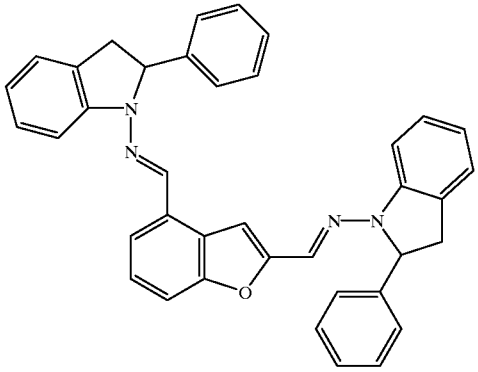
Cpd. No. 139
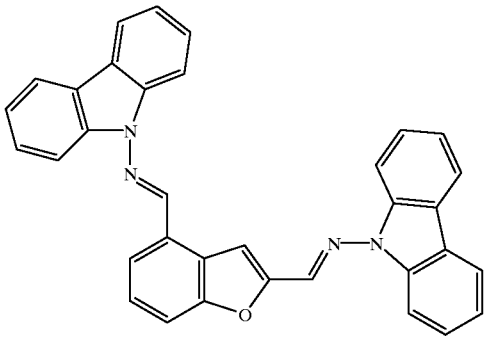
Cpd. No. 140

TABLE 12
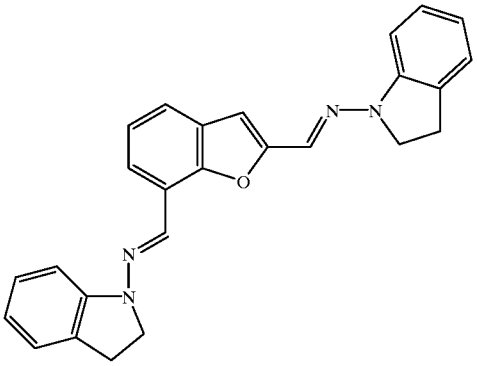
Cpd. No. 141
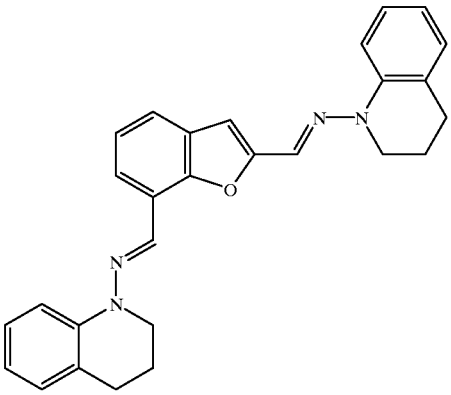
Cpd. No. 142
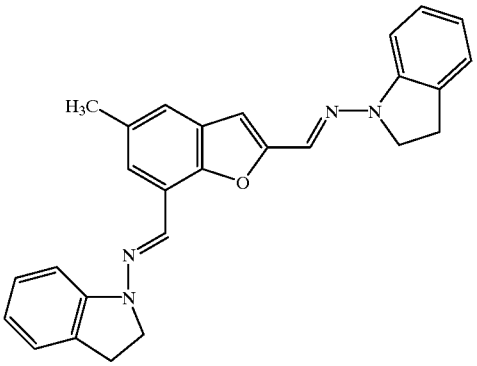
Cpd. No. 143
TABLE 12-continued
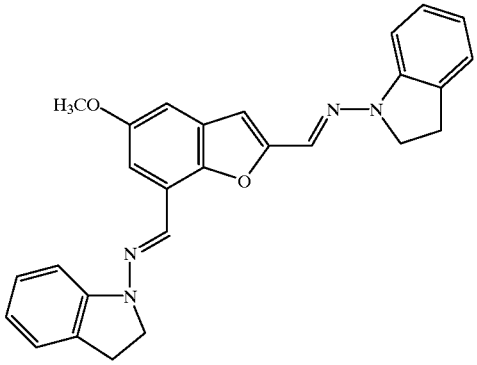
Cpd. No. 144
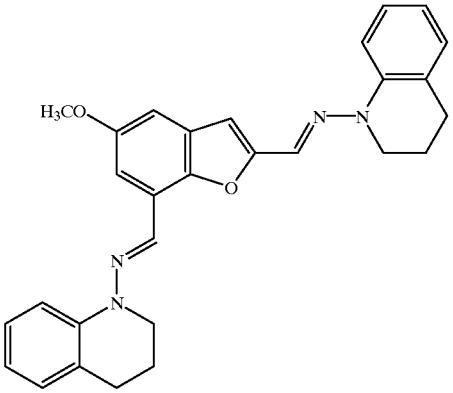
Cpd. No. 145
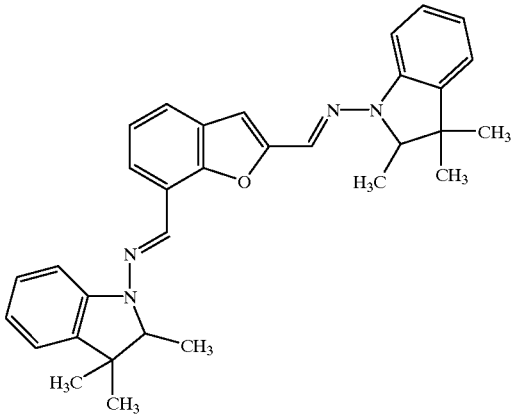
Cpd. No. 146

TABLE 12-continued

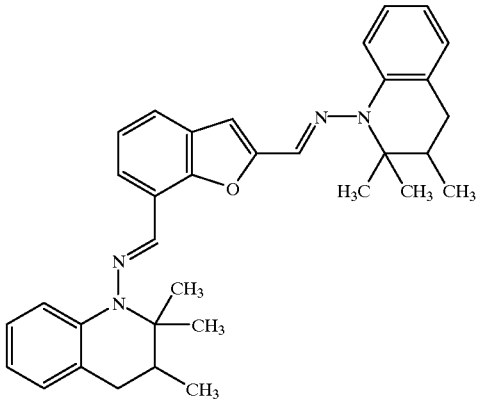

Cpd. No. 147

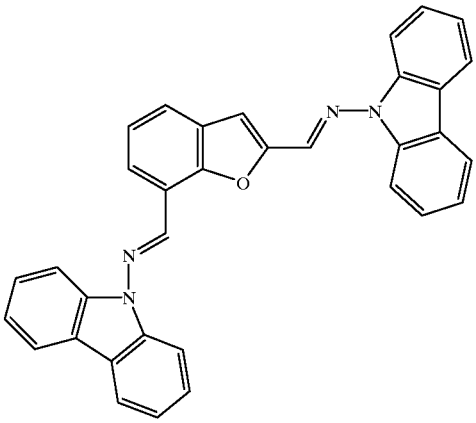

Cpd. No. 148

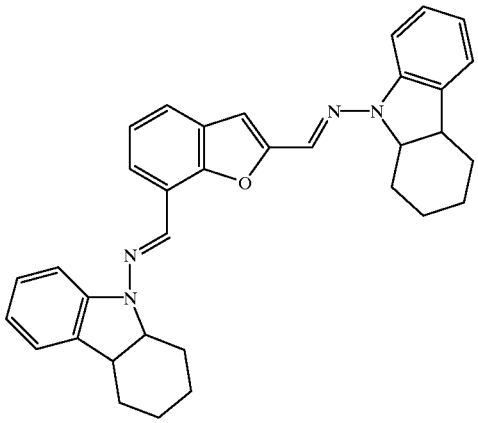

Cpd. No. 149

TABLE 12-continued

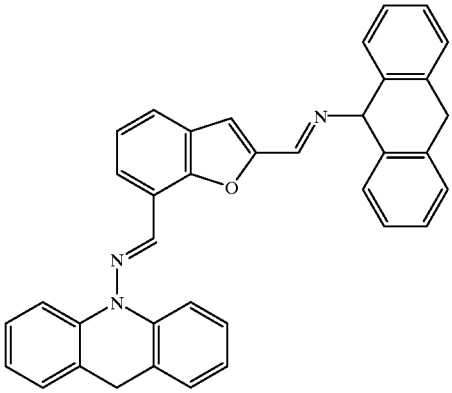

Cpd. No. 150

Among the cyclic bishydrazone compounds represented by the general formula (Ic), those represented by the following general formula (IIc) are suitable for mass-production since the synthesis materials thereof are currently easily available:

(IIc)

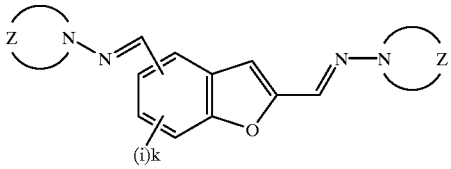

In the general formula (IIc), "Z", "i" and k each represent the same as above.

Moreover, among the cyclic bishydrazone compounds represented by the general formula (Ic), for those represented by the following general formula (IIIc) or (IVc), the hydrazine reagent, which is necessary for synthesizing the cyclic bishydrazone compound of the present invention, is available in wide variety.

(IIIc)

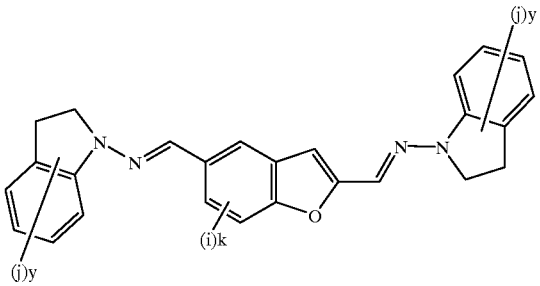

(IVc)

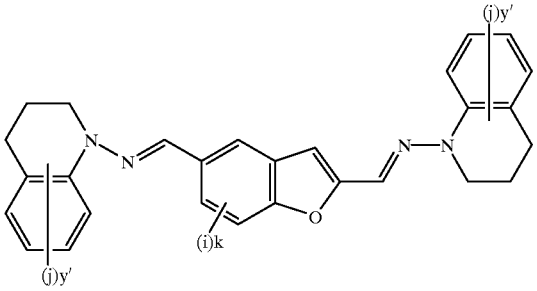

In the general formula (IIIc), "j" represents an alkyl group which has 1 to 3 carbon atoms, an alkoxy group which has 1 to 3 carbon atoms, a dialkylamino group which has 1 to 3 carbon atoms, a halogen atom, or a hydrogen atom, y represents an integer of 1 to 8, wherein, if y is 2 or greater, a plurality of "j" substituents may be identical to or different from one another, or the substituents may form a ring, and "i" and k each represent the same as above.

In the general formula (IVc), y' represents an integer of 1 to 10, and "i", "j" and k each represent the same as above.

Specific examples of the "j" substituent may be the same as those of the "i" substituents above.

The cyclic bishydrazone compound according to the present embodiment of the invention can be easily produced by, for example, the following.

A compound represented by the following general formula (Vc):

(Vc)

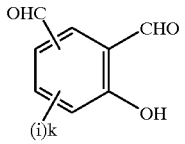

is reacted with a hydrazine reagent represented by the following general formula (VIc):

(VIc)

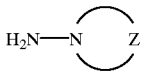

so as to produce the cyclic bishydrazone compound according to the present embodiment of the invention, which is represented by the general formula (Ic).

In the general formulae (Vc) and (VIc), "Z", "i" and k each represent the same as above.

This reaction may be effectuated by, for example: heating while stirring (at about 40° C. to 80° C. for about 3 to 10 hours, using an organic solvent such as ethanol, methanol, acetonitrile, tetrahydrofuran and 1,4-dioxane) 1.0 equivalent of the compound represented by the general formula (Vc) and about 2.00 to 2.40 equivalents of a hydrazine reagent represented by the general formula (VIc), along with about 0.0001 to 0.001 equivalent of a catalyst such as acetic acid, potassium acetate, calcium acetate and sodium acetate.

A photoreceptor for electrophotography of the present invention has a photosensitive layer with a photoconduction function provided on a conductive support. The photosensitive layer contains one or more of the bishydrazone compounds represented by the general formula (Ia), (Ib) or (Ic). Such a photoreceptor has superior characteristics, e.g., the chargeability is high and the photosensitivity is scarcely lowered in repeated use.

The photosensitive layer may be provided in a variety of forms. For example, the photosensitive layer may be provided in a layered structure including a charge generation layer which contains a charge generation substance so as to have an improved charge generation efficiency and a charge transfer layer which contains a charge transfer substance, or in a single layer which contains a charge generation substance and a charge transfer substance. Specifically, the photoreceptor may be obtained by providing, on a conductive support, a material which contains a bishydrazone compound and a sensitizing dye, optionally with a chemical sensitizing agent or an electron withdrawing compound, all dissolved or dispersed in a binder resin. Alternatively, in the case of employing the layered structure including a carrier generation layer with a high charge carrier generation efficiency and a carrier transfer layer, the photoreceptor may be a layered photoreceptor which is obtained by providing a carrier transfer layer on a carrier generation layer, which is provided on a conductive support. The main component of the carrier generation layer is a sensitizing dye or a pigment, typically an azo type pigment or a phthalocyanine type pigment. The carrier transfer layer contains the bishydrazone compound of the present invention dissolved or dispersed in a binder resin. Optionally, an antioxidizing compound or an electron withdrawing compound may be added to the carrier transfer layer. More specifically, possible structures for such a photoreceptor will be illustrated in FIGS. 1 to 5.

FIG. 1 illustrates a photoreceptor for electrophotography of a function separated type, which includes a conductive support 1 and a photosensitive layer 4 provided thereon. The photosensitive layer 4 is formed in a layered structure including a charge generation layer 5 and a charge transfer layer 6. The main component of the charge generation layer 5 is a charge generation substance 2, which is a sensitizing dye or a pigment, typically an azo type pigment or a phthalocyanine type pigment, dissolved or dispersed in a binder. The charge transfer layer 6 contains the bishydrazone compound of the present invention as a charge transfer substance 3 and, optionally, an antioxidant or an electron withdrawing compound, both dissolved or dispersed in a binder.

Figure 2:
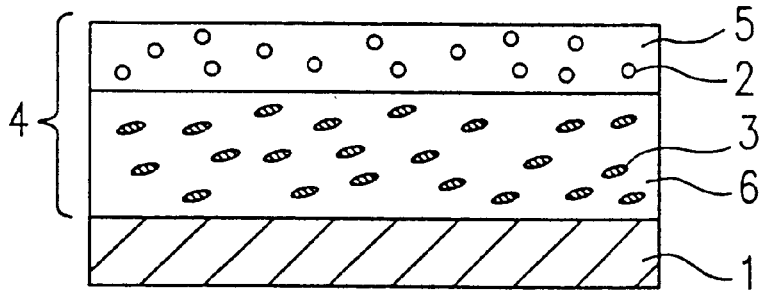
FIG. 2 is a cross sectional view illustrating a photoreceptor for electrophotography according to an embodiment of the present invention.

FIG. 2 illustrates a photoreceptor for electrophotography of a function separated type, which is similar to that illustrated in FIG. 1 and includes the conductive support 1 and the photosensitive layer 4 provided thereon, with the photosensitive layer 4 being formed in a layered structure including the charge generation layer 5 and the charge transfer layer 6. However, the charge generation layer 5 and the charge transfer layer 6 are provided in the order reverse to that in FIG. 1.

Figure 3:
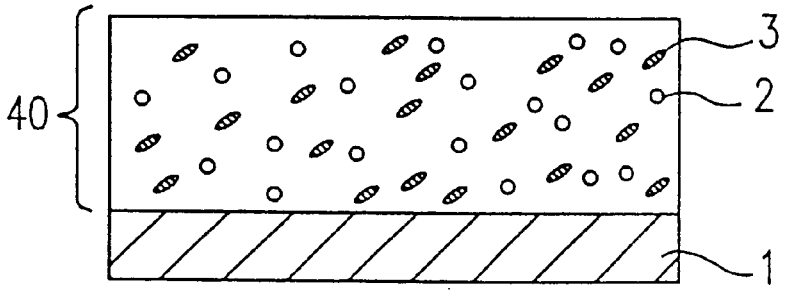
FIG. 3 is a cross sectional view illustrating a photoreceptor for electrophotography according to an embodiment of the present invention.

FIG. 3 illustrates a photoreceptor for electrophotography of a single layer type, which includes the conductive support 1 and a photosensitive layer 40. The photosensitive layer 40 has both functions as a charge generation layer and as a charge transfer layer. The photosensitive layer 40 contains the bishydrazone compound of the present invention as the charge transfer substance 3 and a sensitizing dye as the charge generation substance 2, optionally with a chemical sensitizing agent or an electron withdrawing compound, all dissolved or dispersed in a binder resin.

Figure 4:
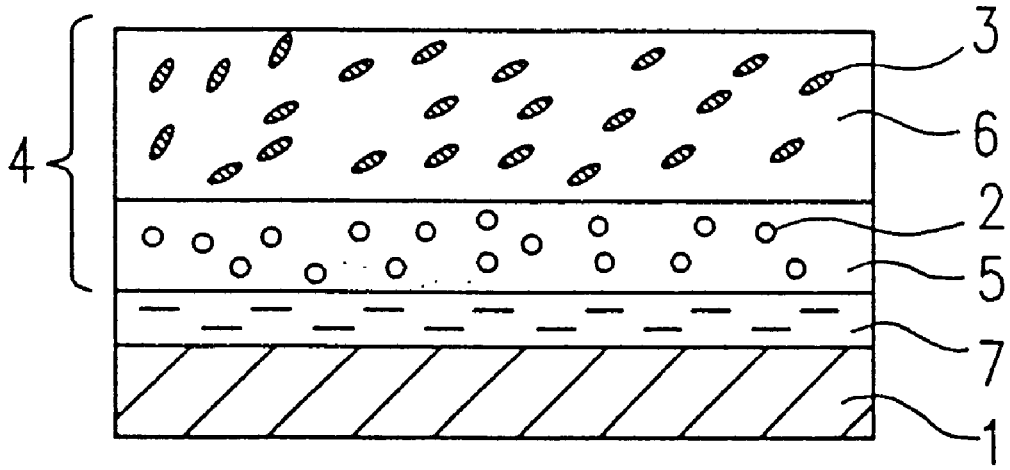
FIG. 4 is a cross sectional view illustrating a photoreceptor for electrophotography according to an embodiment of the present invention.

FIG. 4 illustrates a photoreceptor for electrophotography of a function separated type, which is similar to that illustrated in FIG. 1 and includes the conductive support 1 and the photosensitive layer 4 provided thereon, with the photosensitive layer 4 being formed in a layered structure including the charge generation layer 5 and the charge transfer layer 6. An intermediate layer 7 is provided between the conductive support 1 and the photosensitive layer 4. The intermediate layer 7 is intended to provide a protection function and an adhesion function so as to improve the coating property, and further to improve the charge injection from the conductive support 1 to the photosensitive layer 4.

Figure 5:
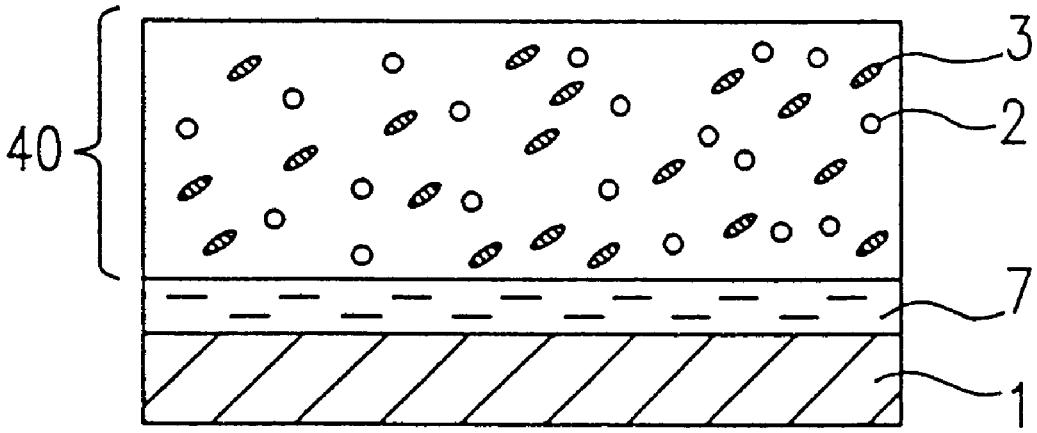
FIG. 5 is a cross sectional view illustrating a photoreceptor for electrophotography according to an embodiment of the present invention.

FIG. 5 illustrates a photoreceptor for electrophotography of a single layer type, which is similar to that illustrated in FIG. 3 and includes the conductive support 1 and the photosensitive layer 40 provided thereon, with the photosensitive layer 40 containing the charge transfer substance 3 and the charge generation substance 2. The intermediate layer 7 is provided between the conductive support 1 and the photosensitive layer 40. The intermediate layer 7 is intended to provide a protection function and an adhesion function so as to improve the coating property, and further to improve the charge injection from the conductive support 1 to the photosensitive layer 40.

The photosensitive layer 4 or 40 may contain, as the charge transfer substance 3, a substance other than the bishydrazone compound of the present invention, including 4-(dibenzylamino)benzaldehyde-N,N-diphenylhydrazone, 4-(ethylphenylamino)benzaldehyde-N,N-diphenylhydrazone, 4-di(p-tolylamino)benzaldehyde-N,N-diphenylhydrazone, 3,3-bis-(4'-diethylaminophenyl) acrolein-N,N-diphenylhydrazone, and a triphenylamine compound such as 4-methoxy-4'-(4-methoxystyryl) triphenylamine and 4-methoxy-4'-styryltriphenylamine.

Various polymeric film-forming binders may be used to form the photosensitive layers 4 and 40 so as to suit the particular application in which the photoreceptors is to be used. For example, in the field of a photoreceptor for use in a copying machine or a printer, it is preferable to use a binder such as a polystyrene resin, a polyvinylacetal resin, a polysulfone resin, a polycarbonate resin, a polyphenyleneoxide resin, a polyester resin, an alkyd resin and a polyalylate resin. One of the above-listed binders may be used alone or two or more of them may be used in combination. Particularly, the polystyrene resin, the polycarbonate resin, the polyphenyleneoxide resin, the polyalylate resin, and the like, are preferable since they have a value of volume resistance of about $10^{13}\Omega$ or higher and are superior in terms of the film forming property and the potential characteristic. Such a binder is added to the bishydrazone compound of the present invention at a weight ratio of about 0.2 to 20 (more preferably about 0.5 to 5) with respect to the bishydrazone compound. When the proportion of the binder is too low, the bishydrazone compound may possibly precipitate at the surface of the photosensitive layer. On the other hand, when the proportion of the binder is too high, the sensitivity may possibly decrease considerably. When the photoreceptor is used in a printing plate, it may be necessary to use an alkaline binder. An alkaline binder refers to a polymeric substance having an acidic group such as an acid anhydride group, a carboxyl group, a phenolic hydroxyl group, a sulfonic group, a sulfonamide group or a sulfonimide group which is soluble in an aqueous or alcoholic alkaline solvent (including a mixed system). Usually, it is preferable that such an alkaline binder has a high acid number of about 100 or greater because a binder having a high acid number is easily dissolved in an alkaline solvent or is easily swelled. Such a binder includes a styrene-maleic anhydride copolymer, a vinyl acetate-maleic anhydride copolymer, a vinyl acetate-crotonic acid copolymer, a methacrylic acid-methacrylic acid ester copolymer, a phenol resin and a methacrylic acid-styrene-methacrylic acid ester copolymer. Such a binder is added to the bishydrazone compound of the present invention at a ratio approximately the same as in the copying machine application.

A sensitizing agent to be contained in the photosensitive layers 4 and 40 includes: a triphenylmethane type dye such as methyl violet, crystal violet, night blue and victoria blue; an acridine dye such as erythrosine, rhodamine B, rhodamine 3R, acridine orange and flapeocine; a thiazine dye such as methylene blue and methylene green; an oxazine dye such as capri blue and meldra blue; a cyanin dye; a styryl dye; a pyrylium salt dye; and a thiopyrylium salt dye. Such a sensitizing agent may be contained in the photosensitive layers 4 and 40 as the charge generation substance 2. In such a case, the sensitizing agent may be used alone or may be used with a pigment which will be described below. The charge generation is likely to be more efficient when the sensitizing agent is used with a pigment.

The pigment which may be contained in the photosensitive layers 4 and 40 as the charge generation substance 2 (which has a photoconduction function and which is provided for generating an electric charge by photoabsorption at an extremely high efficiency) includes: a phthalocyanine-based pigment such as metallophthalocyanine, metal-free phthalocyanine and halogenated metal-free phthalocyanine; a perylene acid pigment such as perylene imide and perylene acid anhydrate; a bisazo type pigment; a trisazo type pigment; a quinacridone type pigment; and an anthraquinone type pigment. Particularly, a superior photoreceptor for electrophotography which exhibits high photosensitivity may be obtained when using a metal-free phthalocyanine pigment, a titanylphthalocyanine pigment, a bisazo type pigment containing fluorene or fluorenon ring, a bisazo pigment containing an aromatic amine or a trisazo pigment.

Moreover, various chemical substances may be optionally added to the photosensitive layers 4 and 40 in order to help prevent the residue charge from increasing in repeated use, and to help prevent the charged potential and the sensitivity from decreasing. Such a chemical substance may be an electron withdrawing compound such as 1-chloroanthraquinone, benzoquinone, 2,3-dichloronaphthoquinone, naphthoquinone, 4,4'-dinitrobenzophenone, 4,4'-dichlorobenzophenone, 4-nitrobenzophenone, 4-nitrobenzalmalondinitryl, α-cyano-β-(p-cyanophenyl)acrylic acid ethyl ester, 9-anthracenylmethylmalondinitryl, 1-cyano-1-(p-nitrophenyl)-2-(p-chlorophenyl)ethylene, 2,7-dinitrofluorenone.

Furthermore, an antioxidant, an anti-curl agent, a leveling agent, and the like, may optionally be added to the photosensitive layers 4 and 40.

The intermediate layer 7 is formed of a material such as casein, polyvinyl butyral, polyvinyl alcohol, nitrocellulose, an ethylene-acrylic acid copolymer, a polyamide (e.g., Nylon 6, Nylon 66, Nylon 610, nylon copolymer and alkoxymethylated nylon), polyurethane and aluminum oxide gel.

The photoreceptor for electrophotography of the present invention is produced by forming the photosensitive layers 4 and 40 containing the bishydrazone compound of the present invention into a film-like layer on the conductive support 1 formed of a metal drum, a metal plate, a paper sheet or a plastic film processed to be electrically conductive with the assistance of the polymeric film-forming binder as described above. In such a case, a photosensitive layer material including bishydrazone compound of the present invention is dissolved or dispersed in a suitable coating solvent so as to prepare a coating liquid. Then, the coating liquid is applied on the conductive support 1 and dried so as to form the photosensitive layers 4 and 40 thereon.

Such a coating solvent includes: an aromatic hydrocarbon such as benzene, toluene, xylene and monochlorobenzene; a halogenated hydrocarbon such as dichloromethane and dichloroethane; dioxane; dimethoxymethylether; and dimethylformamide. One of the above-listed solvents may be used alone or two or more of them may be used in combination. Optionally, a solvent such as alcohols, acetonitrile and methyl ethyl ketone may also be added. In order to further improve the sensitivity of the photoreceptor for electrophotography, it is desirable to form an uniform film-like layer by adding a substance which gives plasticity to the sensitizing agent and/or the binder.

Hereinafter, more specific examples of the present invention will be described. It is not intended that the present invention is limited to such examples.

EXAMPLE 1

In Example 1, the bishydrazone compound shown in Table 1 as Exemplary compound No. 1 was produced as follows.

(1) Production of a Derivative from a Tricyclic Compound

About 8.28 g (1.0 equivalent) of 5-formylsalicylaldehyde was dissolved in about 35 ml (about 8.1 equivalents) of epichlorohydrin, and 0.1 ml of triethylamine was added thereto. Then, the mixture was reacted at about 120° C. to 130° C. for about 5 hours.

After confirming the completion of the reaction by thin layer chromatography (TLC), the mixture was cooled and the excess epichlorohydrin was removed therefrom by a rotary evaporator, thereafter adding ethanol so as to produce white powder.

After the white powder was separated by filtering and sufficiently washed with ethanol, the white powder was recrystallized from ethanol so as to obtain about 8.9 g of the target derivative from a tricyclic compound in the form of white agglomerated crystals (yield: about 78.3%).

Figure 6:
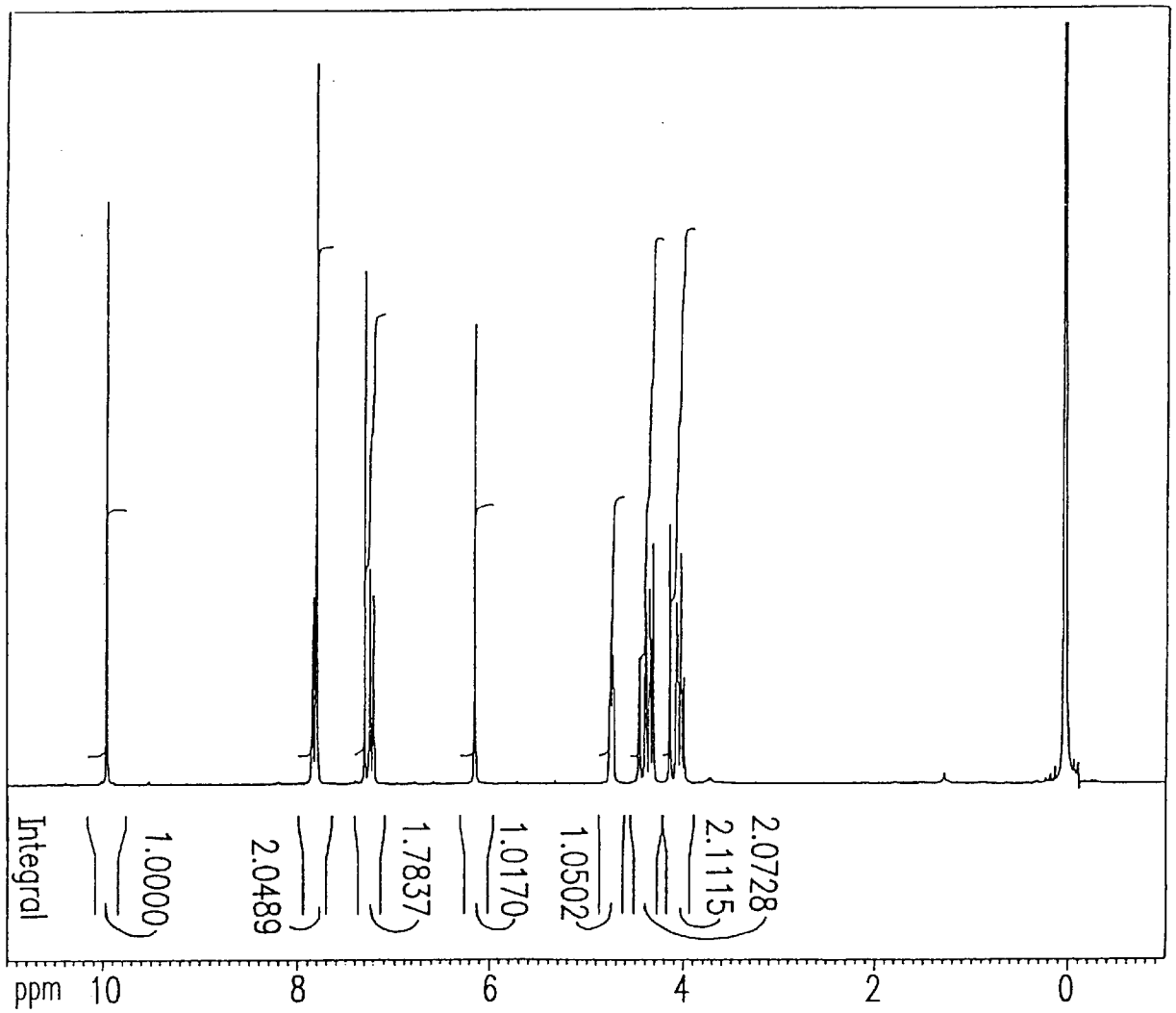
FIG. 6 shows a $^{1}$H-NMR spectrum of a tricyclic compound which is the first intermediate for synthesizing Exemplary compound No. 1.
Figure 7A:
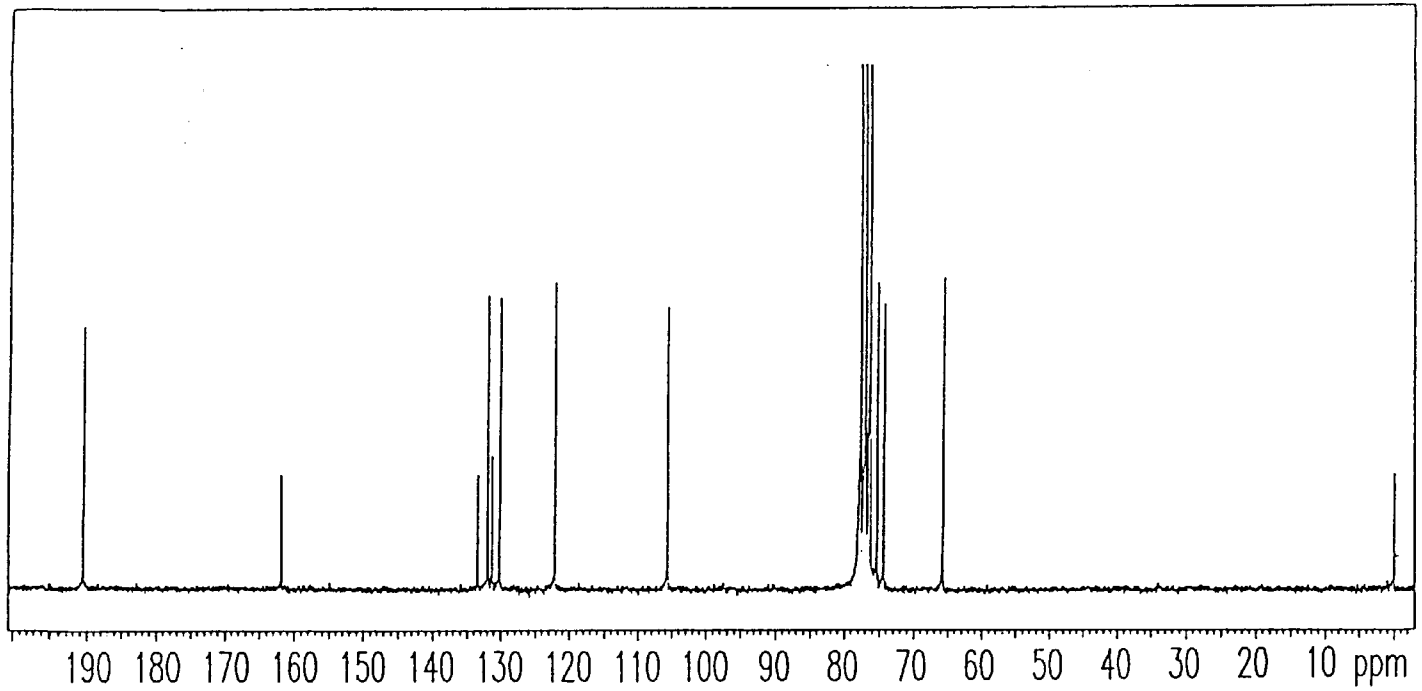
FIG. 7A shows a normal $^{13}$C-NMR spectrum of the tricyclic compound which is the first intermediate for synthesizing Exemplary compound No. 1.
Figure 7B:
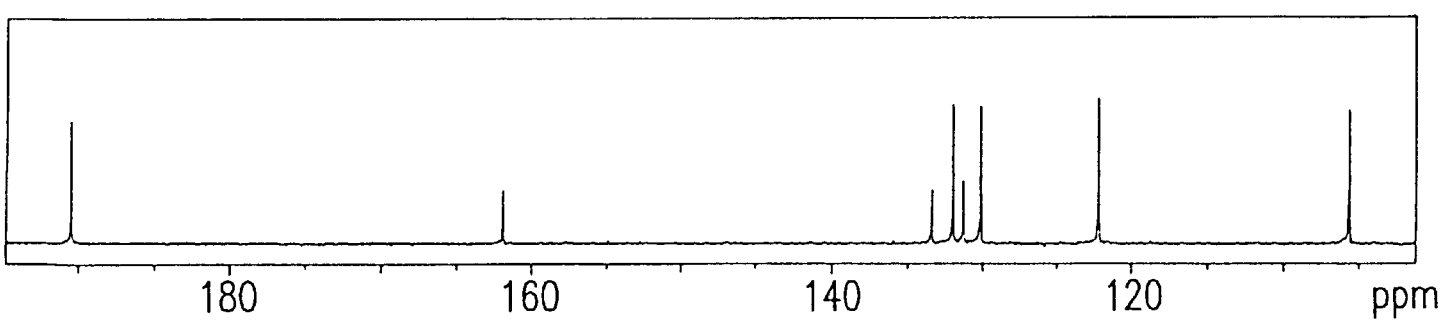
FIG. 7B shows a partial enlarged view of the normal $^{13}$C-NMR spectrum of the tricyclic compound which is the first intermediate for synthesizing Exemplary compound No. 1.
Figure 8A:
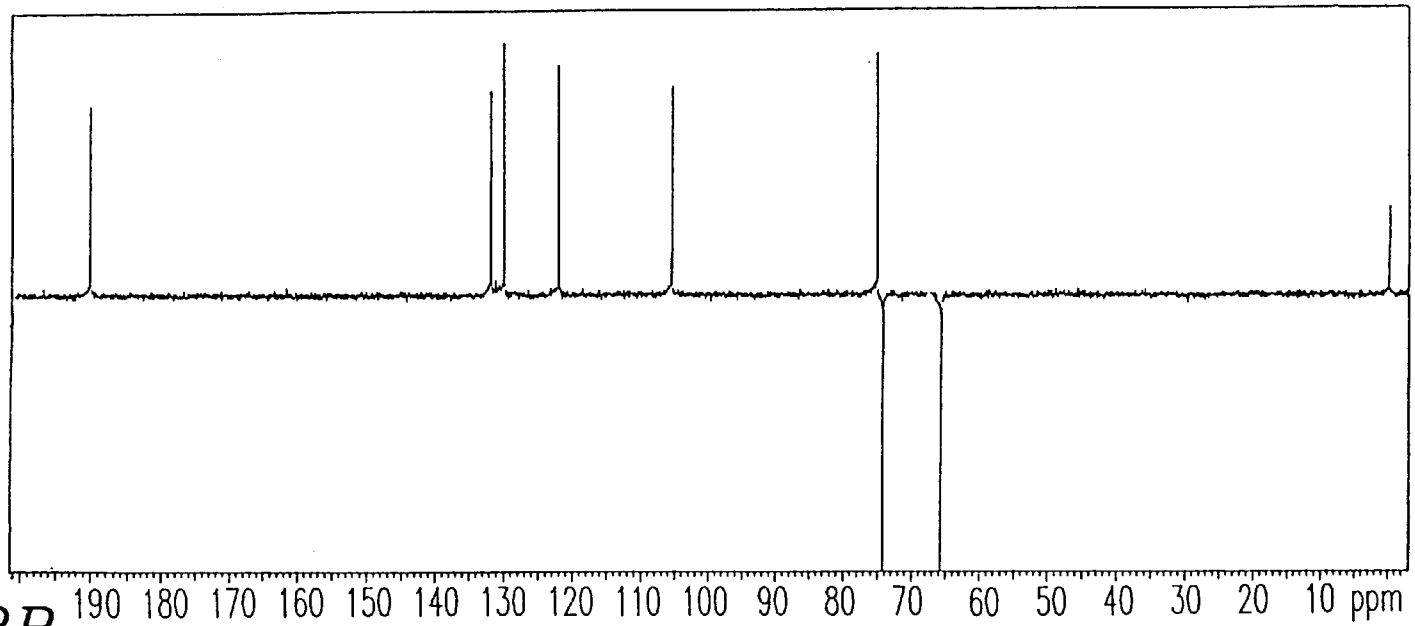
FIG. 8A shows a DEPT135 $^{13}$C-NMR spectrum of the tricyclic compound which is the first intermediate for synthesizing Exemplary compound No. 1.
Figure 8B:
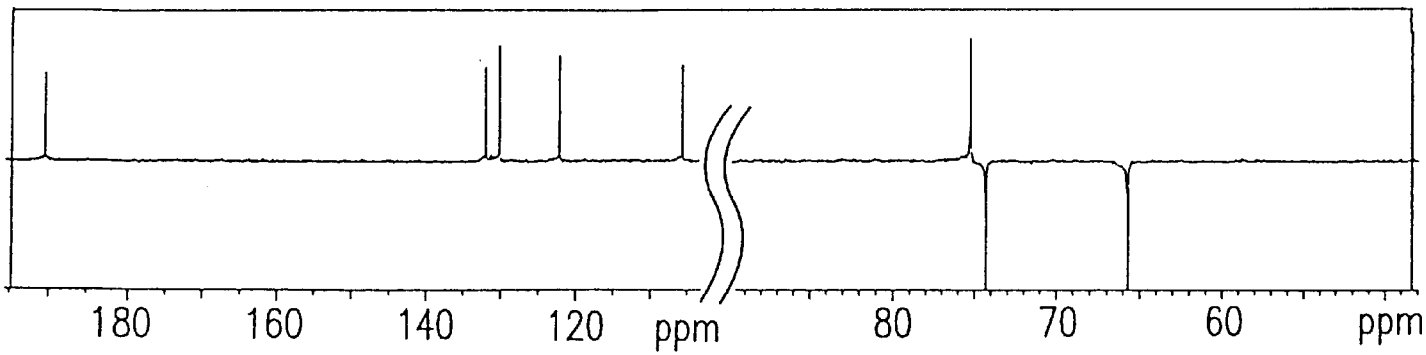
FIG. 8B shows a partial enlarged view of the DEPT135 $^{13}$C-NMR spectrum of the tricyclic compound which is the first intermediate for synthesizing Exemplary compound No. 1, shown in FIG. 8A.

The structure confirmation of the obtained derivative from a tricyclic compound was conducted by measuring the $^{1}$H-NMR, normal $^{13}$C-NMR and DEPT135 $^{13}$C-NMR thereof. FIG. 6 and Table 13 below show the measured $^{1}$H-NMR; FIGS. 7A and 7B and Table 14 below show the measured normal $^{13}$C-NMR; and FIGS. 8A and 8B and Table 15 below show the measured DEPT135 $^{13}$C-NMR. In FIGS. 7A and 7B through 13A and 13B, the "B" figure shows a partial enlarged view of the corresponding "A" figure.

TABLE 13

| $^{1}$H-NMR(d-CDCl$_3$) | | |
|---|---|---|
| ppm = | 3.97 ~ 4.12 | (m,2H) |
| | 4.29 ~ 4.44 | (m,2H) |
| | 4.70 ~ 4.73 | (m,1H) |
| | 6.12 | (S,1H) |
| | 7.12 ~ 7.26 | (m,1H) |
| | 7.81 ~ 7.82 | (m,2H) |
| | 9.93 | (S,1H) |

TABLE 14

| normal $^{13}$C-NMR(d-CDCl$_3$) | |
|---|---|
| ppm = | 65.73 (CH$_2$) |
| | 74.54 (CH$_2$) |
| | 75.30 (CH) |
| | 105.66 (CH) |
| | 122.20 (CH) |
| | 130.17 (CH) |
| | 131.31 (C) |
| | 131.99 (CH) |
| | 133.44 (C) |
| | 161.89 (C) |
| | 190.50 (CHO) |

TABLE 15

| DEPT135$^{13}$C-NMR(d-CDCl$_3$) | |
|---|---|
| ppm = | 65.73 (CH$_2$) |
| | 74.34 (CH$_2$) |
| | 75.30 (CH) |
| | 105.66 (CH) |
| | 122.20 (CH) |
| | 130.17 (CH) |
| | 131.99 (CH) |
| | 190.50 (CHO) |

These NMR signals well support the structure of the target derivative from a tricyclic compound.

(2) Production of a Compound Derived From 2-formylbenzo[b]furan

About 1.08 g (1.0 equivalent) of the obtained derivative from a tricyclic compound was dissolved in a mixed solvent of acetonitrile 20 ml/water 5 ml at room temperature, and about 1.57 g (about 1.4 equivalents) of sodium periodate was added thereto. Then, about 0.5 ml of 1N-hydrochloric acid aqueous solution was further added, and the mixture was heated while being stirred at about 80° C. for about 3 hours.

After confirming the completion of the reaction by thin layer chromatography (TLC), the mixture was cooled down to room temperature.

The reacted solution was diluted with about 40 ml of dichloromethane, about 3 to 4 ml of triethylamine was added thereto, and the solution was heated while being stirred at about 30° C. to 40° C. for about 5 hours.

After confirming the completion of the intramolecular aldol reaction by TLC, the mixture was cooled down to room temperature, and an extraction process was performed by known methods.

The resultant crude product was purified by using a silica gel chromatography (BW-200: produced by Fuji Silisia Chemical) and a dissolution medium (hexane/dichloromethane=about 9/1 to 100% dichloromethane) so as to obtain about 0.75 g of the target 2,5-bisformylbenzo[b]furan in the form of white powdery crystal (yield: about 82.2%).

Figure 9A:
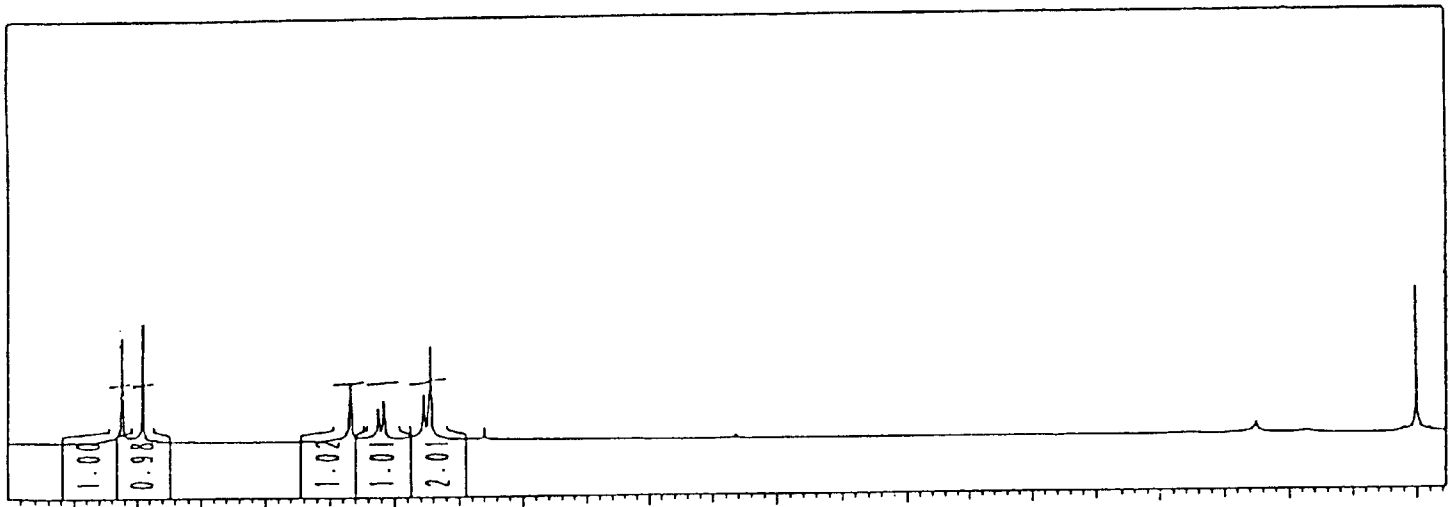
FIG. 9A shows a $^{1}$H-NMR spectrum of 2,5-bisformylbenzo[b]furan which is the second intermediate for synthesizing Exemplary compound No. 1.
Figure 9B:
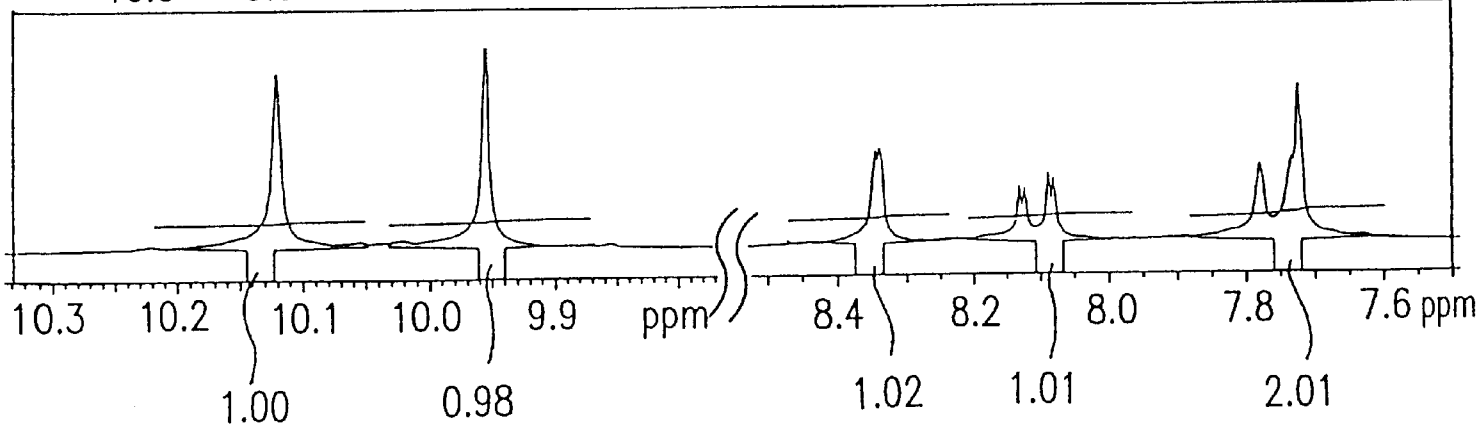
FIG. 9B shows a partial enlarged view of the $^{1}$H-NMR spectrum of 2,5-bisformylbenzo[b]furan which is the second intermediate for synthesizing Exemplary compound No. 1, shown in FIG. 9A.
Figure 10A:
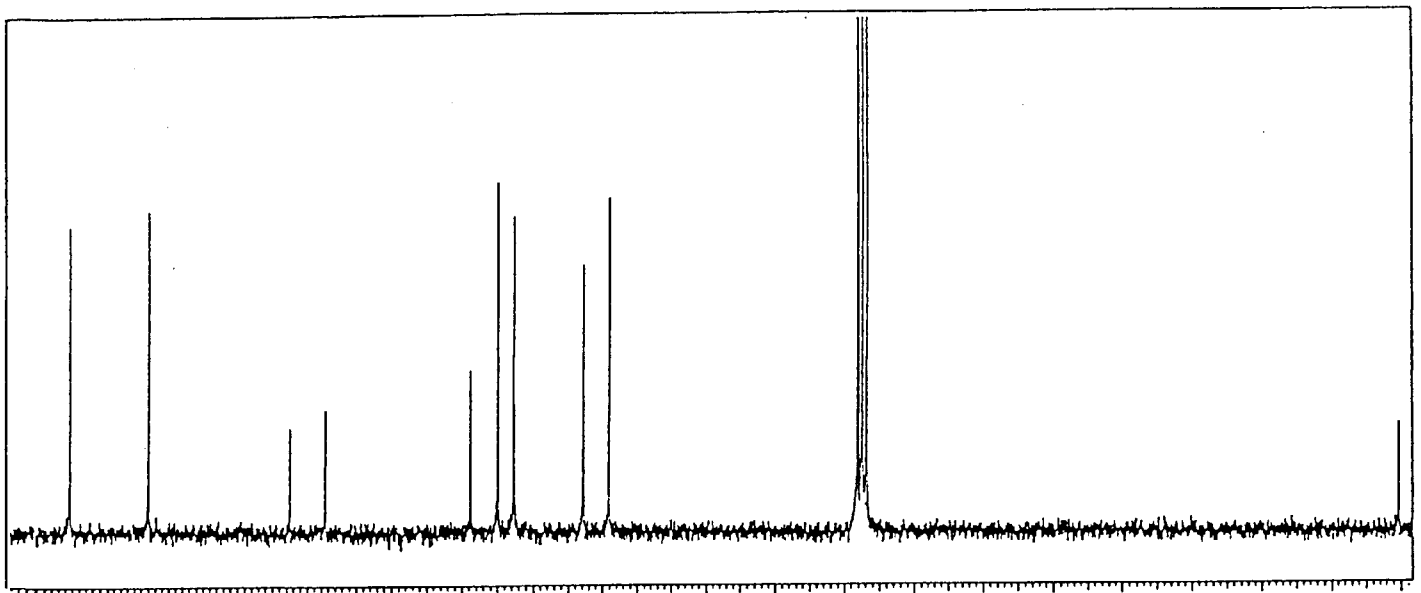
FIG. 10A shows a normal $^{13}$C-NMR spectrum of 2,5-bisformylbenzo[b]furan which is the second intermediate for synthesizing Exemplary compound No. 1.
Figure 10B:
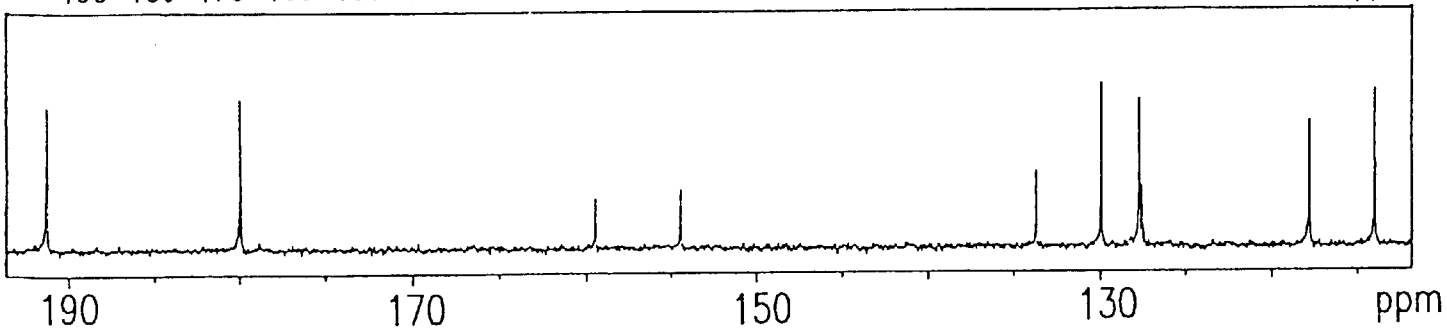
FIG. 10B shows a partial enlarged view of the normal $^{13}$C-NMR spectrum of 2,5-bisformylbenzo[b]furan which is the second intermediate for synthesizing Exemplary compound No. 1, shown in FIG. 10A.
Figure 11B:
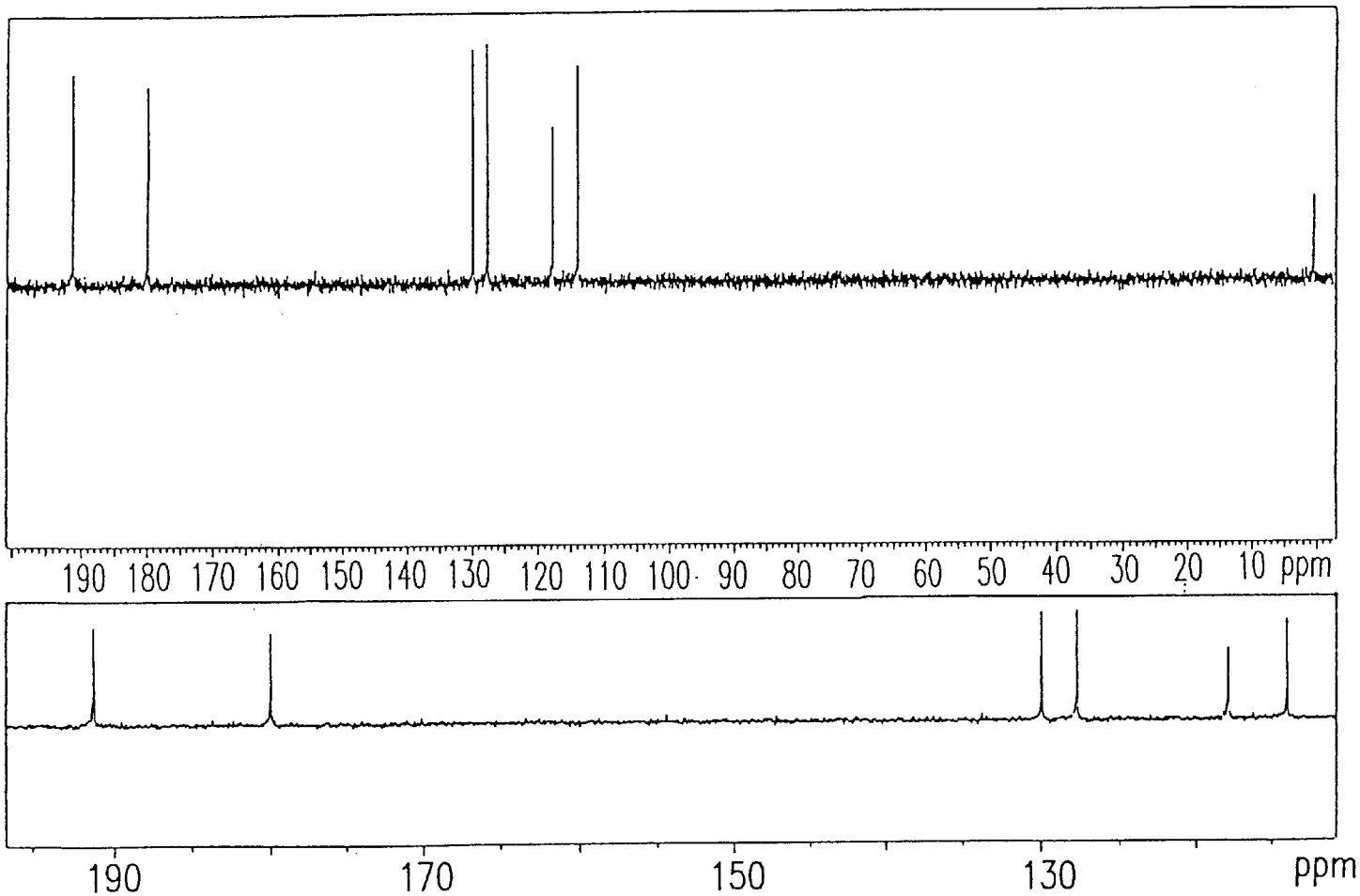
FIG. 11B shows a partial enlarged view of the DEPT135 $^{13}$C-NMR spectrum of 2,5-bisformylbenzo[b]furan which is the second intermediate for synthesizing Exemplary compound No. 1, shown in FIG. 11A.

The structure confirmation of the obtained 2,5-bisformylbenzo[b]furan was conducted by measuring the $^{1}$H-NMR, normal $^{13}$C-NMR and DEPT135 $^{13}$C-NMR thereof. FIGS. 9A and 9B and Table 16 below show the measured $^{1}$H-NMR; FIGS. 10A and 10B and Table 17 below show the measured normal $^{13}$C-NMR; and FIGS. 11A and 11B and Table 18 below show the measured DEPT135 $^{13}$C-NMR.

TABLE 16

| $^1$H-NMR(d-$CDCl_3$) | |
|---|---|
| ppm = | 7.72 (S,1H) |
| | 7.75 (d,J = 8.6,1H) |
| | 8.10 (dd. J = 8.6, 1.6, 1H) |
| | 8.33 (d, J = 1.6, 1H) |
| | 9.95 (S,1H) |
| | 10.11 (S, 1H) |

TABLE 17

| normal $^{13}$C-NMR(d-$CDCl_3$) | |
|---|---|
| ppm = | 114.03 (CH) |
| | 117.82 (CH) |
| | 127.56 (C) |
| | 127.72 (CH) |
| | 129.95 (CH) |
| | 133.75 (C) |
| | 161.89 (C) |
| | 154.43 (C) |
| | 159.48 (C) |
| | 179.98 (CHO) |
| | 191.32 (CHO) |

TABLE 18

| DEPT135$^{13}$C-NMR(d-$CDCl_3$) | |
|---|---|
| ppm = | 114.05 (CH) |
| | 117.82 (CH) |
| | 127.72 (CH) |
| | 129.25 (CH) |
| | 179.98 (CHO) |
| | 191.32 (CHO) |

These NMR signals well support the structure of the target 2,5-bisformylbenzo[b]furan.

(3) Production of a Bishydrazone Compound

About 0.6 g (1.0 equivalent) of the obtained 2,5-bisformylbenzo[b]furan was dissolved in about 10 ml of ethanol, and about 0.885 g (about 2.1 equivalents) of N-phenyl-N-methylhydrazine and about 0.05 ml of acetic acid were added thereto. Then, the mixture was heated while being stirred at about 60° C. to 70° C. for about 5 hours.

After the completion of the reaction, the produced solid matter was separated by filtering and sufficiently washed with ethanol. Then, the solid matter was purified by recrystallization from ethanol so as to obtain about 1.18 g of the target bishydrazone compound of Exemplary compound No. 1 in the form of yellow powder (yield: about 95%).

Figure 12A:
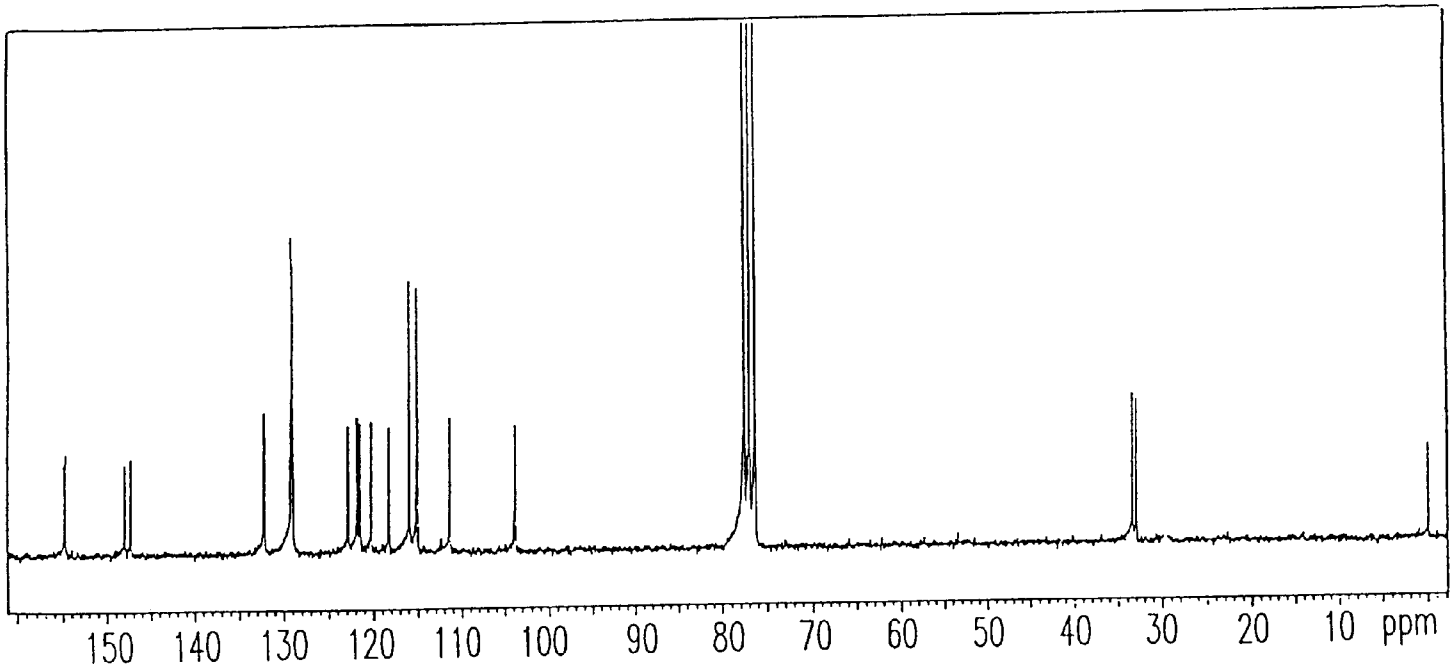
FIG. 12A shows a normal $^{13}$C-NMR spectrum of a bishydrazone compound of Exemplary compound No. 1.
Figure 12B:
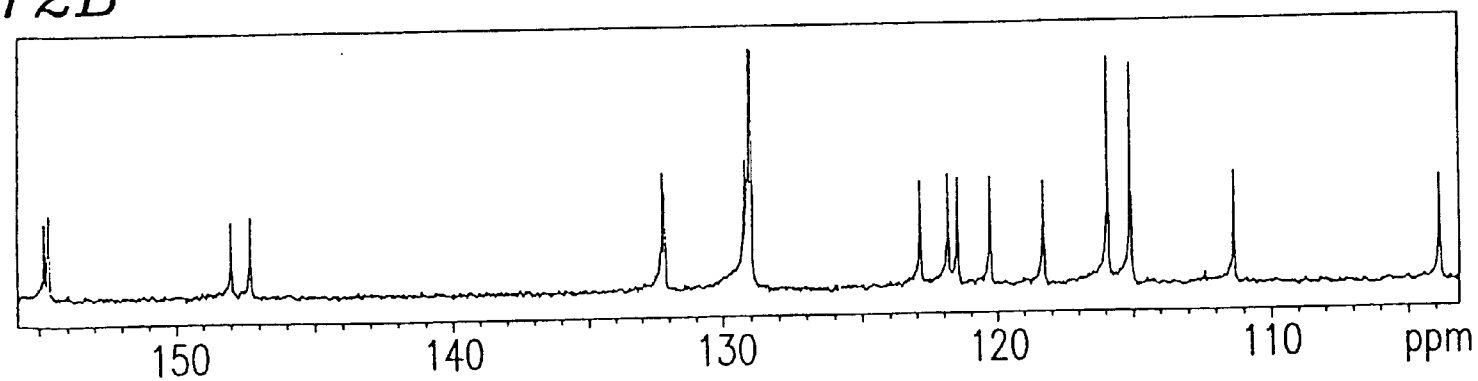
FIG. 12B shows a partial enlarged view of the normal $^{13}$C-NMR spectrum of the bishydrazone compound of Exemplary compound No. 1, shown in FIG. 12A.
Figure 13A:
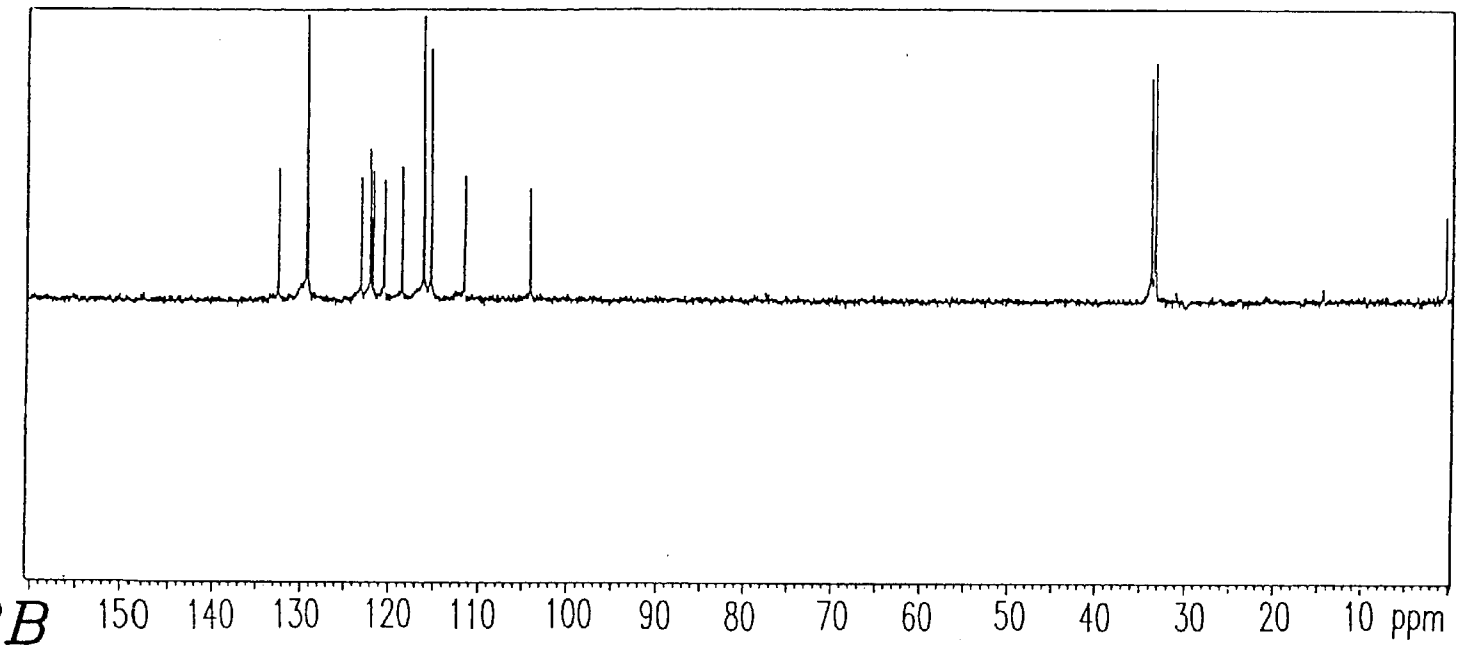
FIG. 13A shows a DEPT135 $^{13}$C-NMR spectrum of the bishydrazone compound of Exemplary compound No. 1.
Figure 13B:
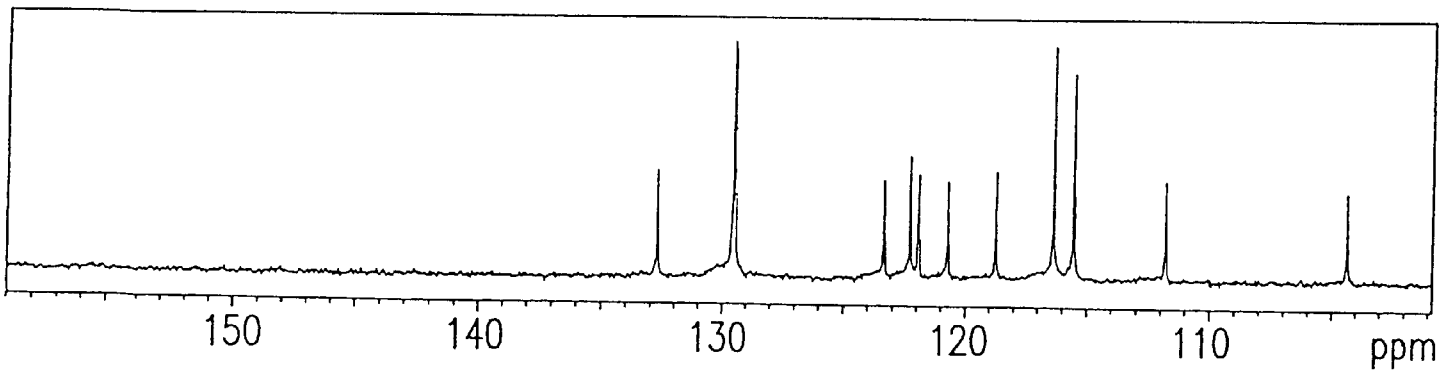
FIG. 13B shows a partial enlarged view of the DEPT135 $^{13}$C-NMR spectrum of the bishydrazone compound of Exemplary compound No. 1, shown in FIG. 13A.

The structure confirmation of the obtained bishydrazone compound of Exemplary compound No. 1 was conducted by measuring the normal $^{13}$C-NMR and DEPT135 $^{13}$C-NMR thereof. FIGS. 12A and 12B and Table 19 below show the measured normal $^{13}$C-NMR; and FIGS. 13A and 13B and Table 20 below show the measured DEPT135 13C-NMR.

TABLE 19

| normal$^{13}$C-NMR(d-$CDCl_3$) | |
|---|---|
| ppm = | 33.02 ($CH_3$) |
| | 33.48 ($CH_3$) |
| | 103.88 (CH) |
| | 111.36 (CH) |
| | 115.11 (CH) |
| | 115.93 (CH) |
| | 118.31 (CH) |
| | 120.30 (CH) |
| | 121.50 (CH) |
| | 121.86 (CH) |

TABLE 19-continued

| | |
|---|---|
| | 122.90 (CH) |
| | 129.02 (CH) |
| | 129.10 (CH) |
| | 129.25 (C) |
| | 132.18 (C) |
| | 132.27 (CH) |
| | 147.32 (C) |
| | 147.99 (C) |
| | 154.70 (C) |
| | 159.85 (C) |

TABLE 20

| DEPT135$^{13}$C-NMR(d-$CDCl_3$) | |
|---|---|
| ppm = | 33.02 ($CH_3$) |
| | 33.48 ($CH_3$) |
| | 103.88 (CH) |
| | 111.36 (CH) |
| | 115.11 (CH) |
| | 115.93 (CH) |
| | 118.31 (CH) |
| | 120.30 (CH) |
| | 121.50 (CH) |
| | 121.86 (CH) |
| | 122.90 (CH) |
| | 129.02 (CH) |
| | 129.10 (CH) |
| | 132.27 (CH) |

These NMR signals well support the structure of the target bishydrazone compound of Exemplary compound No. 1.

Although the bishydrazone compound of Exemplary compound No. 1 has been described in Example 1, the other bishydrazone compounds of the present invention represented by the general formula (Ia) may be produced similarly.

EXAMPLE 2

In Example 2, photosensitive layers 4 of a layered structure were formed by respectively using the bishydrazone compounds shown in Table 1 as Exemplary compound Nos. 1, 3, 5, 6 and 9 as the charge transfer substance 3 contained in the charge transfer layer 6, illustrated in FIG. 1, thereby producing five different photoreceptors for electrophotography.

First, to an about 1% polyvinyl butyral resin ("Eslex B": produced by Nisshin Kagaku Kogyo) in THF (tetrahydrofuran), there was added a substantially equivalent amount of a bisazo pigment represented by the following formula (IXa):

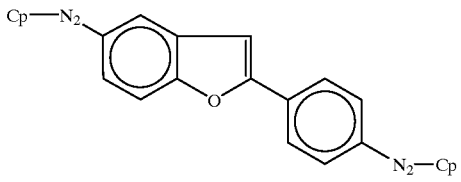

-continued

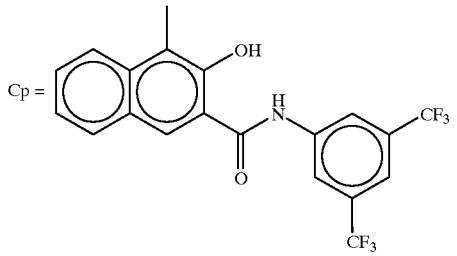

(IXa)

Then, the pigment was dispersed in a paint conditioner (produced by Red Devil Co., Ltd.) using glass beads having a diameter of about 1.5 mm for about 2 hours, so as to prepare a coating liquid.

The coating liquid was applied on the conductive support 1 formed of a polyester film (thickness: about 80 $\mu$m) with aluminum vapor-deposited thereon, and was dried. The obtained charge generation layer 5 had a thickness of about 0.2 $\mu$m.

Then, about 1 g of each of the bishydrazone compounds shown in Table 1 as Exemplary compound Nos. 1, 3, 5, 6 and 9 and about 1.2 g of a polyalylate resin ("U-100": produced by Unitika Ltd.) were dissolved in methylene chloride so as to prepare an about 15% solution, thereby obtaining five different coating liquids. The five coating liquids were respectively applied on the charge generation layers 5 with a doctor blade method and dried thereon. The obtained charge transfer layers (resin-cyclic bishydrazone compound solid solution phase) 6 each had a thickness of about 25 $\mu$m. Thus, the photosensitive layers 4 of a layered structure were formed, thereby obtaining the five photoreceptors for electrophotography.

The electrophotographic characteristics of the obtained photoreceptors were evaluated using an electrostatic recording paper test device ("SP-428": produced by Kawaguchi Denki Co., Ltd.). An exposure $E_{100}$ (lux.s) required for lowering the potential from about −700 V to about −100 V with a white light irradiation (irradiation: about 5 lux) and an initial potential $V_0$ (−volt) were measured under conditions of applied voltage: about −6 kV and static: No. 3. Then, the exposure $E_{100}$ (lux.s) and the initial potential $V_0$ (−volt) were measured in the 10000th cycle (one cycle: from application of electrical charge to removal of electrical charge) (irradiation for removal of electrical charge: one-second irradiation of about 40-lux white light). The measured values are shown in Table 21 below.

TABLE 21

| | First cycle | | 10000th cycle | |
|---|---|---|---|---|
| Cpd. No. | $V_0$(−Volt) | $E_{100}$(lux · s) | ($V_0$(−Volt) | $E_{100}$(lux · s) |
| Cpd. No. 1 | 720 | 2.1 | 705 | 2.3 |
| Cpd. No. 3 | 700 | 2.2 | 690 | 2.3 |
| Cpd. No. 5 | 715 | 2.0 | 690 | 2.2 |
| Cpd. No. 6 | 730 | 2.2 | 710 | 2.3 |
| Cpd. No. 9 | 710 | 2.3 | 730 | 2.4 |

The results shown in Table 21 above indicated that each of the photoreceptors for electrophotography according to the present example had good sensitivity, high chargeability and superior repeatability.

EXAMPLE 3

In Example 3, the photosensitive layer 4 of a layered structure was formed by using the bishydrazone compound shown in Table 1 as Exemplary compound No. 4 as the charge transfer substance 3 contained in the charge transfer layer 6, illustrated in FIG. 1, thereby producing a photoreceptor for electrophotography.

First, about 0.4 g of an X-type metal-free phthalocyanine ("Firstgen Blue-8120": produced by Dainippon Ink & Chemicals, Inc.) was added to about 30 ml of an ethyl acetate solution containing about 0.3 g of a vinyl chloride-vinyl acetate copolymer resin ("Eslex M": produced by Sekisui Chemical Co., Ltd.) dissolved therein. Then, the pigment was dispersed in a paint conditioner (produced by Red Devil Co., Ltd.) for about 20 minutes, so as to prepare a coating liquid. The coating liquid was applied on the conductive support 1 formed of a polyester film with aluminum vapor-deposited thereon, and was dried. The obtained charge generation layer 5 had a thickness of about 0.4 $\mu$m.

Then, a polyalylate layer containing about 50% by weight of the bishydrazone compound shown in Table 1 as Exemplary compound No. 4 was formed on the charge generation layer 5. Thus, a photoreceptor for electrophotography having the photosensitive layer 4 of a layered structure was obtained.

The spectral sensitivity of the obtained photoreceptor at about 780 nm was evaluated by measuring the energy $E_{50}$ required for lowering the potential by half and the initial potential $V_0$ (−volt). As a result, $V_0$ was about 720 (−volt) and $E_{50}$ was about 0.25 ($\mu$J/cm$^2$), indicating that the photoreceptor had very high sensitivity and high chargeability.

Moreover, the photoreceptor for electrophotography according to the present example was attached to a drum in a laser printer ("WD-580P": Sharp K.K.), and a non copy aging test was conducted by repeating a process of printing a blank document for 10000 cycles. In the 10000th cycle, the initial potential and the sensitivity were measured to determine the respective decrease thereof. As a result, $V_0$ was about 710 (−volt) and $E_{50}$ was about 0.27 ($\mu$J/cm$^2$), indicating excellent repeatability of the photoreceptor.

EXAMPLE 4

In Example 4, photosensitive layers 40 of a single layer structure were formed by respectively using the bishydrazone compounds shown in Table 1 as Exemplary compound Nos. 2, 3, 4 and 8 as the charge transfer substance 3 illustrated in FIG. 3, thereby producing four different photoreceptors for electrophotography.

First, about 1.1 g of a polyarylate resin represented by the following structural formula (Xa), about 0.15 g of N,N-3,5-xylyl-3,4-xylyl-3,4,9,10-perylenetetracarboxylimide and about 0.05 g of an antioxidant tertiary-butylhydroquinon (BHQ) were dissolved in methylene chloride so as to prepare a coating liquid, with the imide compound being partially dispersed.

(Xa)

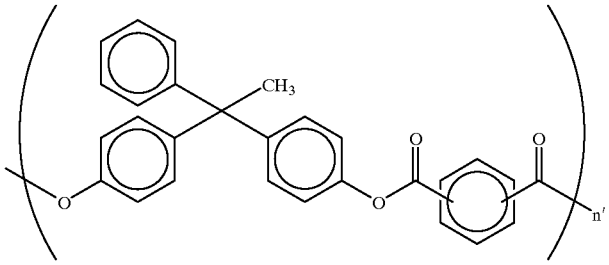

In the above formula, n' represents an integer of about 100 to 10000, depending upon the polymer synthesis condition.

The coating liquid was applied using an applicator on the conductive support 1 formed of an aluminum substrate whose surface had been subjected to an alumite treatment (alumite layer thickness: about 7 μm) and dried thereon so as to obtain the photosensitive layer 40 which had a thickness of about 20 μm. Thus, the photosensitive layers 40 of a single layer structure were formed, thereby producing four different photoreceptors from the Exemplary compounds 2, 3, 4 and 8 above for electrophotography.

The electrophotographic characteristics of the obtained photoreceptors were evaluated using an electrostatic recording paper test device ("SP-428": produced by Kawaguchi Denki Co., Ltd.). An exposure $E_{100}$ (lux.s) required for lowering the potential from about +700 V to about +100 V with a white light irradiation (irradiation: about 5 lux) was measured under conditions of applied voltage: about +5.5 kV and static: No. 3. Then, in the 10000th cycle of the non copy aging test, the decrease in the sensitivity $E_{100}$ (lux.s) was evaluated. The results are shown in Table 22 below.

TABLE 22

| | $E_{100}$(lux · s) | |
|---|---|---|
| Cpd. No. | First Cycle | 10000th cycle |
| Cpd. No. 2 | 2.2 | 2.3 |
| Cpd. No. 3 | 2.0 | 2.1 |
| Cpd. No. 4 | 2.1 | 2.2 |
| Cpd. No. 8 | 1.9 | 2.0 |

The results shown in Table 22 above indicated that each of the photoreceptors for electrophotography according to the present example had good sensitivity and superior repeatability also when positively charged.

EXAMPLE 5

In Example 5, the bishydrazone compound of Exemplary Compound No. 63 was produced as follows.

(1) Production of 5-formyl-2-acetylbenzo[b]furan

About 5.0 g (1.0 equivalent) of 5-formylsalicylaldehyde was dissolved in about 15 ml of ethanol, and about 3.25 g (about 1.05 equivalents) of monochloroacetone was added thereto. Then, about 8.7 ml (about 1.50 equivalents) of diisopropylethylamine was added thereto at room temperature. The mixture was heated while being stirred for about 5 hours, and maintaining the reaction temperature at about 60° C. to 70° C. After confirming the completion of the reaction by TLC, the mixture was allowed to cool down. The produced solid matter was separated by filtering, and washed with ethanol. Then, the solid matter was recrystallized from ethanol so as to obtain about 5.8 g of the target 5-formyl-2-acetylbenzo[b]furan in the form of white crystal (yield: about 92.6%).

Figure 14:
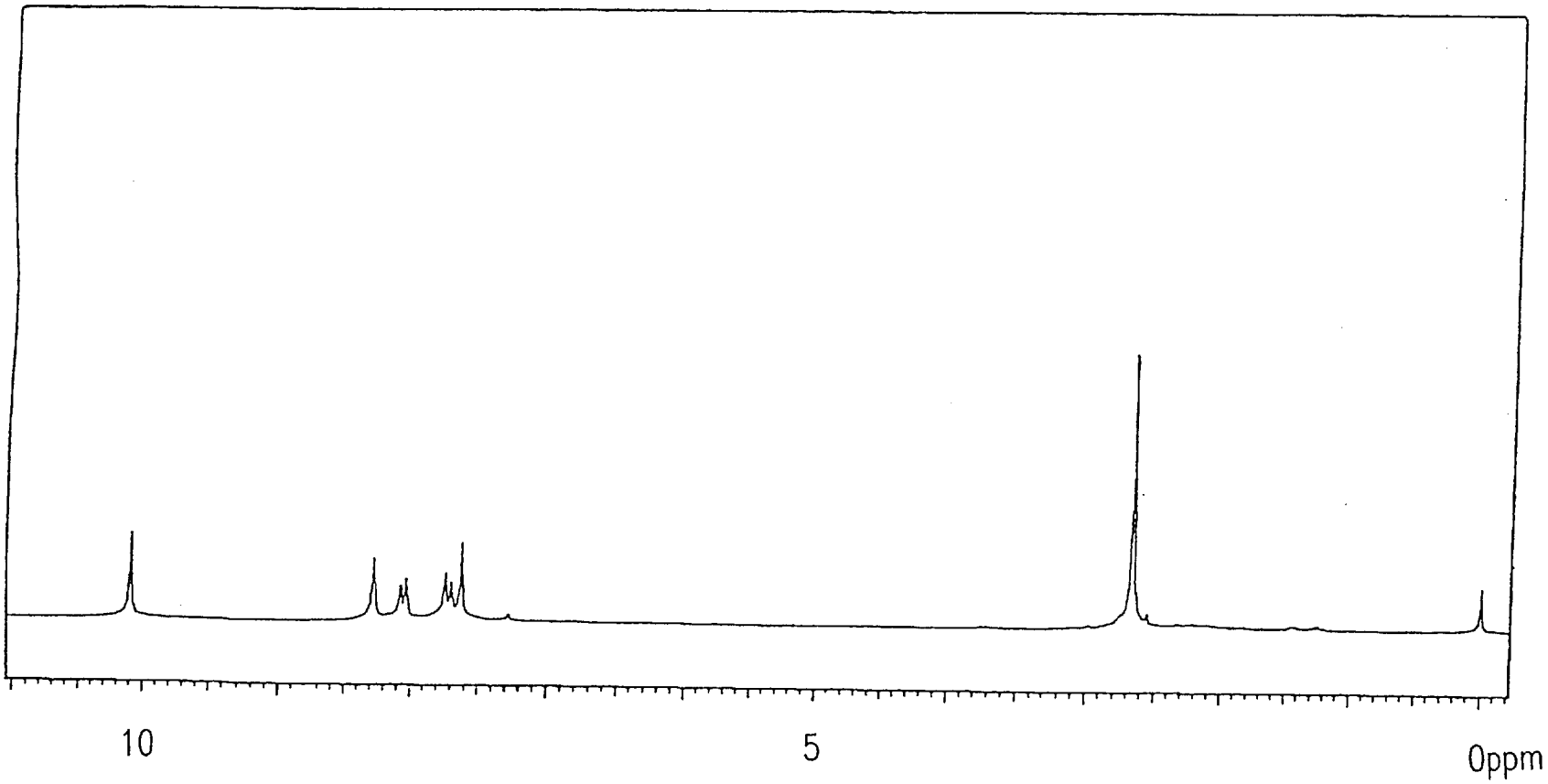
FIG. 14 shows a $^{1}$H-NMR spectrum of 5-formyl-2-acetylbenzo[b]furan in heavy chloroform ($CDCl_3$).
Figure 15:
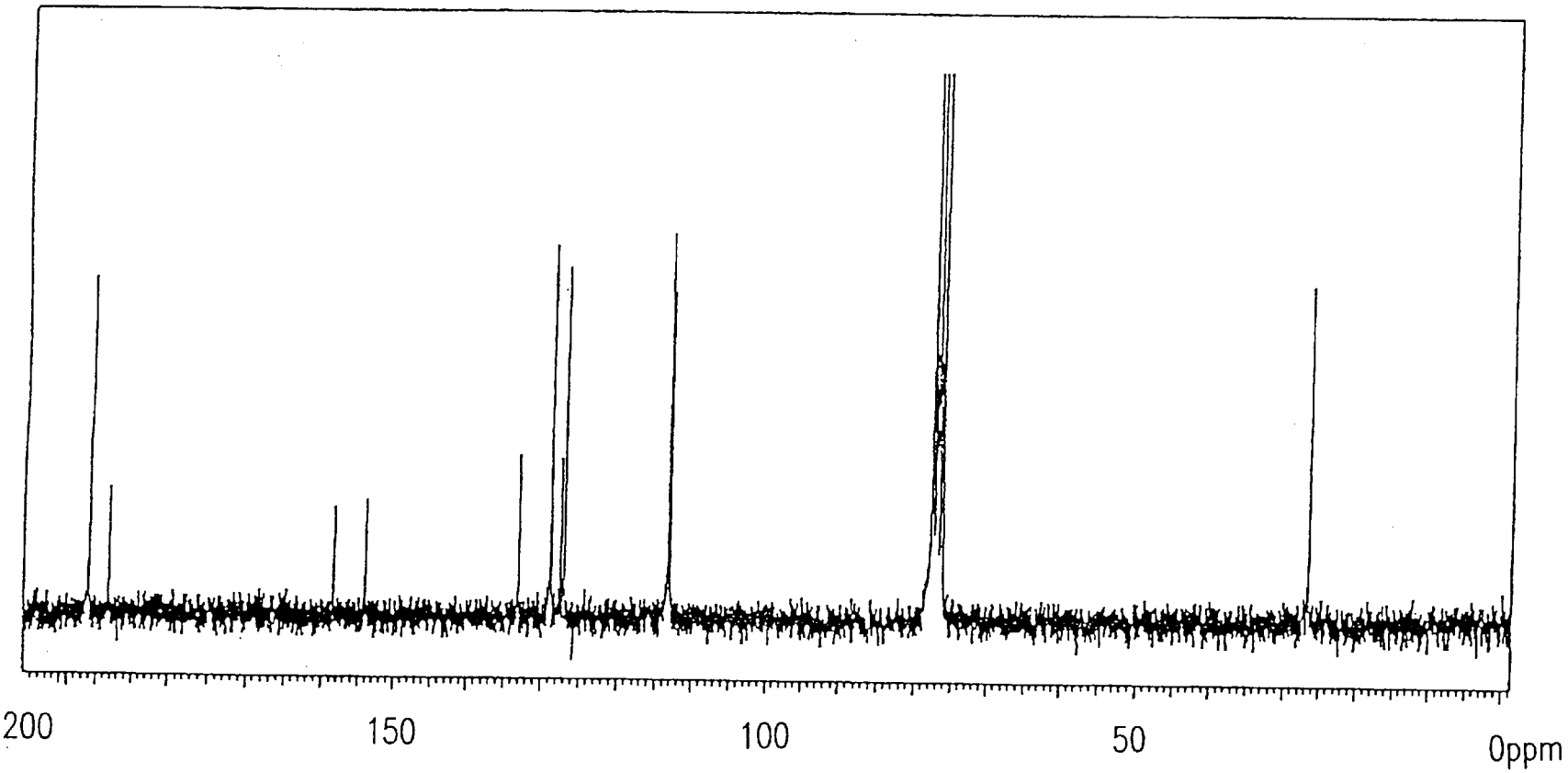
FIG. 15 shows a normal $^{13}$C-NMR spectrum of 5-formyl-2-acetylbenzo[b]furan in heavy chloroform.
Figure 16:
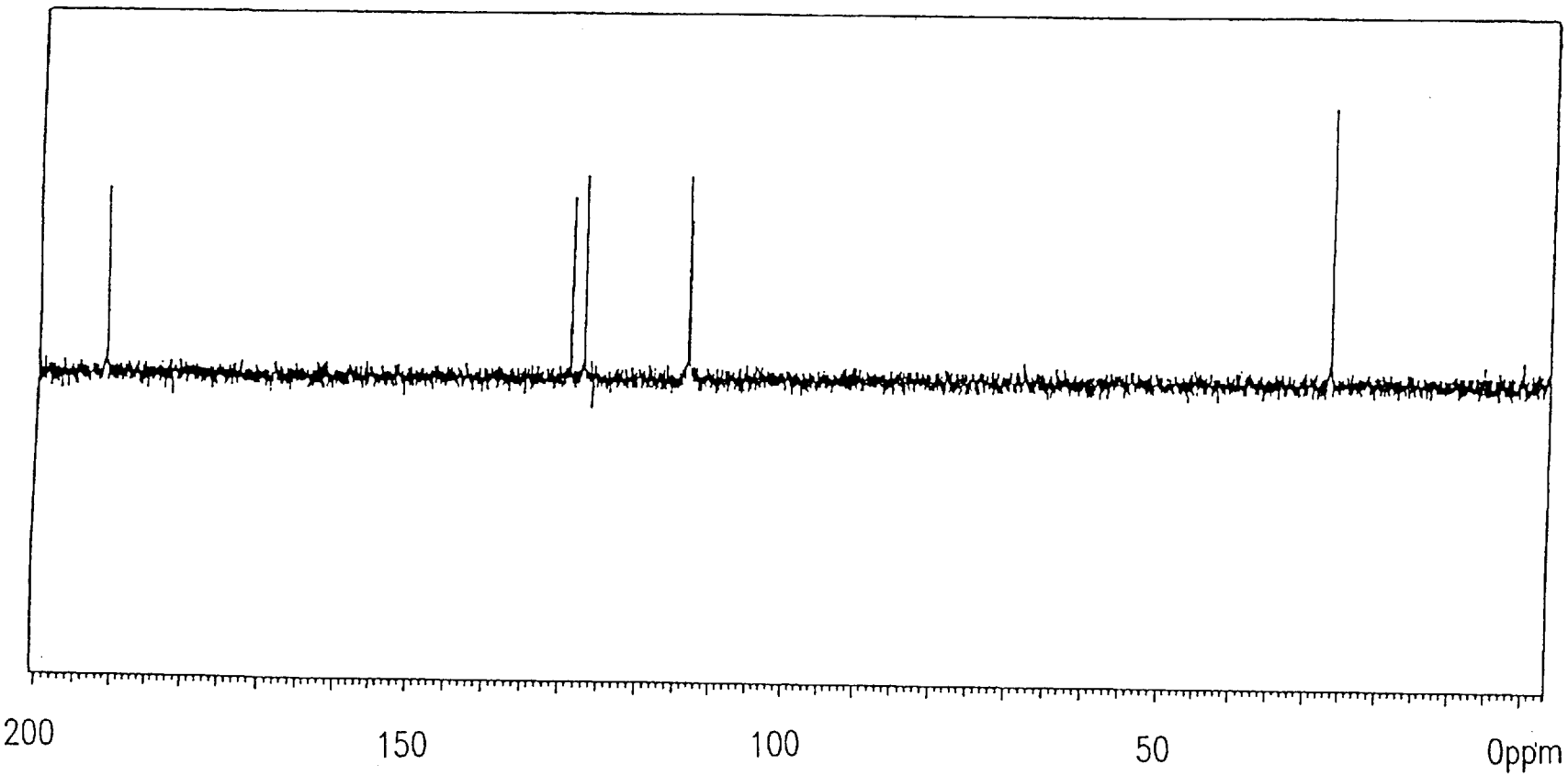
FIG. 16 shows a DEPT135 $^{13}$C-NMR spectrum of 5-formyl-2-acetylbenzo[b]furan in heavy chloroform.

The structure confirmation of the obtained 5-formyl-2-acetylbenzo[b]furan was conducted by measuring the $^{1}$H-NMR, normal $^{13}$C-NMR and DEPT135 $^{13}$C-NMR thereof. FIG. 14 shows the measured $^{1}$H-NMR; FIG. 15 shows the measured normal $^{13}$C-NMR; and FIG. 16 shows the measured DEPT135 $^{13}$C-NMR. These NMR signals well support the structure of the target 5-formyl-2-acetylbenzo[b]furan.

(2) Production of a 5-formyl-2-acetylbenzo[b]furan-N-methyl-N-phenylhydrazine(monohydrazone) Compound About 2.0 g (1.0 equivalent) of 5-formyl-2-acetylbenzo[b]furan was dissolved in about 10 ml of ethanol, and about 1.36 g (about 1.05 equivalents) of N-methyl-N-phenylhydrazine and about 0.1 ml of acetic acid as a catalyst were added thereto at about 0° C. Then, the mixture was stirred for about 15 hours while maintaining the mixture at room temperature. After confirming the completion of the reaction by TLC, the produced solid matter was separated by filtering, and washed with ethanol. Then, the solid matter was recrystallized from ethanol so as to obtain about 2.73 g of the target 5-formyl-2-acetylbenzo[b]furan-N-methyl-N-phenylhydrazine(monohydrazone) compound in the form of light yellow crystal (yield: about 87.9%).

Figure 17:
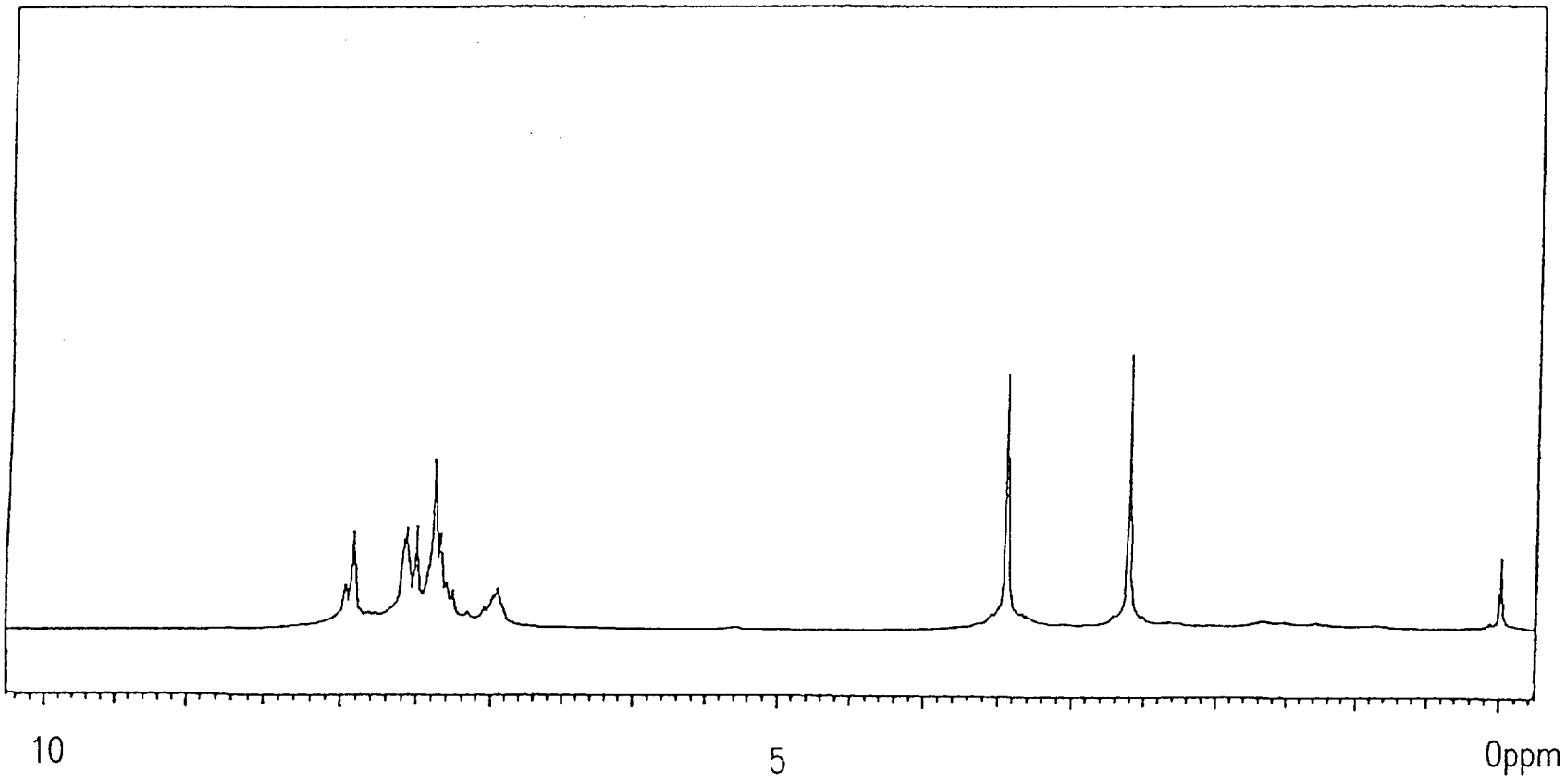
FIG. 17 shows a $^{1}$H-NMR spectrum of 5-formyl-2-acetylbenzo[b]furan-N-methyl-N-phenylhydrazine (monohydrazone) in heavy chloroform.
Figure 18:
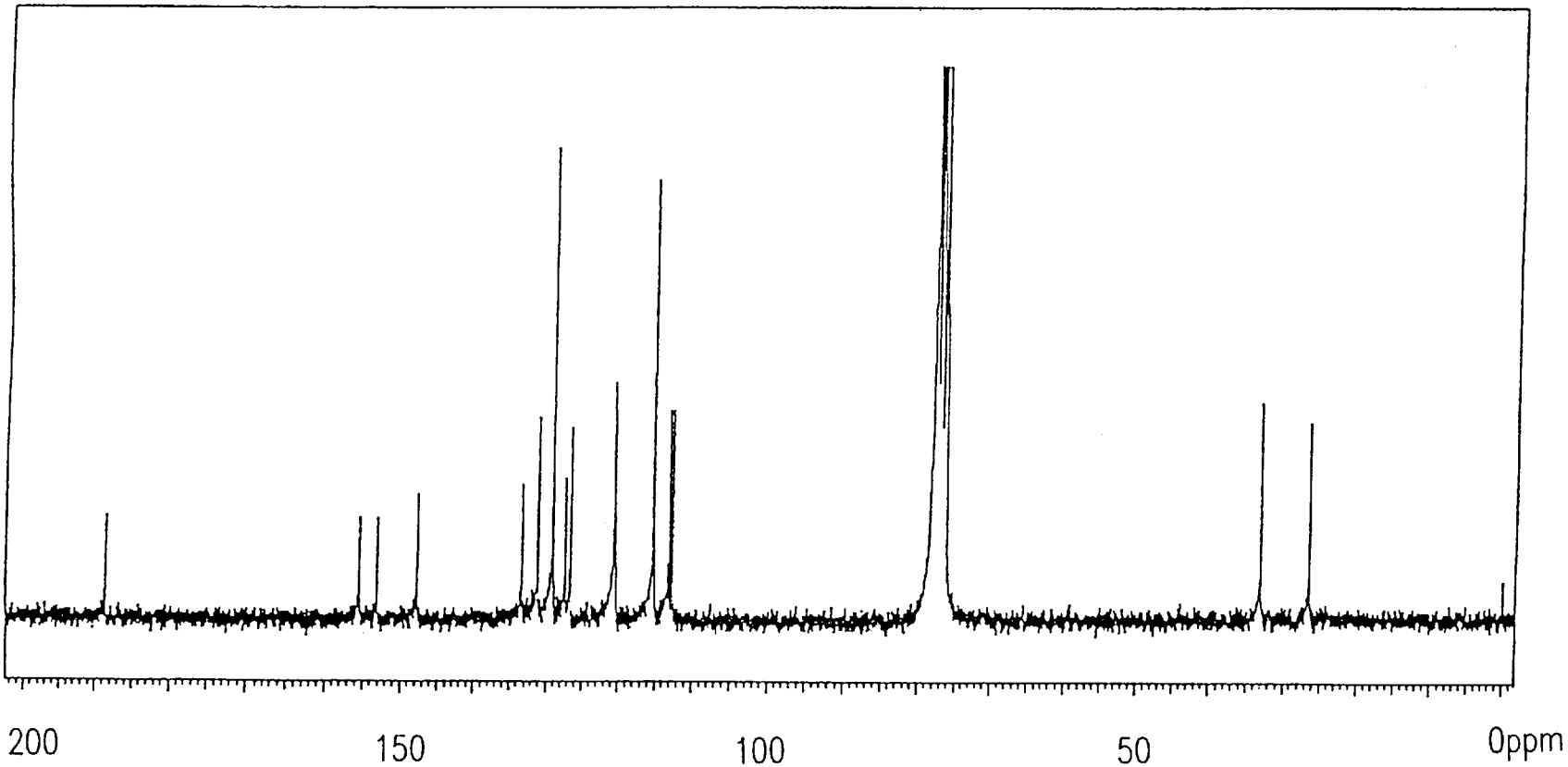
FIG. 18 shows a normal $^{13}$C-NMR spectrum of 5-formyl-2-acetylbenzo[b]furan-N-methyl-N-phenylhydrazine (monohydrazone) in heavy chloroform.
Figure 19:
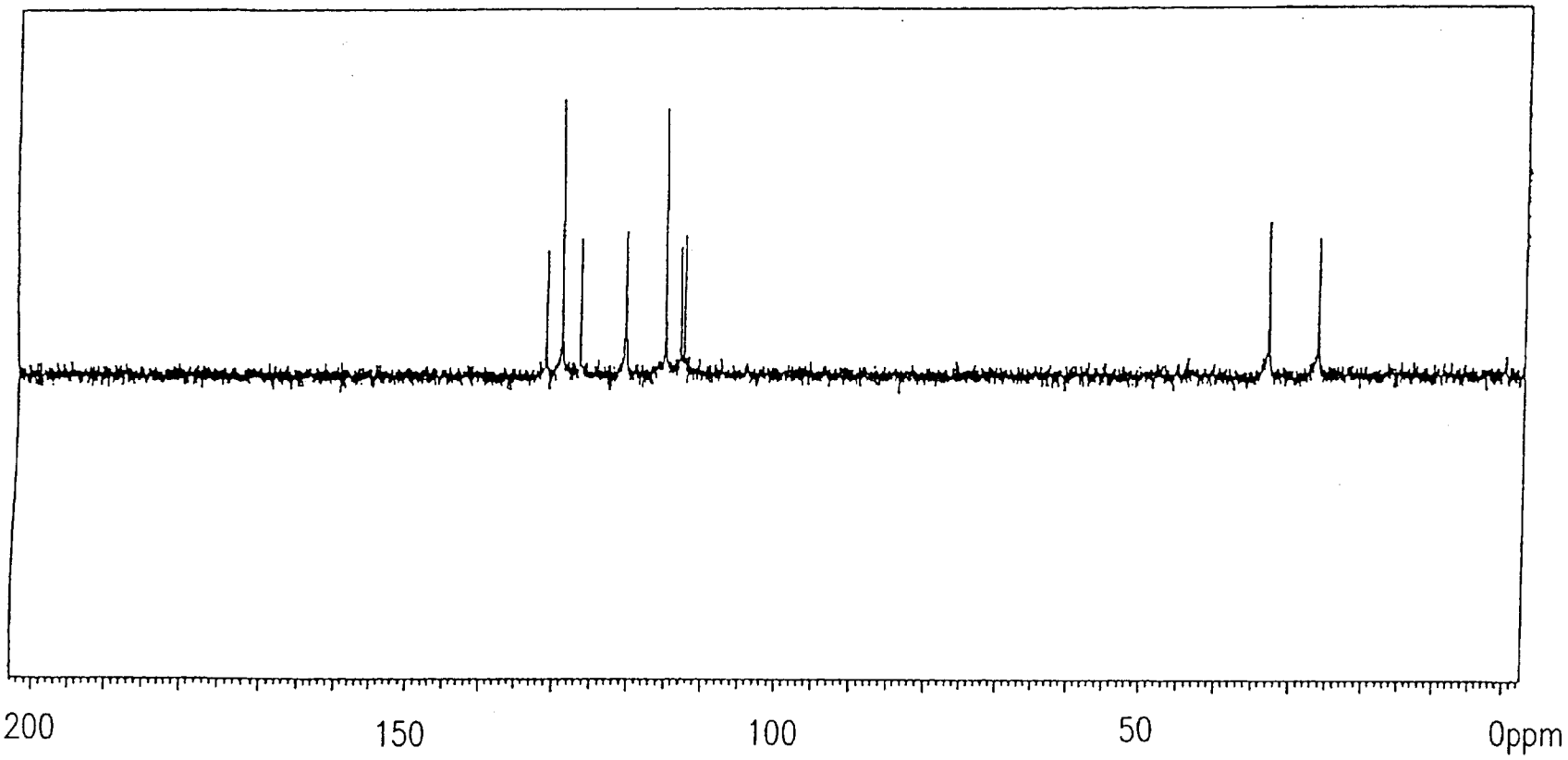
FIG. 19 shows a DEPT135 $^{13}$C-NMR spectrum of 5-formyl-2-acetylbenzo[b]furan-N-methyl-N-phenylhydrazine(monohydrazone) in heavy chloroform.

The structure confirmation of the obtained 5-formyl-2-acetylbenzo[b]furan-N-methyl-N-phenylhydrazine (monohydrazone) compound was conducted by measuring the $^{1}$H-NMR, normal $^{13}$C-NMR and DEPT135 $^{13}$C-NMR thereof. FIG. 17 shows the measured $^{1}$H-NMR; FIG. 18 shows the measured normal $^{13}$C-NMR; and FIG. 19 shows the measured DEPT135 $^{13}$C-NMR. These NMR signals well support the structure of the target 5-formyl-2-acetylbenzo[b]furan-N-methyl-N-phenylhydrazine (monohydrazone) compound.

(3) Production of a Bishydrazone Compound (Exemplary Compound No. 63)

About 1.0 g (1.0 equivalent) of 5-formyl-2-acetylbenzo[b]furan-N-phenylhydrazone was dissolved in about 6 ml of ethanol, and about 0.51 g (about 1.1 equivalents) of N-aminoindoline and about 0.05 ml of acetic acid as a catalyst were added thereto at room temperature. Then, the mixture was heated while being stirred for about 5 hours and maintaining the solution at about 60° C. to 70° C. After confirming the completion of the reaction by TLC, the mixture was allowed to cool down. The produced solid matter was separated by filtering, and washed with ethanol. Then, the solid matter was recrystallized from ethanol so as to obtain about 1.35 g of the target bishydrazone compound (Exemplary Compound No. 63) in the form of yellow crystal (yield: about 93.0%).

Figure 20:
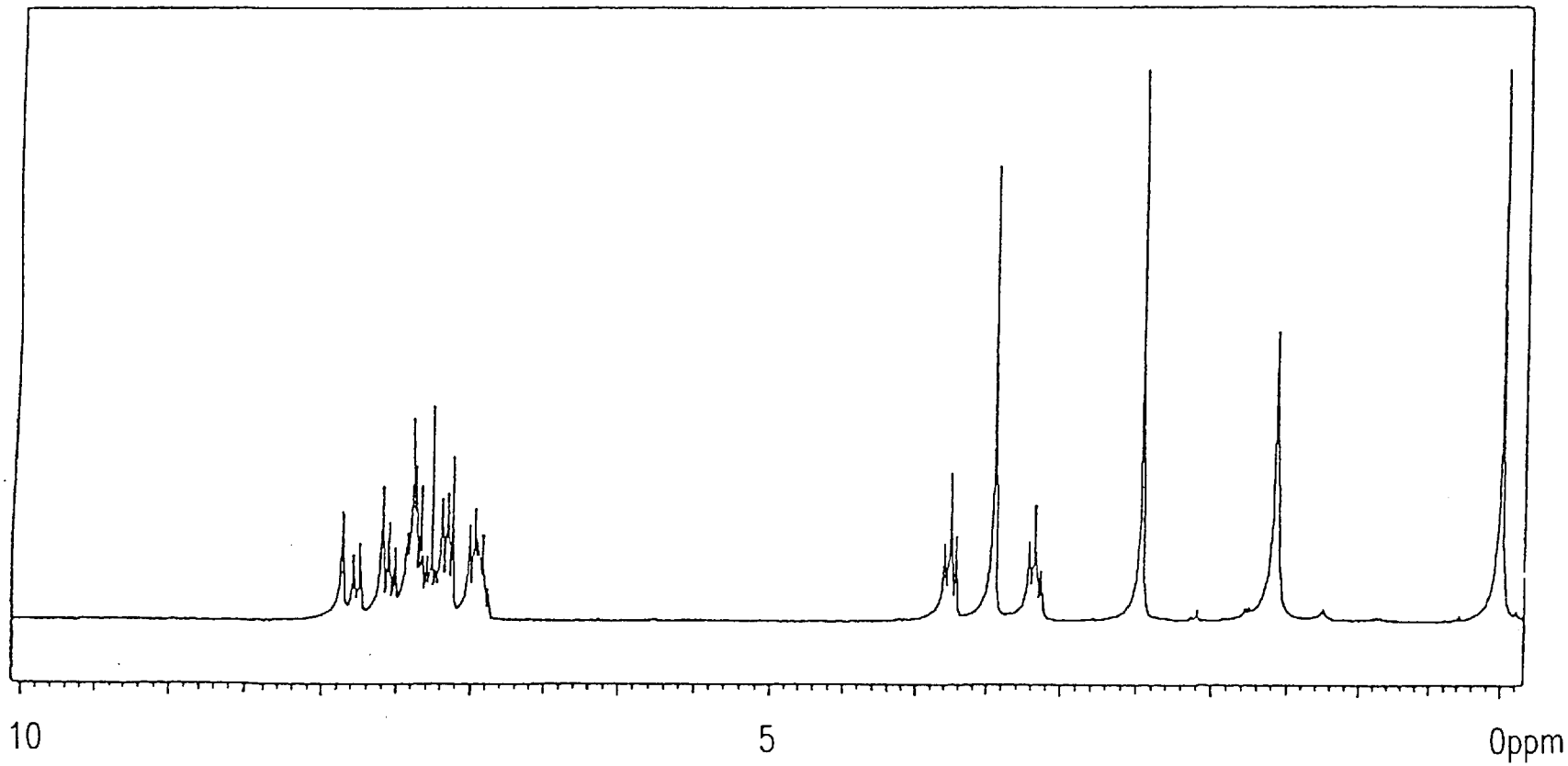
FIG. 20 shows a $^{1}$H-NMR spectrum of a bishydrazone compound of Exemplary Compound No. 63 in heavy chloroform.
Figure 21:
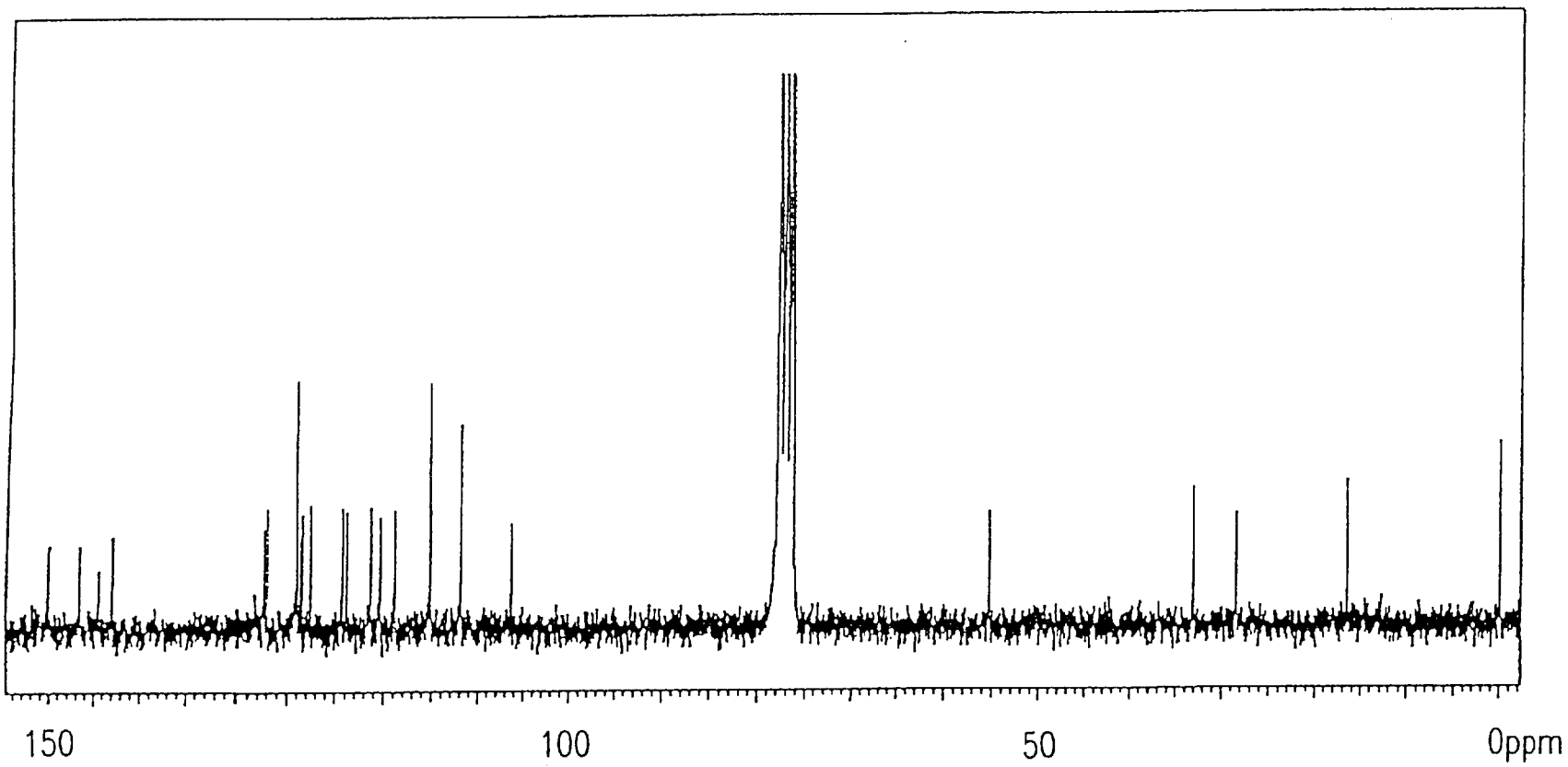
FIG. 21 shows a normal $^{13}$C-NMR spectrum of the bishydrazone compound of Exemplary Compound No. 63 in heavy chloroform.
Figure 22:
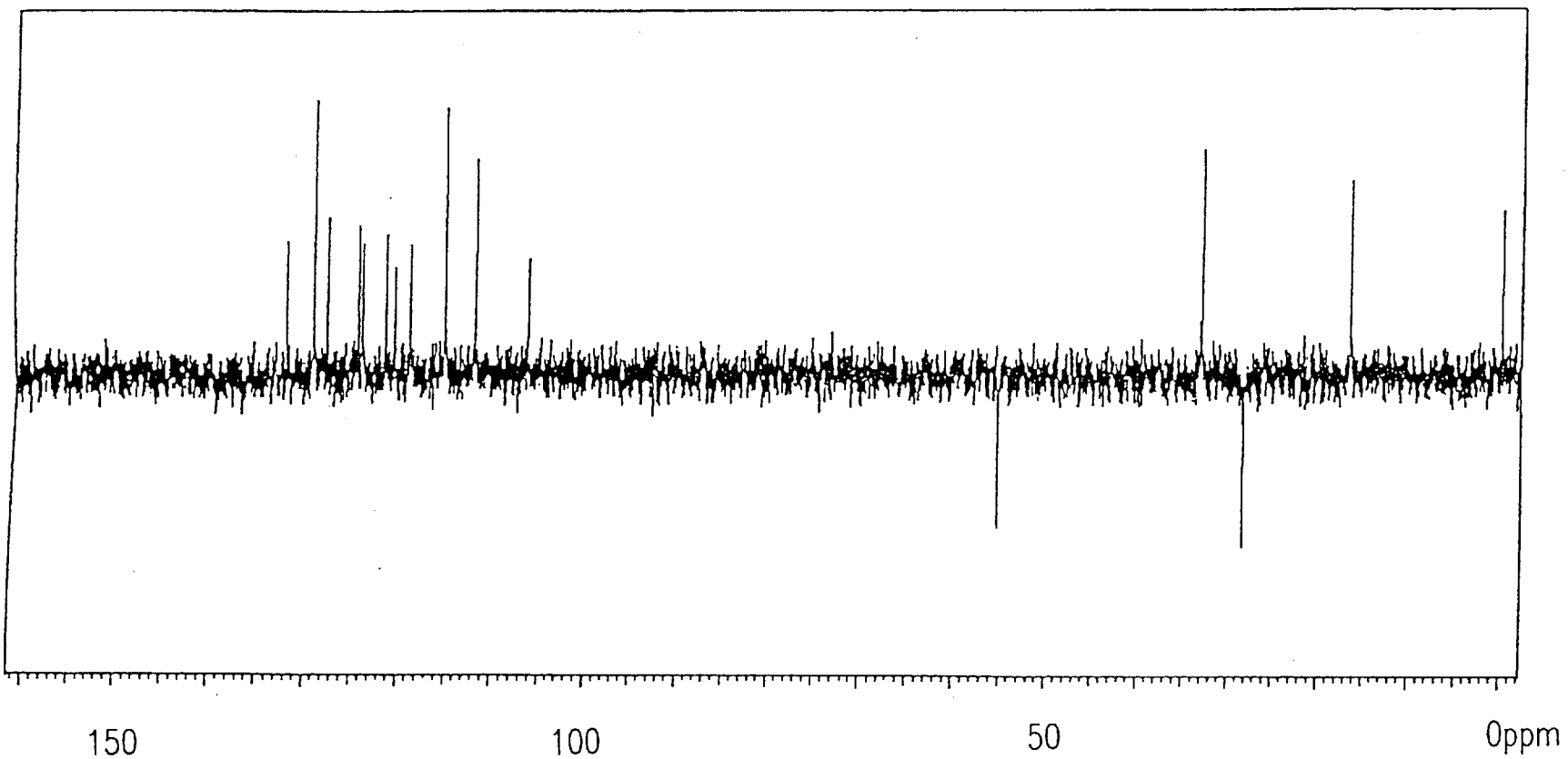
FIG. 22 shows a DEPT135 $^{13}$C-NMR spectrum of the bishydrazone compound of Exemplary Compound No. 63 in heavy chloroform.

The structure confirmation of the obtained bishydrazone compound (Exemplary Compound No. 63) was conducted by measuring the $^{1}$H-NMR, normal $^{13}$C-NMR and DEPT135 $^{13}$C-NMR thereof. FIG. 20 shows the measured $^{1}$H-NMR; FIG. 21 shows the measured normal $^{13}$C-NMR; and FIG. 22 shows the measured DEPT135 $^{13}$C-NMR. These NMR signals well support the structure of the target bishydrazone compound (Exemplary Compound No. 63).

EXAMPLE 6

In Example 6, the bishydrazone compound of Exemplary Compound No. 62 was produced as follows.

(1) Production of a 5-formyl-2-acetylbenzo[b]-furan-N-aminoindoline(monohydrazone) Compound About 2.0 g (1.0 equivalent) of 5-formyl-2-acetylbenzo[b]furan was dissolved in about 10 ml of ethanol, and about 1.47 g (about 1.03 equivalents) of N-aminoindoline and about 0.1 ml of acetic acid as a catalyst were added thereto at about 0° C. Then, the mixture was stirred for about 15 hours while maintaining the solution at room temperature. After confirming the completion of the reaction by TLC, the produced solid matter was separated by filtering, and washed with ethanol. Then, the solid matter was recrystallized from ethanol so as to obtain about 3.09 g of the target 5-formyl-2-acetylbenzo[b]furan-N-aminoindoline (monohydrazone) in the form of light yellow crystal (yield: about 95.5%).

Figure 23:
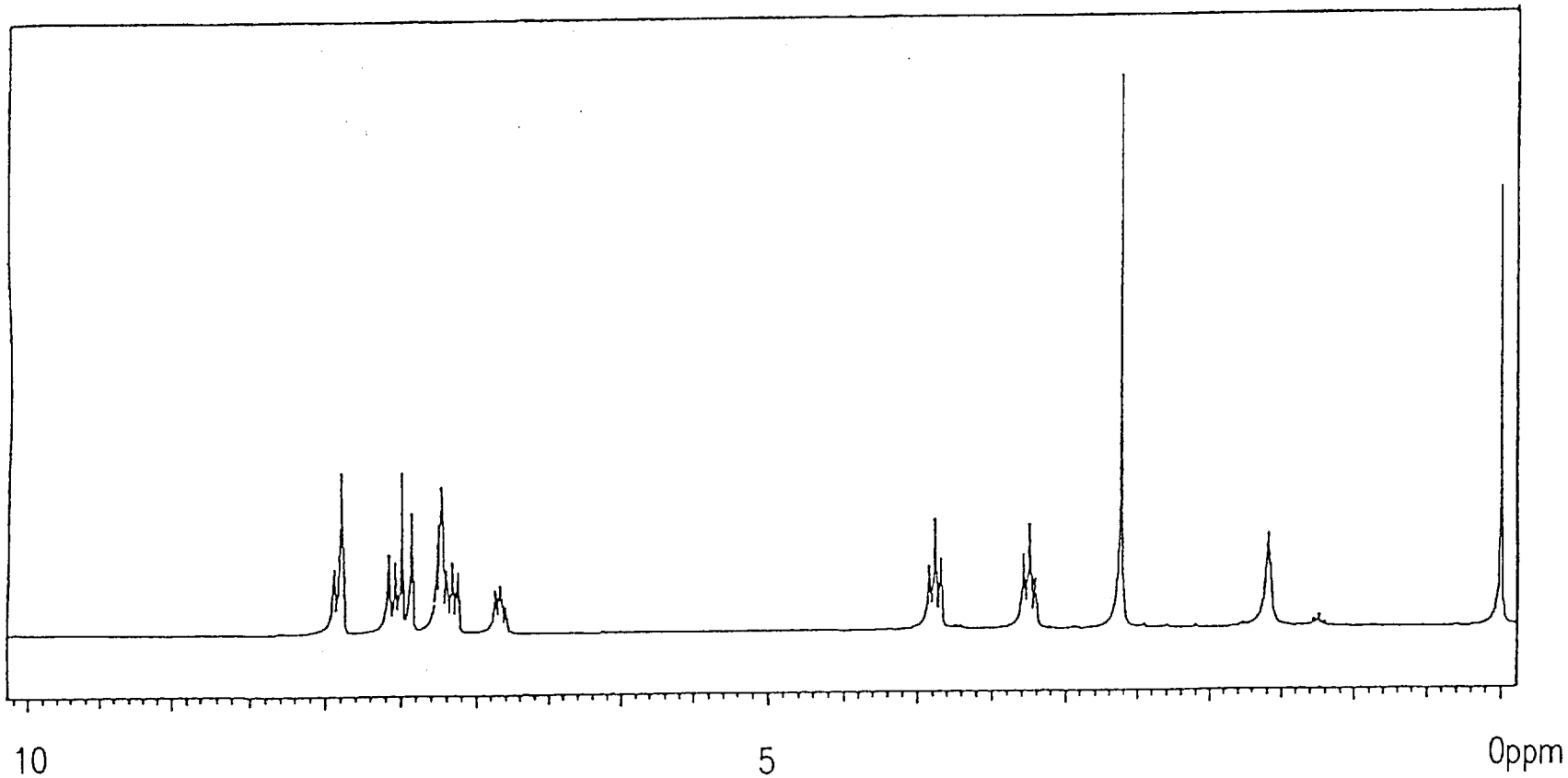
FIG. 23 shows a $^{1}$H-NMR spectrum of 5-formyl-2-acetylbenzo[b]furan-N-aminoindoline(monohydrazone) in heavy chloroform.
Figure 24:
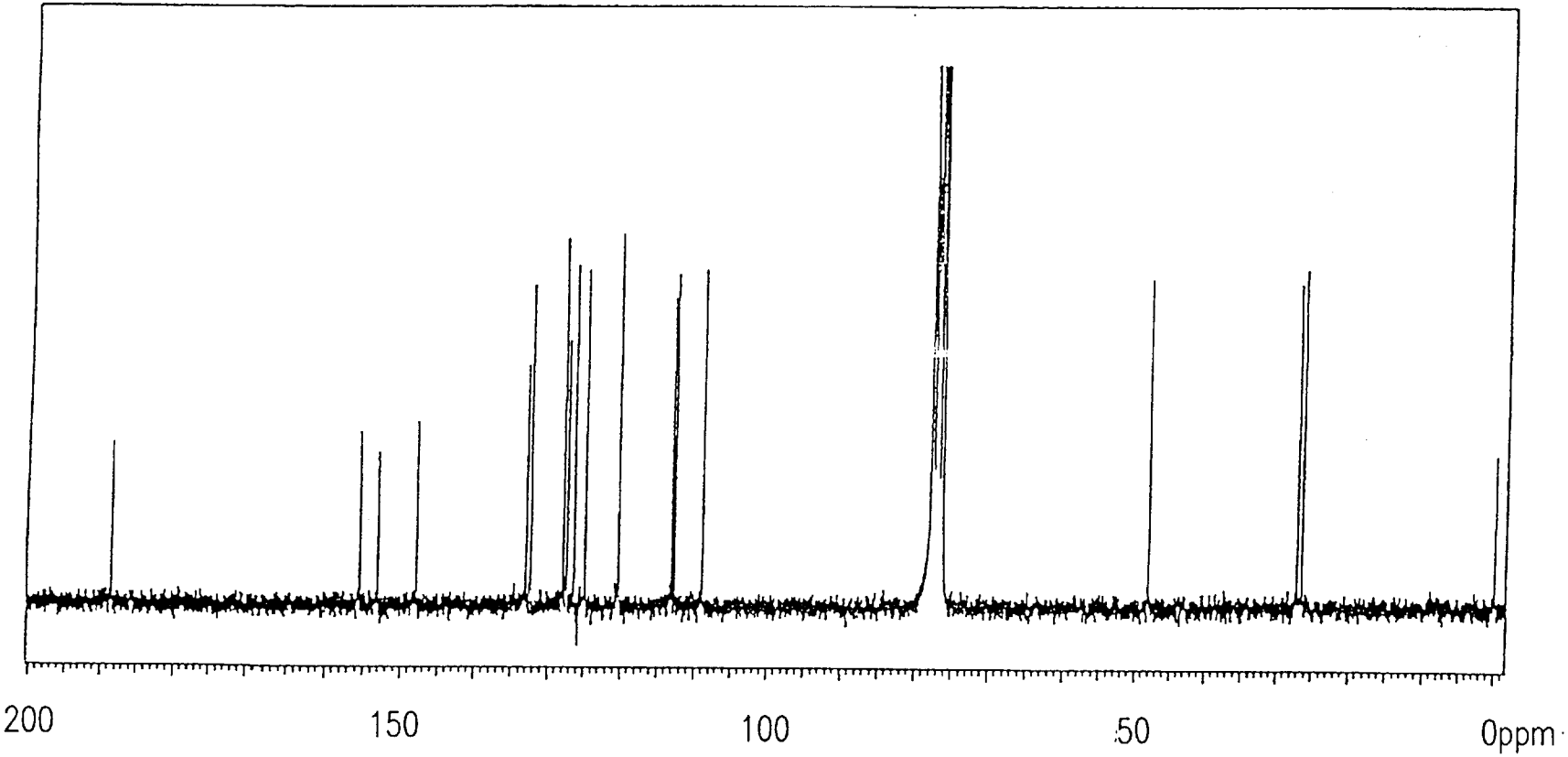
FIG. 24 shows a normal $^{13}$C-NMR spectrum of 5-formyl-2acetylbenzo[b]furan-N-aminoindoline(monohydrazone) in heavy chloroform.
Figure 25:
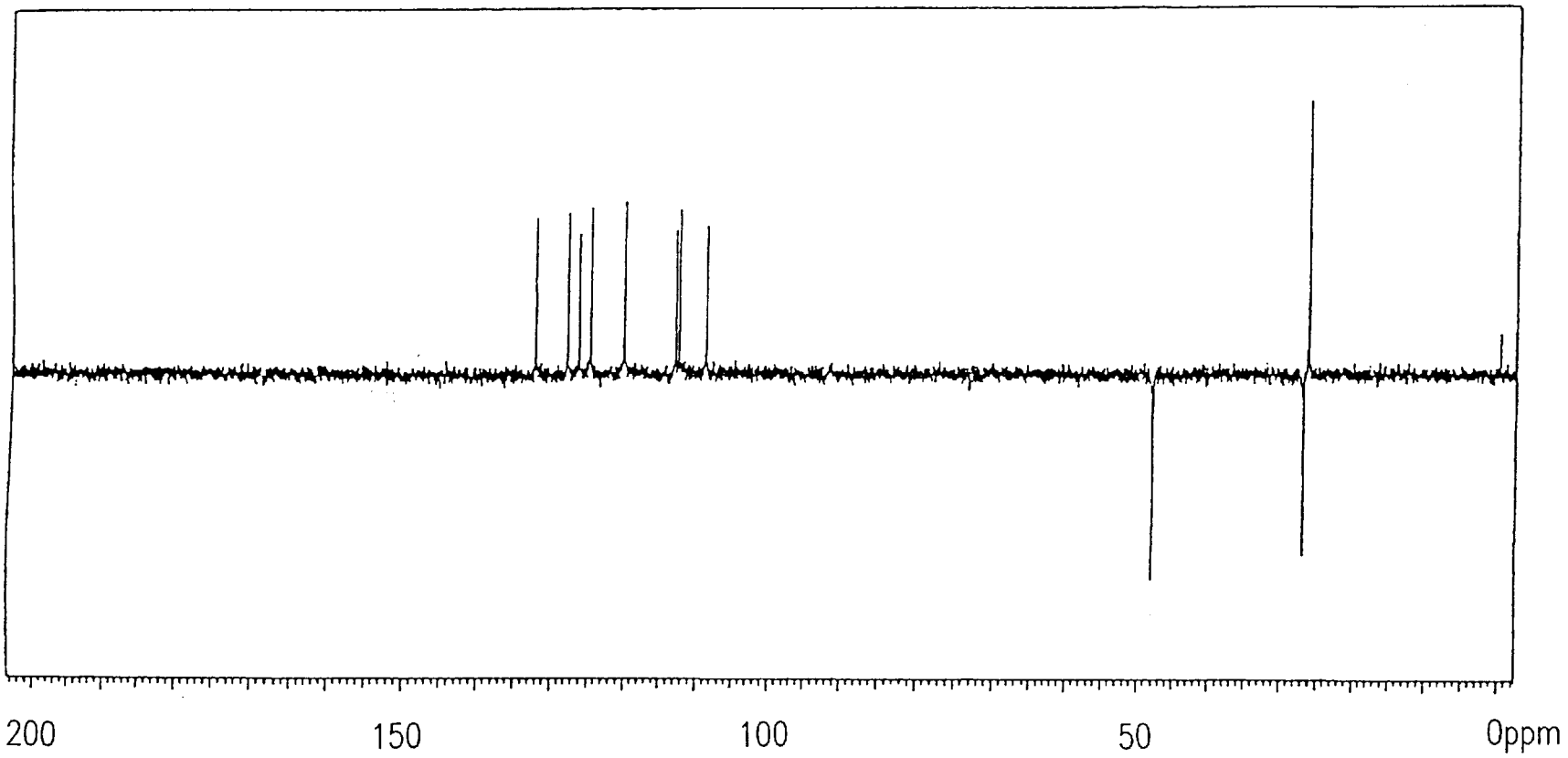
FIG. 25 shows a DEPT135 $^{13}$C-NMR spectrum of 5-formyl-2acetylbenzo[b]furan-N-aminoindoline (monohydrazone) in heavy chloroform.

The structure confirmation of the obtained 5-formyl-2-acetylbenzo[b]furan-N-aminoindoline(monohydrazone) was conducted by measuring the $^{1}$H-NMR, normal $^{13}$C-NMR and DEPT135 $^{13}$C-NMR thereof. FIG. 23 shows the measured $^{1}$H-NMR; FIG. 24 shows the measured normal $^{13}$C-NMR; and FIG. 25 shows the measured DEPT135 $^{13}$C-NMR. These NMR signals well support the structure of the target 5-formyl-2-acetylbenzo[b]furan-N-aminoindoline (monohydrazone).

(2) Production of a Bishydrazone Compound (Exemplary Compound No. 62)

About 1.0 g (1.0 equivalent) of 5-formyl-2-acetylbenzo[b]furan-N-aminoindoline(monohydrazone) was dissolved in about 6 ml of ethanol, and about 0.48 g (about 1.2 equivalents) of N-methyl-N-phenylhydrazine and about 0.05 ml of acetic acid as a catalyst were added thereto at room temperature. Then, the mixture was heated while being stirred for about 5 hours while maintaining the mixture at about 60° C. to 70° C. After confirming the completion of the reaction by TLC, the mixture was allowed to cool down. The produced solid matter was separated by filtering, and washed with ethanol. Then, the solid matter was recrystallized from ethanol so as to obtain about 1.28 g of the target bishydrazone compound (Exemplary Compound No. 62) in the form of yellow crystal (yield: about 91.8%).

Figure 26:
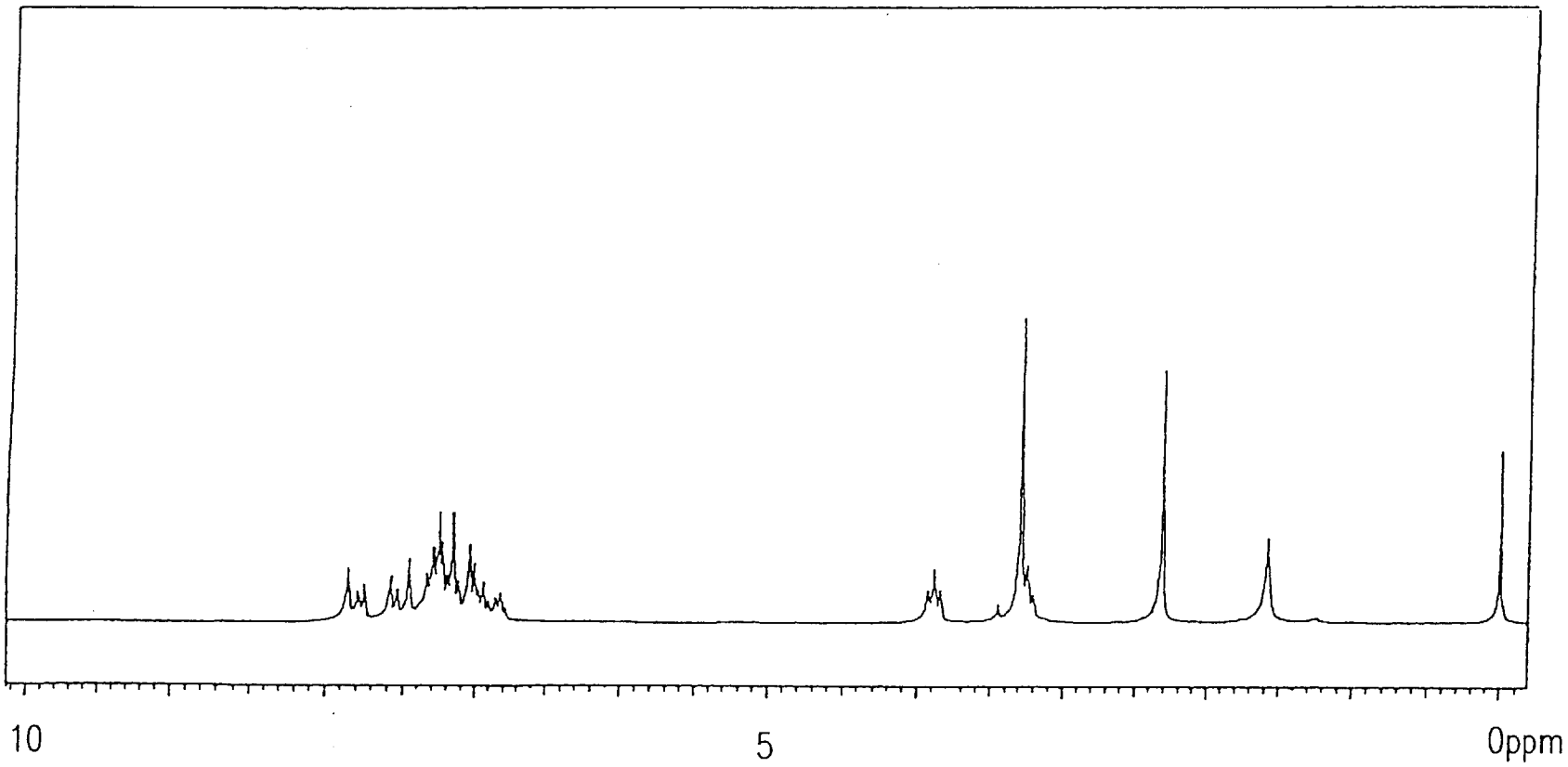
FIG. 26 shows a $^{1}$H-NMR spectrum of a bishydrazone compound of Exemplary Compound No. 62 in heavy chloroform.
Figure 27:
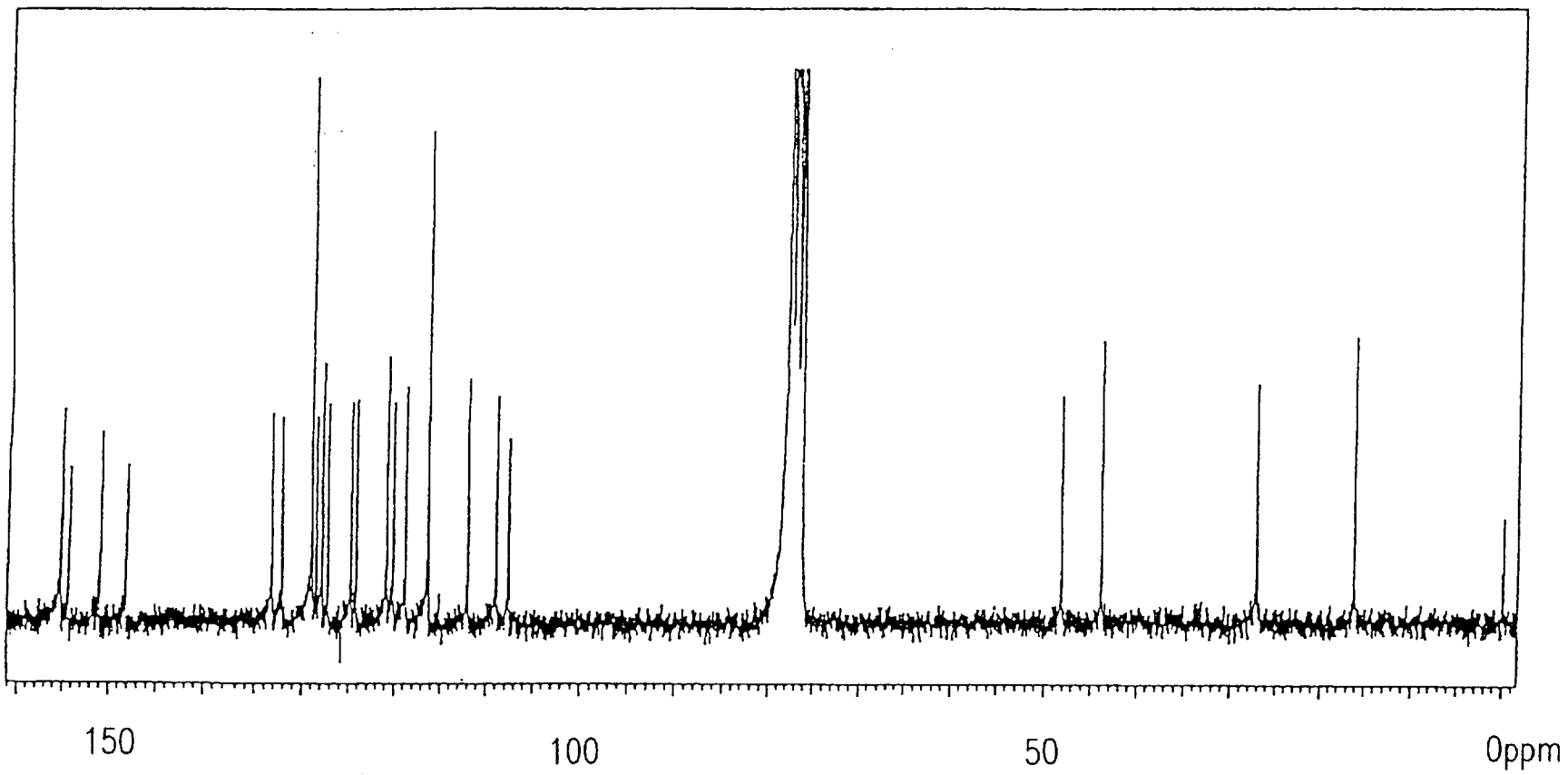
FIG. 27 shows a normal $^{13}$C-NMR spectrum of the bishydrazone compound of Exemplary Compound No. 62 in heavy chloroform.
Figure 28:
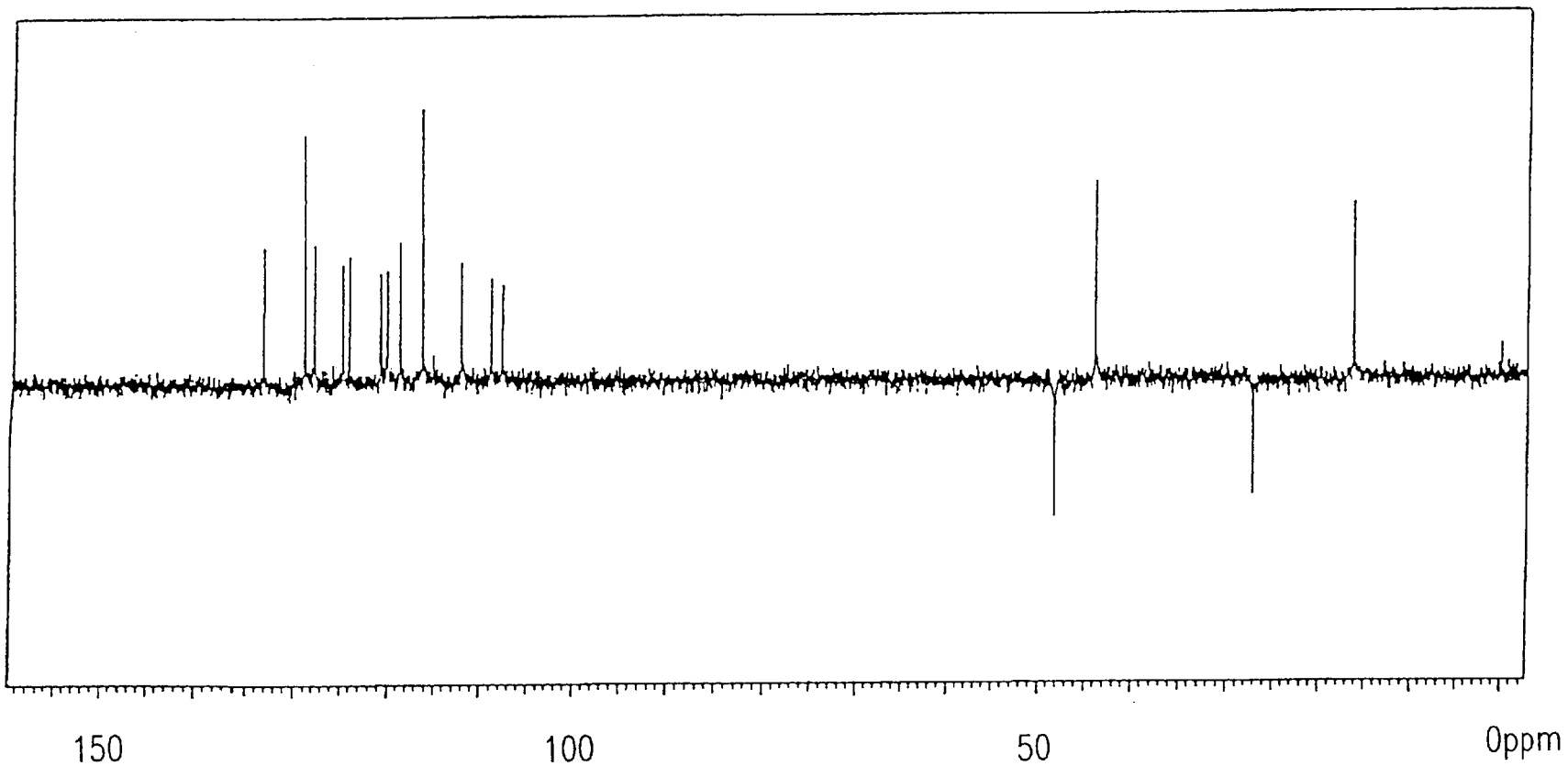
FIG. 28 shows a DEPT135 $^{13}$C-NMR spectrum of the bishydrazone compound of Exemplary Compound No. 62 in heavy chloroform.

The structure confirmation of the obtained bishydrazone compound (Exemplary Compound No. 62) was conducted by measuring the $^{1}$H-NMR, normal $^{13}$C-NMR and DEPT135 $^{13}$C-NMR thereof. FIG. 26 shows the measured $^{1}$H-NMR; FIG. 27 shows the measured normal $^{13}$C-NMR; and FIG. 28 shows the measured DEPT135 $^{13}$C-NMR. These NMR signals well support the structure of the target bishydrazone compound (Exemplary Compound No. 62).

EXAMPLE 7

In Example 7, the bishydrazone compound of Exemplary Compound No. 61 was produced as follows.

Production of a Bishydrazone Compound (Exemplary Compound No. 61)

About 1.0 g (1.0 equivalent) of 5-formyl-2-acetylbenzo[b]furan was dissolved in about 10 ml of ethanol, and about 1.56 g (about 2.4 equivalents) of N-methyl-N-phenylhydrazine and about 0.1 ml of acetic acid as a catalyst were added thereto at room temperature. Then, the mixture was heated while being stirred at about 70° C. to 80° C. for about 15 hours. After confirming the completion of the reaction by TLC, the produced solid matter was separated by filtering, and washed with ethanol. Then, the solid matter was recrystallized from ethanol so as to obtain about 1.95 g of the target bishydrazone compound (Exemplary Compound No. 61) in the form of light yellow crystal (yield: about 92.6%).

Figure 29:
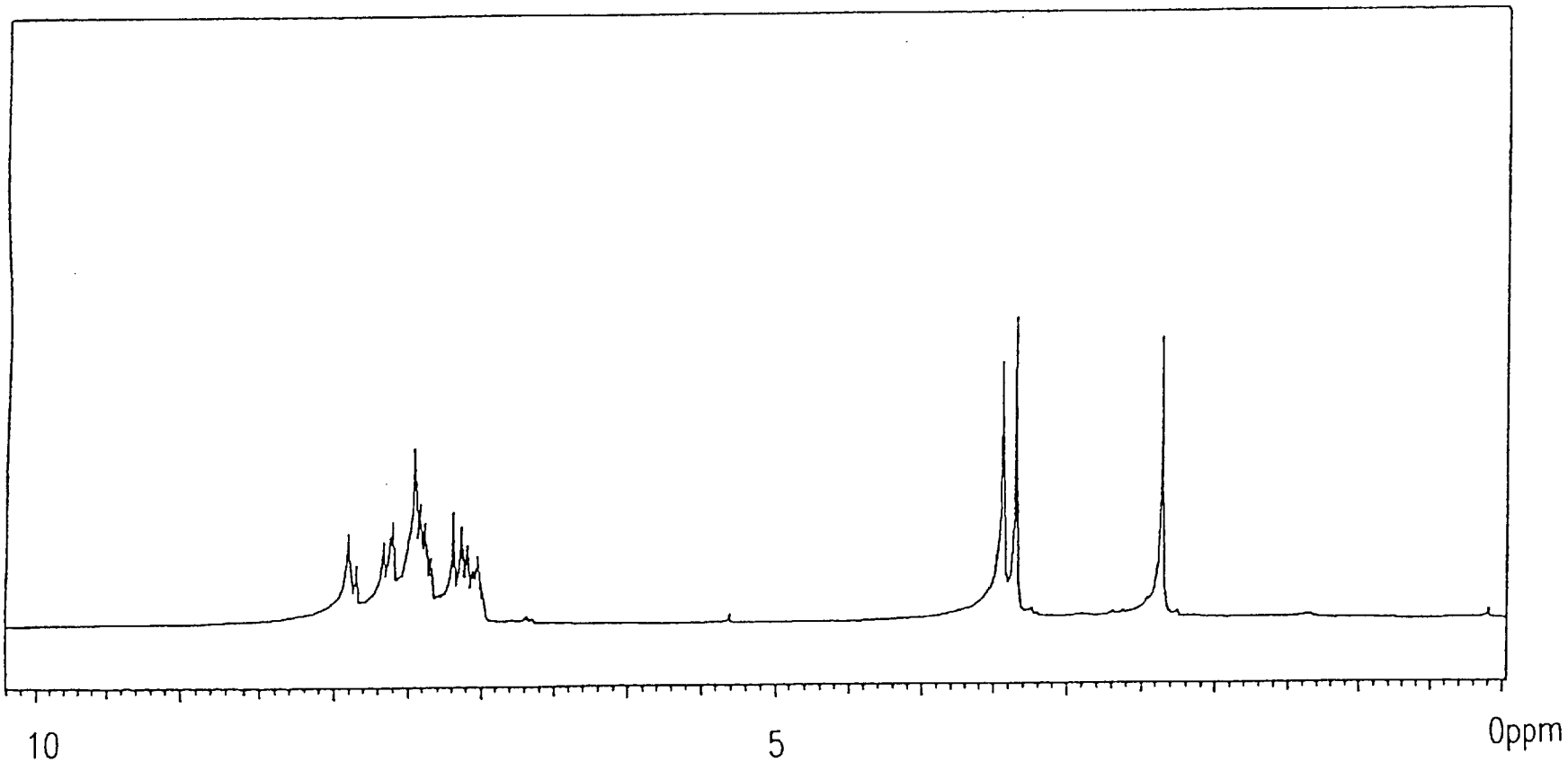
FIG. 29 shows a $^{1}$H-NMR spectrum of a bishydrazone compound of Exemplary Compound No. 61 in heavy chloroform.
Figure 30:
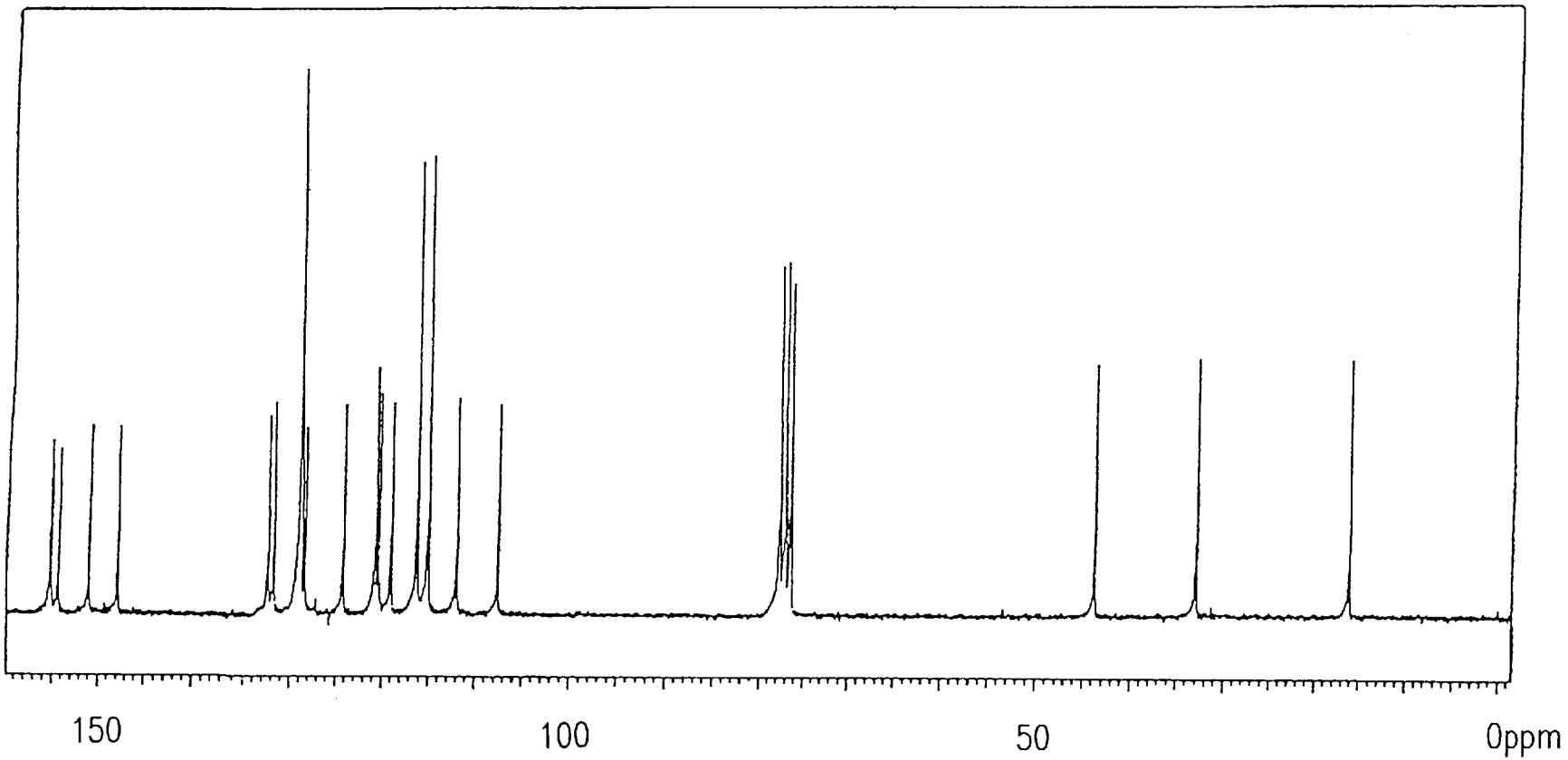
FIG. 30 shows a normal $^{13}$C-NMR spectrum of the bishydrazone compound of Exemplary Compound No. 61 in heavy chloroform.
Figure 31:
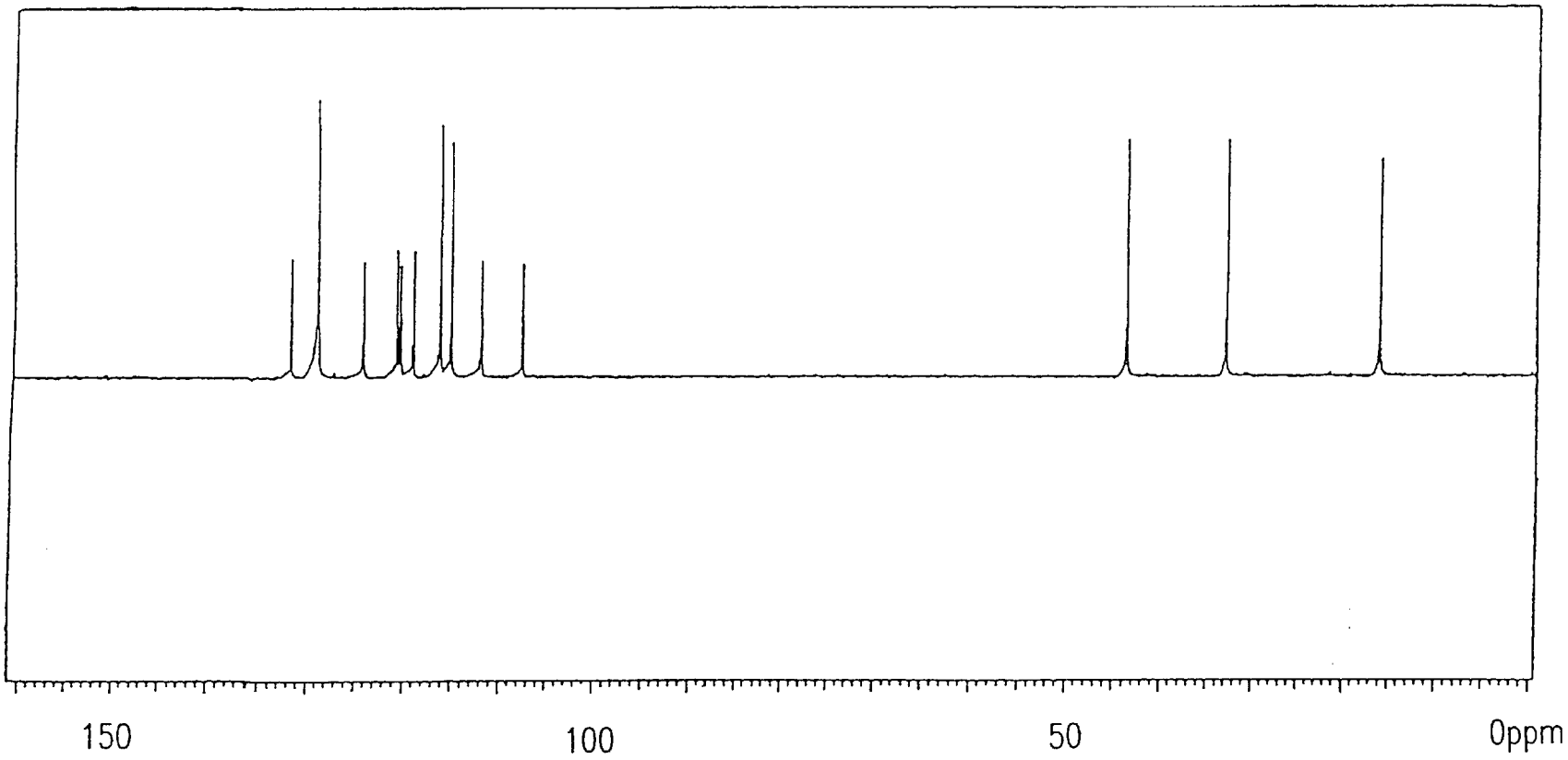
FIG. 31 shows a DEPT135 $^{13}$C-NMR spectrum of the bishydrazone compound of Exemplary Compound No. 61 in heavy chloroform.

The structure confirmation of the obtained bishydrazone compound (Exemplary Compound No. 61) was conducted by measuring the $^{1}$H-NMR, normal $^{13}$C-NMR and DEPT135 $^{13}$C-NMR thereof. FIG. 29 shows the measured $^{1}$H-NMR; FIG. 30 shows the measured normal $^{13}$C-NMR; and FIG. 31 shows the measured DEPT135 $^{13}$C-NMR. These NMR signals well support the structure of the target bishydrazone compound (Exemplary Compound No. 61).

EXAMPLE 8

In Example 8, the bishydrazone compound of Exemplary Compound No. 64 was produced as follows.

Production of a Bishydrazone Compound (Exemplary Compound No. 64)

About 1.0 g (1.0 equivalent) of 5-formyl-2-acetylbenzo[b]furan was dissolved in about 10 ml of ethanol, and about 1.71 g (about 2.4 equivalents) of N-aminoindoline and about 0.1 ml of acetic acid as a catalyst were added thereto at room temperature. Then, the mixture was heated while being stirred at about 70° C. to 80° C. for about 15 hours. After confirming the completion of the reaction by TLC, the produced solid matter was separated by filtering, and washed with ethanol. Then, the solid matter was recrystallized from ethanol so as to obtain about 2.10 g of the target bishydrazone compound (Exemplary Compound No. 64) in the form of light yellow crystal (yield: about 94.0%).

Figure 32:
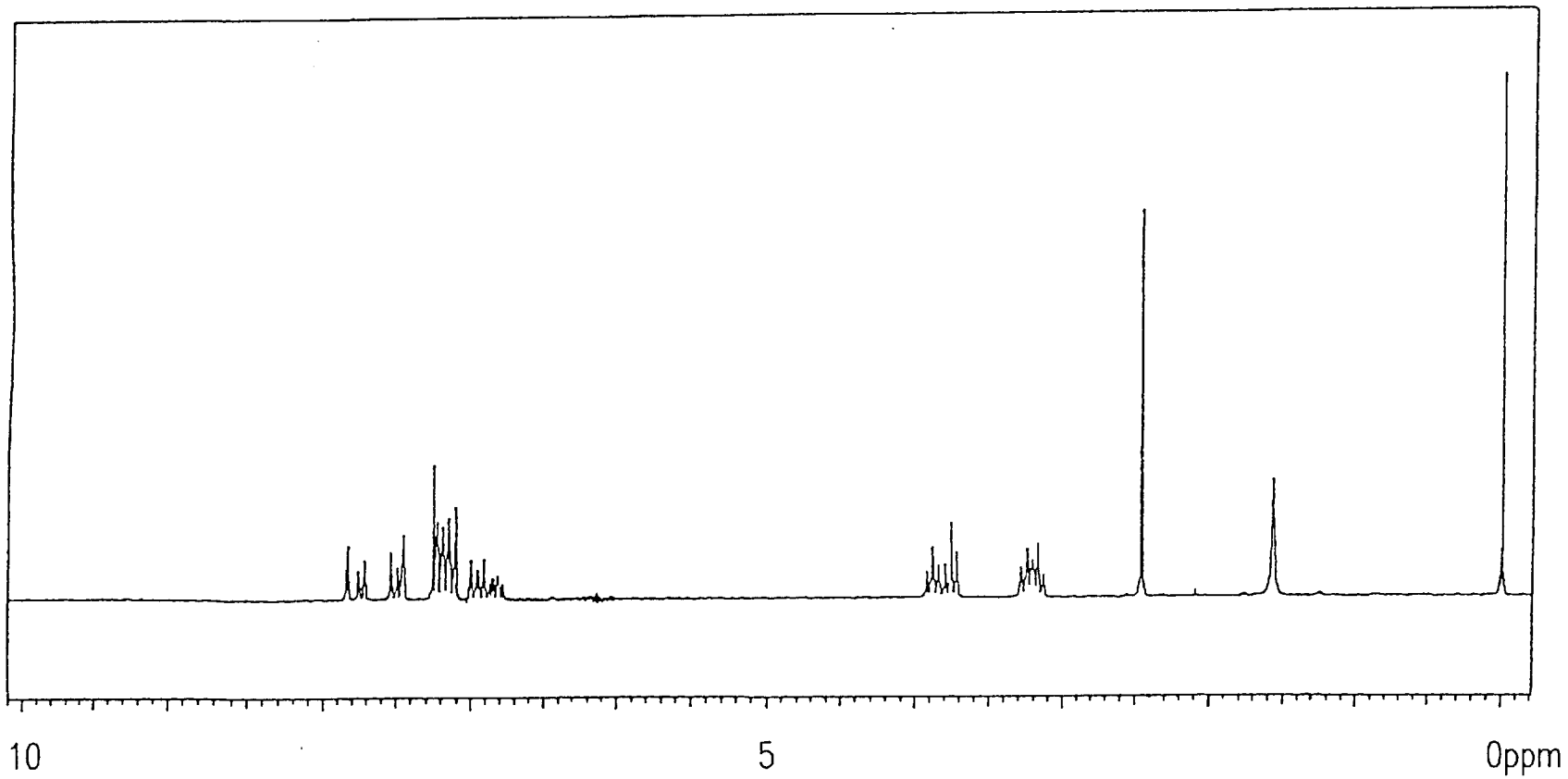
FIG. 32 shows a $^{1}$H-NMR spectrum of a bishydrazone compound of Exemplary Compound No. 64 in heavy chloroform.
Figure 33:
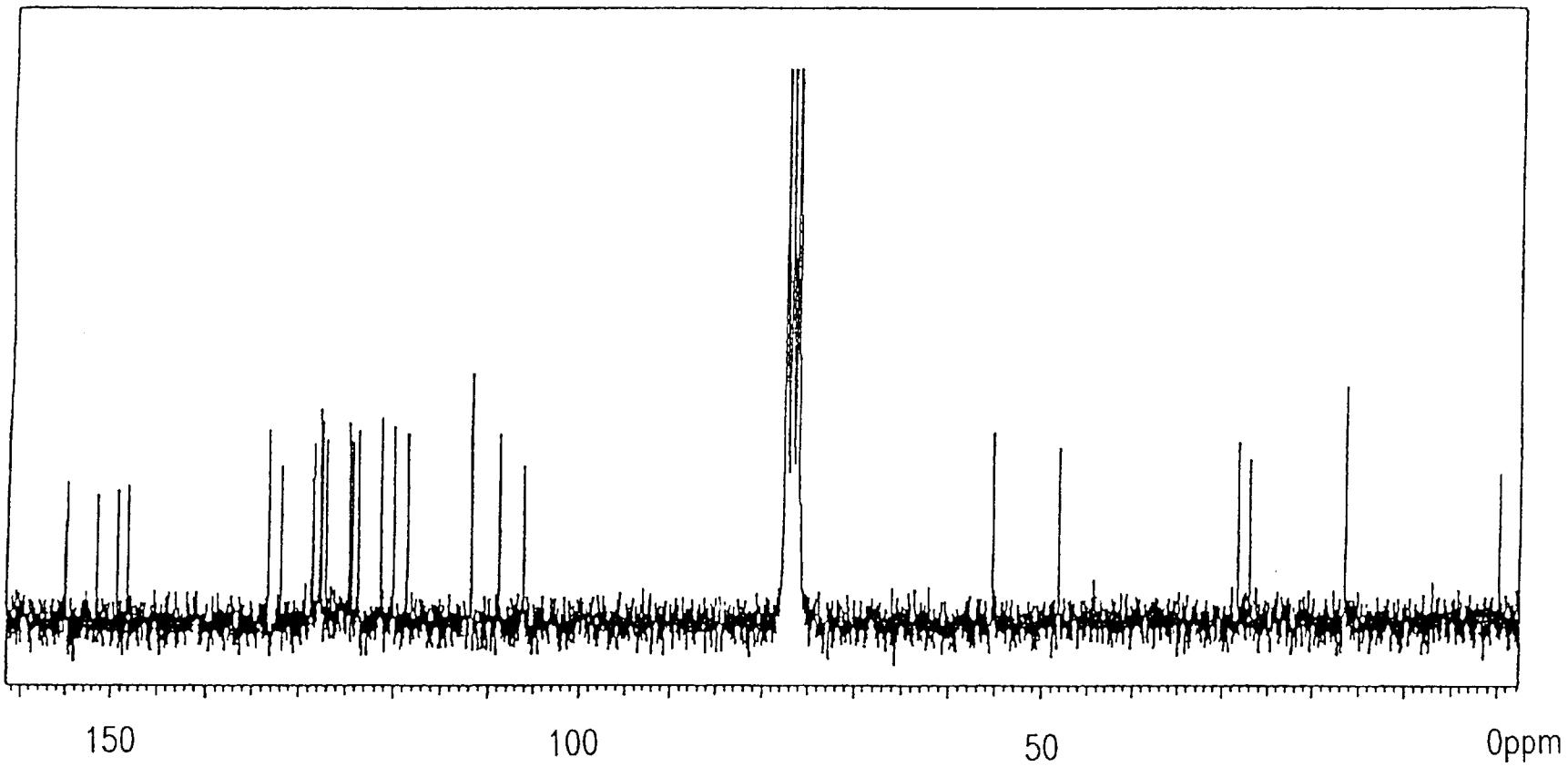
FIG. 33 shows a normal $^{13}$C-NMR spectrum of the bishydrazone compound of Exemplary Compound No. 64 in heavy chloroform.
Figure 34:
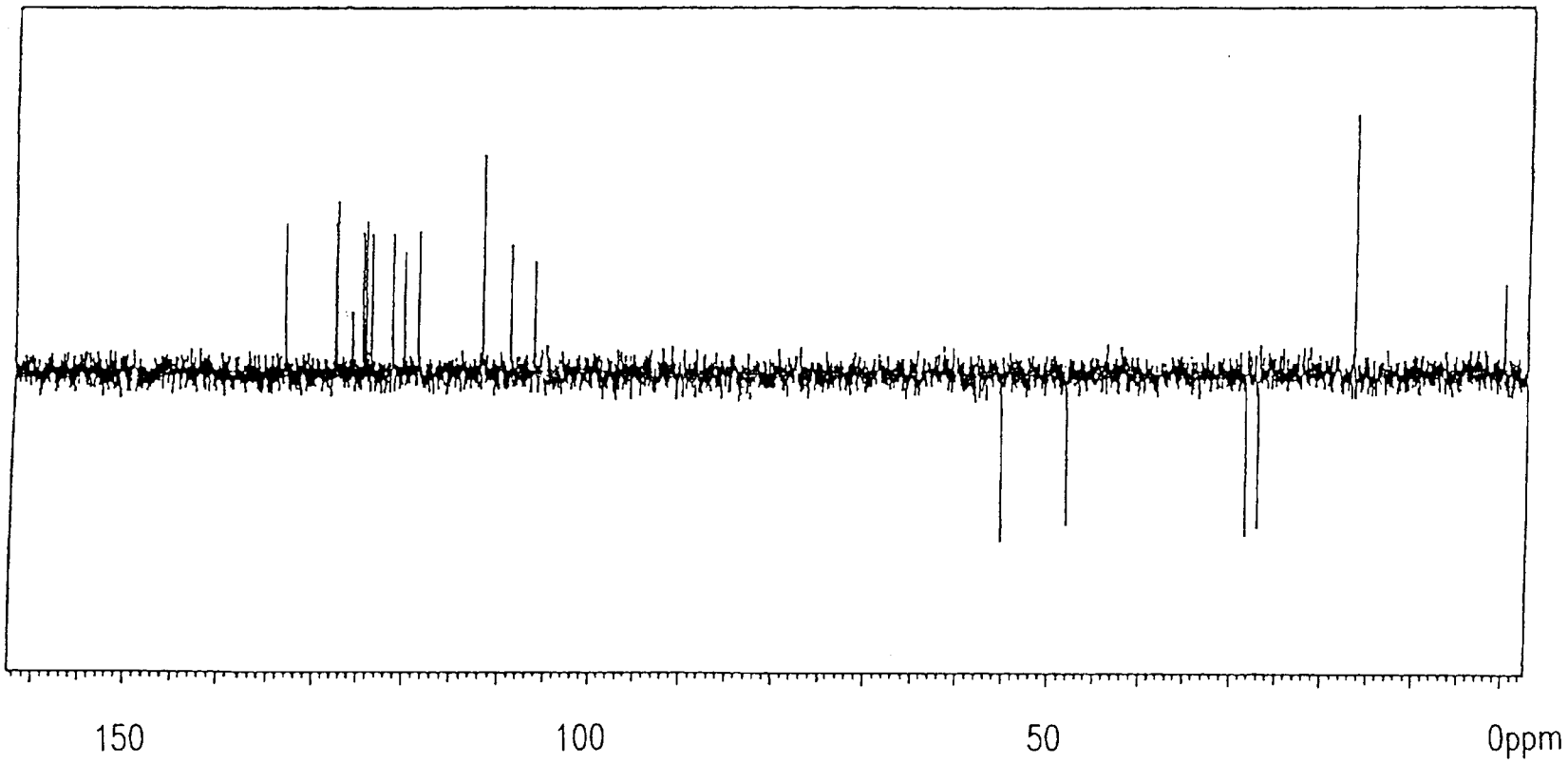
FIG. 34 shows a DEPT135 $^{13}$C-NMR spectrum of the bishydrazone compound of Exemplary Compound No. 64 in heavy chloroform.

The structure confirmation of the obtained bishydrazone compound (Exemplary Compound No. 64) was conducted by measuring the $^{1}$H-NMR, normal $^{13}$C-NMR and DEPT135 $^{13}$C-NMR thereof. FIG. 32 shows the measured $^{1}$H-NMR; FIG. 33 shows the measured normal $^{13}$C-NMR; and FIG. 34 shows the measured DEPT135 $^{13}$C-NMR. These NMR signals well support the structure of the target bishydrazone compound (Exemplary Compound No. 64).

EXAMPLE 9

In Example 9, photosensitive layers 4 of a layered structure were formed by respectively using the bishydrazone compounds of Exemplary compound Nos. 61, 63, 70, 84 and 99 as the charge transfer substance 3 contained in the charge transfer layer 6, illustrated in FIG. 1, thereby producing five different photoreceptors for electrophotography.

A polyester film (thickness: about 80 $\mu$m) with aluminum vapor-deposited thereon was used as a support. To an about 1% phenoxy resin ("PKHH": produced by Union Carbide Corp.) in THF, there was added a substantially equivalent amount of bisazo pigment represented by the following formula (XVIb). Then, the pigment was dispersed in a paint conditioner (produced by Red Devil Co., Ltd.) using glass beads having a diameter of about 1.5 mm for about 2 hours, so as to prepare a coating liquid. The coating liquid was applied by the doctor blade method on the support and dried thereon. After being dried, the resultant film had a thickness of about 0.2 $\mu$m.

(XVIb)

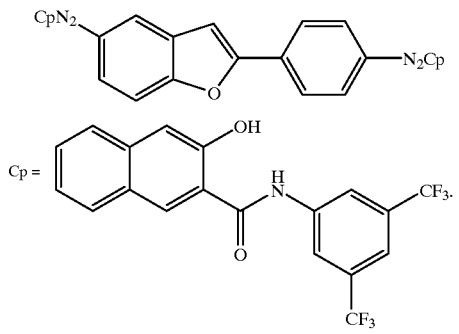

Then, about 1 g of each of the bishydrazone compounds of Exemplary compound Nos. 61, 63, 70, 84 and 99 and about 1.2 g of a polyalylate resin ("U-100": produced by Unitika Ltd.) were dissolved in methylene chloride so as to prepare an about 15% solution. The solution was applied with a doctor blade method and dried, thereby producing a resin-bisamine compound solid solution phase (charge transfer layer) having a thickness of about 25 $\mu$m after being dried.

The electrophotographic characteristics of the obtained photoreceptors were evaluated using an electrostatic recording paper test device ("SP-428": produced by Kawaguchi Denki Co., Ltd.). An exposure $E_{100}$ (lux.s) required for lowering the potential from about −700 V to about −100 V with a white light irradiation (irradiation: about 5 lux) and an initial potential $V_0$ (−volt) were measured under conditions of applied voltage: about −6 kV and static: No. 3. The results are shown in Table 23 below. Moreover, in the 10000th cycle (one cycle: from application of electrical charge to removal of electrical charge) (irradiation for removal of electrical charge: one-second irradiation of about 40-lux white light), the exposure $E_{100}$ (lux.s) and the initial potential $V_0$ (−volt) were measured again using the same apparatus so as to determine the variation of the values $E_{100}$ and $V_0$.

TABLE 23

| | First cycle | | 10000th cycle | |
|---|---|---|---|---|
| Cpd. No. | $V_0$ (−Volt) | $E_{100}$ (lux · s) | $V_0$ (-Volt) | $E_{100}$ (lux · s) |
| Cpd. No. 61 | 710 | 2.0 | 700 | 2.1 |
| Cpd. No. 63 | 700 | 2.1 | 690 | 2.2 |
| Cpd. No. 70 | 720 | 2.1 | 700 | 2.2 |
| Cpd. No. 84 | 715 | 2.0 | 700 | 2.1 |
| Cpd. No. 99 | 600 | 2.1 | 690 | 2.2 |

The results shown in Table 23 above indicated that bisenamine compounds of the present invention have good sensitivity and repeating properties.

EXAMPLE 10

In Example 10, a photosensitive layer 4 of a layered structure was formed by using the bishydrazone compound of Exemplary compound No. 62 as the charge transfer substance 3 contained in the charge transfer layer 6, illustrated in FIG. 1, thereby producing a photoreceptor for electrophotography.

About 0.4 g of an X-type metal-free phthalocyanine ("Firstgen Blue-8120": produced by Dainippon Ink & Chemicals, Inc.), which is represented by the following formula (XVIIb), was added to about 30 ml of an ethyl acetate solution containing about 0.3 g of a vinyl chloride-vinyl acetate copolymer resin ("Eslex M": produced by Sekisui Chemical Co., Ltd.) dissolved therein. Then, the pigment was dispersed in a paint conditioner for about 20 minutes, so as to prepare a coating liquid. The coating liquid was applied on a polyester film with aluminum vapor-deposited thereon, and was dried so as to produce a charge generation layer with a thickness of about 0.4 $\mu$m after being dried.

(XVIIb)

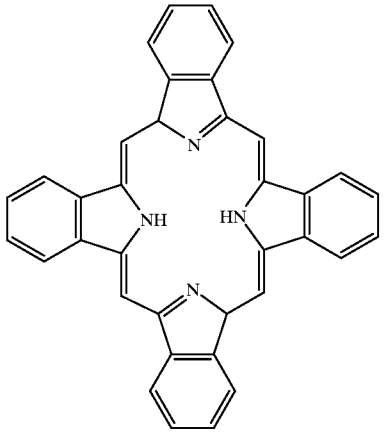

Then, a polyalylate layer containing about 50% by weight of the bishydrazone compound of Exemplary compound No. 62 was formed on the produced charge generation layer, thereby producing a photoreceptor having two layers.

The present photoreceptor was evaluated with light at about 780 nm, so as to measure the energy ($E_{50}$) required for lowering the potential by half and the initial potential ($-V_0$). As a result, $V_0$ was about −750 (volt) and $E_{50}$ was about 0.22 ($\mu$J/cm$^2$), indicating that the photoreceptor had very high sensitivity and high chargeability.

Moreover, the photoreceptor for electrophotography according to the present example was attached to a drum in a laser printer ("WD-580P": Sharp K.K.), and a non copy aging test was conducted by repeating a process of printing a blank document for 10000 cycles. In the 10000th cycle, the initial potential and the sensitivity were measured to determine the respective decrease thereof. As a result, $V_0$ was about −730 (volt) and $E_{50}$ was about 0.23 ($\mu$J/cm$^2$), indicating only little change in the values.

EXAMPLE 11

In Example 11, photosensitive layers 40 of a single layer structure were formed by respectively using the bishydrazone compounds of Exemplary compound Nos. 64, 67, 79 and 101 as the charge transfer substance 3 illustrated in FIG. 3, thereby producing four different photoreceptors for electrophotography.

First, about 1 g of Exemplary compound Nos. 64, 67, 79 or 101 of the present invention, about 1.1 g of a polycarbonate resin represented by the following structural formula (XVIIIb), about 0.15 g of N,N-3,5-xylyl-3,4,9,10-perylenetetracarboxylimide and about 0.05 g of an ultraviolet absorber were dissolved in methylene chloride, with the imide compound being partially dispersed, so as to prepare a coating liquid.

(XVIIIb)

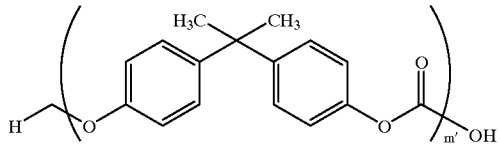

The coating liquid was applied using an applicator on a support formed of an aluminum substrate whose surface had been subjected to an alumite treatment (alumite layer thickness: about 7 $\mu$m) and dried thereon so as to obtain a single layer photoreceptor which had a thickness of about 20 $\mu$m.

The electrophotographic characteristics of the obtained photoreceptors were evaluated using an electrostatic recording paper test device under conditions of applied voltage: about 5.5 kV and static: No. 3. The exposure $E_{100}$ (lux.s) required for lowering the potential from about +700 V to about +100 V with a white light irradiation was measured. The results are shown in Table 24 below. Moreover, a non copy aging test was conducted by repeating a process of printing a blank document for 10000 cycles so as to determine the decrease in the sensitivity ($E_{100}$). The results are also shown in Table 24 below.

TABLE 24

| Cpd. | $E_{100}$(lux · s) | |
|---|---|---|
| No. | First cycle | 10000th cycle |
| Cpd. No. 64 | 2.0 | 2.1 |
| Cpd. No. 67 | 2.1 | 2.2 |
| Cpd. No. 79 | 2.3 | 2.4 |
| Cpd. No. 101 | 2.1 | 2.2 |

The results shown in Table 24 above indicated that the photoreceptors with the bishydrazone compound of the present invention had good sensitivity and superior repeatability also when positively charged.

EXAMPLE 12

In Example 12, the cyclic bishydrazone compound shown in Table 9 as Exemplary compound No. 111 was produced as follows.

About 0.6 g (1.0 equivalent) of 2,5-bisformylbenzo[b] furan was dissolved in about 10 ml of ethanol, and about 0.97 g (about 2.1 equivalents) of 1-amino-2,3-dihydroindole and about 0.05 ml of acetic acid were added thereto. Then, the mixture was heated while being stirred at about 60° C. to 70° C. for about 5 hours.

After the completion of the reaction, the produced solid matter was separated by filtering and sufficiently washed with ethanol. Then, the solid matter was purified by recrystallization from ethanol so as to obtain about 1.40 g of the target cyclic bishydrazone compound of Exemplary compound No. 111 in the form of yellow powder (yield: about 93%).

Figure 35:
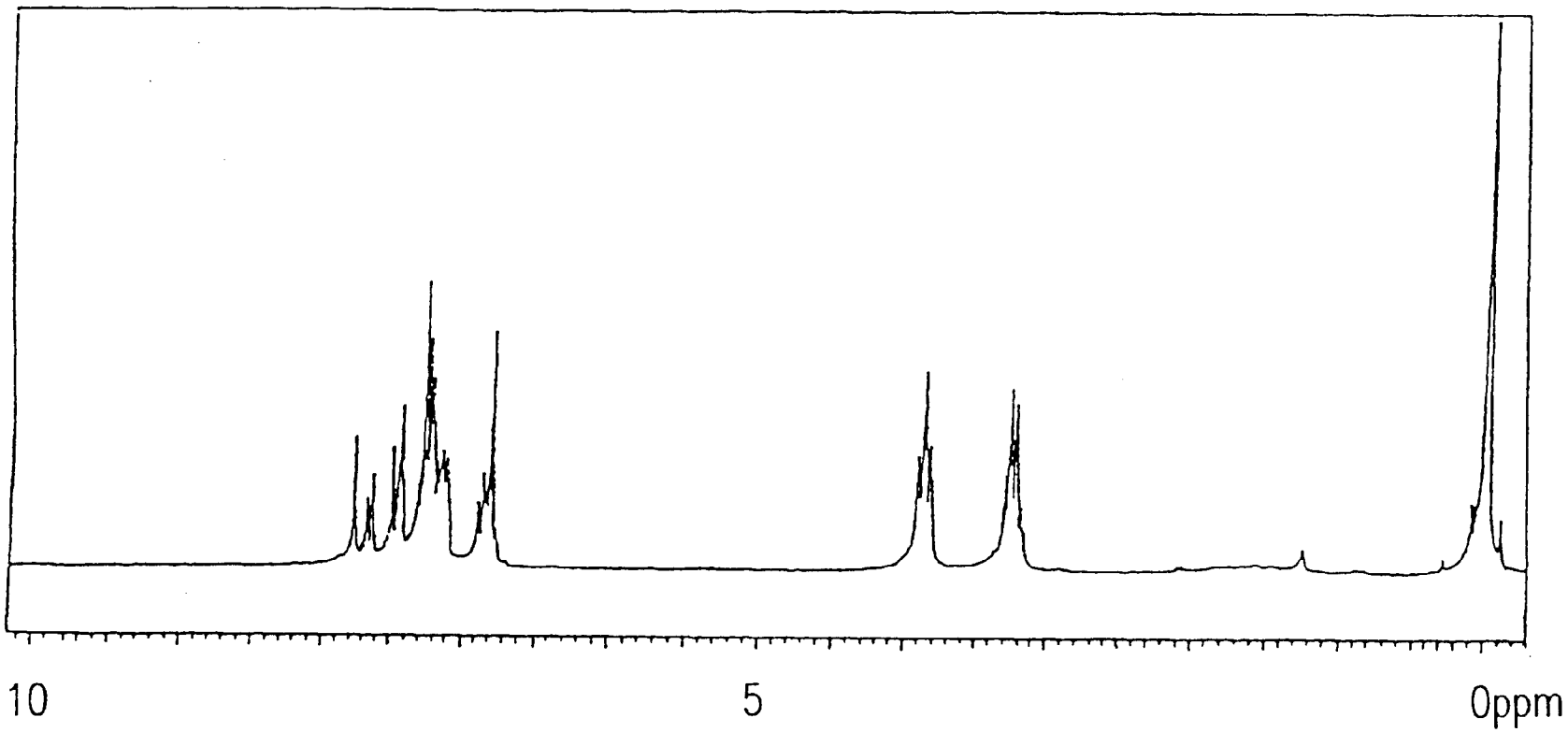
FIG. 35 shows a $^{1}$H-NMR spectrum of a cyclic bishydrazone compound of Exemplary Compound No. 111.
Figure 36:
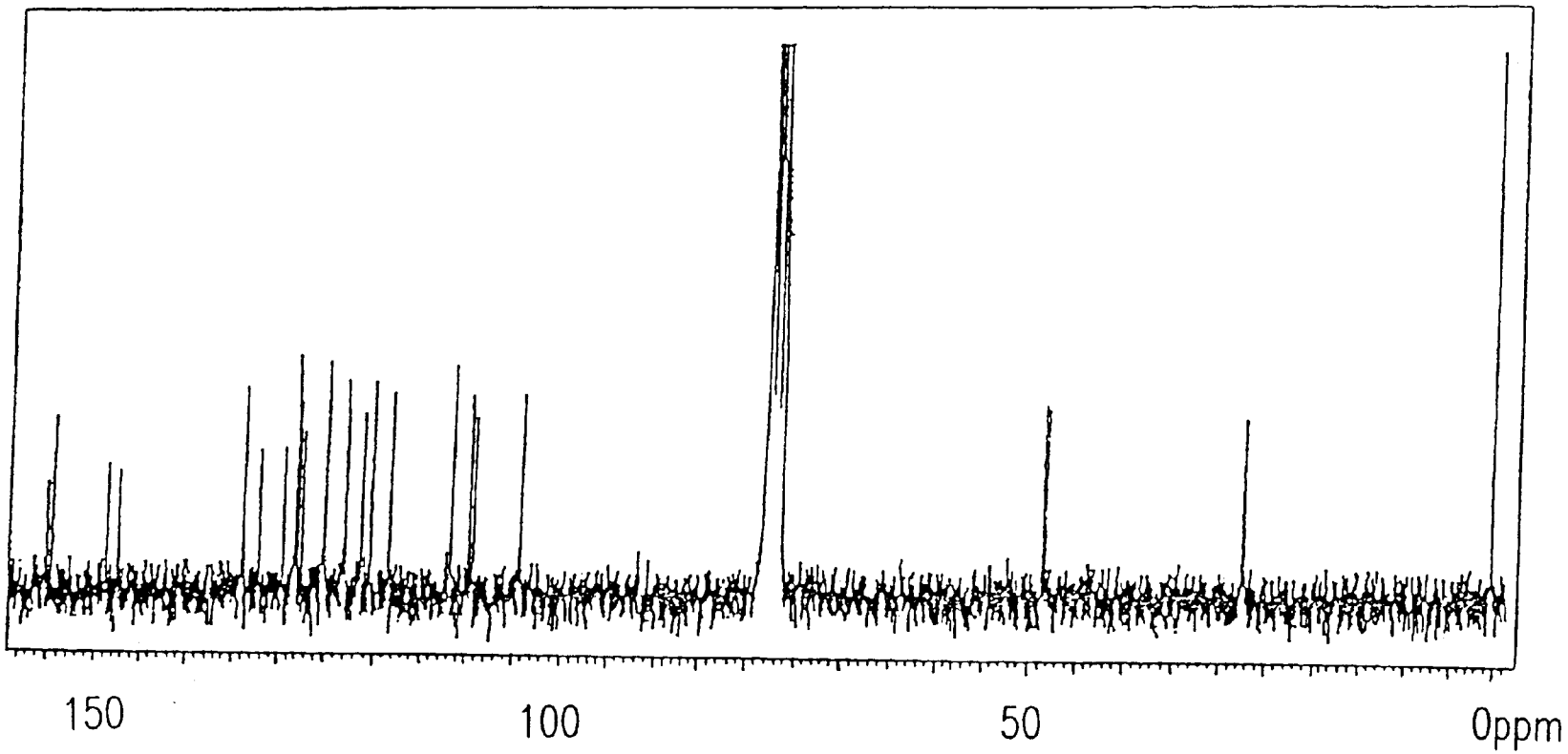
FIG. 36 shows a normal $^{13}$C-NMR spectrum of the cyclic bishydrazone compound of Exemplary Compound No. 111.
Figure 37:
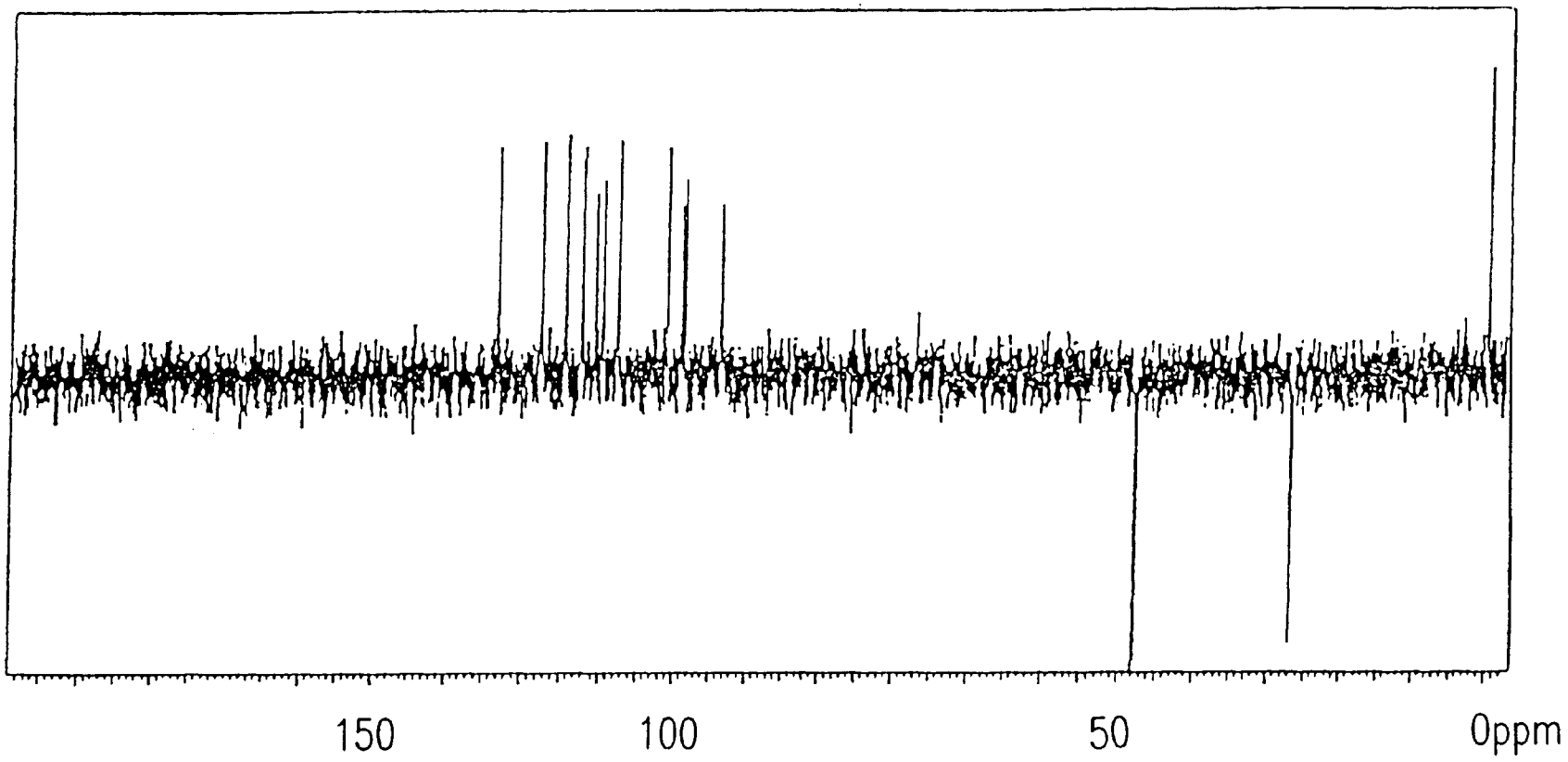
FIG. 37 shows a DEPT135 $^{13}$C-NMR spectrum of the cyclic bishydrazone compound of Exemplary Compound No. 111.

The structure confirmation of the obtained cyclic bishydrazone compound of Exemplary compound No. 111 was conducted by measuring the $^{1}$H-NMR, normal $^{13}$C-NMR and DEPT135 $^{13}$C-NMR thereof. FIG. 35 and Table 25 below show the measured $^{1}$H-NMR; FIG. 36 and Table 26 show the measured normal $^{13}$C-NMR; and FIG. 37 and Table 27 below show the measured DEPT135 $^{13}$C-NMR.

TABLE 25

| 1H-NMR | |
|---|---|
| ppm = | 3.25 (4H,q,J = 9Hz) |
| | 3.88 (4H,t,J = 9Hz) |
| | 6.77–7.88 (14H,m) |

TABLE 26

| 13C-NMR | |
|---|---|
| ppm = | 26.99 (CH2) |
| | 27.16 (CH2) |
| | 47.87 (CH2) |
| | 48.25 (CH2) |
| | 103.91 (CH) |
| | 108.94 (CH) |
| | 109.44 (CH) |
| | 111.38 (CH) |
| | 118.05 (CH) |
| | 120.02 (CH) |
| | 121.00 (CH) |
| | 122.61 (CH) |
| | 122.80 (CH) |
| | 124.73 (CH) |
| | 124.85 (CH) |
| | 127.25 (C) |
| | 127.60 (C) |
| | 127.85 (CH) |
| | 128.00 (CH) |
| | 129.26 (C) |
| | 131.92 (C) |
| | 133.64 (CH) |
| | 147.10 (C) |
| | 148.34 (C) |
| | 154.35 (C) |
| | 154.90 (C) |

TABLE 27

| DEPT135,13C-NMR | |
|---|---|
| ppm = | 26.99 (CH2) |
| | 27.16 (CH2) |
| | 47.87 (CH2) |
| | 48.25 (CH2) |
| | 103.91 (CH) |
| | 108.94 (CH) |
| | 109.44 (CH) |
| | 111.38 (CH) |
| | 118.05 (CH) |
| | 120.02 (CH) |
| | 121.00 (CH) |
| | 122.61 (CH) |
| | 122.80 (CH) |
| | 124.73 (CH) |
| | 124.85 (CH) |
| | 127.85 (CH) |
| | 128.00 (CH) |
| | 133.64 (CH) |

These NMR signals well support the structure of the target cyclic bishydrazone compound of Exemplary compound No. 111.

Although the cyclic bishydrazone compound shown in Table 9 as Exemplary compound No. 111 has been described in Example 12, the other cyclic bishydrazone compounds of the present invention represented by the general formula (Ic) may be produced similarly.

EXAMPLE 13

In Example 13, photosensitive layers 4 of a layered structure were formed by respectively using the cyclic bishydrazone compounds shown in Table 9 as Exemplary compound Nos. 111, 113, 115, 116 and 119 as the charge transfer substance 3 contained in the charge transfer layer 6, illustrated in FIG. 1, thereby producing five different photoreceptors for electrophotography.

First, to an about 1% THF (tetrahydrofuran) solution in which a polyvinyl butyral resin ("Eslex B": produced by Nisshin Kagaku Kogyo), a bisazo pigment represented by the following structural formula (VIIc) of an amount substantially equal to that of the resin was added. Then, the pigment was dispersed in a paint conditioner (produced by Red Devil Co., Ltd.) using glass beads having a diameter of about 1.5 mm for about 2 hours, so as to prepare a coating liquid.

(VIIc)

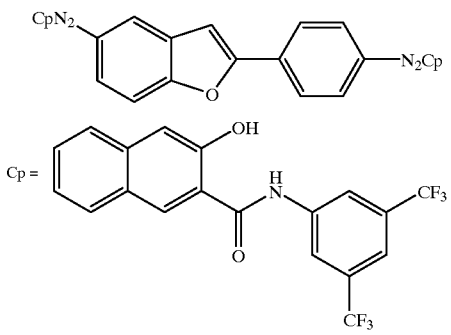

The coating liquid was applied on the conductive support 1 formed of a polyester film (thickness: about 80 μm) with aluminum vapor-deposited thereon, and was dried. The obtained charge generation layer 5 had a thickness of about 0.2 μm.

Then, about 1 g of each of the bishydrazone compounds shown in Table 9 as Exemplary compound Nos. 111, 113, 115, 116 and 119 and about 1.2 g of a polyalylate resin ("U-100": produced by Unitika Ltd.) were dissolved in methylene chloride so as to prepare an about 15% solution, thereby obtaining five different coating liquids. The five coating liquids were respectively applied on the charge generation layers 5 with a doctor blade method and dried thereon. The obtained charge transfer layers (resin-bishydrazone compound solid solution phase) 6 each had a thickness of about 25 μm. Thus, the photosensitive layers 4 of a layered structure were formed, thereby obtaining the five photoreceptors for electrophotography.

The electrophotographic characteristics of the obtained photoreceptors were evaluated using an electrostatic recording paper test device ("SP-428": produced by Kawaguchi Denki Co., Ltd.). An exposure $E_{100}$ (lux.s) required for lowering the potential from about −700 V to about −100 V with a white light irradiation (irradiation: about 5 lux) and an initial potential $V_0$ (−volt) were measured under conditions of applied voltage: about −6 kV and static: No. 3. Then, in the 10000th cycle (one cycle: from application of electrical charge to removal of electrical charge) (irradiation for removal of electrical charge: one-second irradiation of about 40-lux white light), the exposure $E_{100}$ (lux.s) and the initial potential $V_0$ (−volt) were measured again. The measured values are shown in Table 28 below.

TABLE 28

| Cpd. | First cycle | | 10000th cycle | |
|---|---|---|---|---|
| No. | $V_0$(Volt) | $E_{100}$(lux · s) | $V_0$(Volt) | $E_{100}$(lux · s) |
| Cpd. No. 111 | 710 | 2.0 | 705 | 2.2 |
| Cpd. No. 113 | 700 | 2.1 | 690 | 2.3 |
| Cpd. No. 115 | 730 | 2.2 | 715 | 2.4 |
| Cpd. No. 116 | 705 | 2.0 | 690 | 2.1 |
| Cpd. No. 119 | 720 | 2.1 | 700 | 2.2 |

The results shown in Table 28 above indicated that each of the photoreceptors for electrophotography according to the present example had good sensitivity, high chargeability and superior repeatability.

EXAMPLE 14

In Example 14, the photosensitive layer 4 of a layered structure was formed by using the bishydrazone compound shown in Table 9 as Exemplary compound No. 114 as the charge transfer substance 3 contained in the charge transfer layer 6, illustrated in FIG. 1, thereby producing a photoreceptor for electrophotography.

First, about 0.4 g of an X-type metal-free phthalocyanine ("Firstgen Blue-8120": produced by Dainippon Ink & Chemicals, Inc.) was added to about 30 ml of an ethyl acetate solution containing about 0.3 g of a vinyl chloride-vinyl acetate copolymer resin ("Eslex M": produced by Sekisui Chemical Co., Ltd.) dissolved therein. Then, the pigment was dispersed in a paint conditioner (produced by Red Devil Co., Ltd.) for about 20 minutes, so as to prepare a coating liquid. The coating liquid was applied on the conductive support 1 formed of a polyester film with aluminum vapor-deposited thereon, and was dried. The obtained charge generation layer 5 had a thickness of about 0.4 μm.

Then, a polyalylate layer containing about 50% by weight of the bishydrazone compound shown in Table 9 as Exemplary compound No. 114 was formed on the charge generation layer 5. Thus, a photoreceptor for electrophotography having the photosensitive layer 4 of a layered structure was obtained.

The spectral sensitivity of the obtained photoreceptor at about 780 nm was evaluated by measuring the energy $E_{50}$ required for lowering the potential by half and the initial potential $V_0$ (−volt) on a voltage application to about −6 kV. As a result, $V_0$ was about 720 (−volt) and $E_{50}$ was about 0.24 ($\mu J/cm^2$), indicating that the photoreceptor had very high sensitivity and high chargeability.

Moreover, the photoreceptor for electrophotography according to the present example was attached to a drum in a laser printer ("WD-580P": Sharp K.K.), and a non copy aging test was conducted by repeating a process of printing a blank document for 10000 cycles. In the 10000th cycle, the initial potential and the sensitivity were measured to determine the respective decrease thereof. As a result, $V_0$ was about 710 (−volt) and $E_{50}$ was about 0.25 ($\mu J/cm^2$), indicating excellent repeatability of the photoreceptor.

EXAMPLE 15

In Example 15, photosensitive layers 40 of a single layer structure were formed by respectively using the cyclic bishydrazone compounds shown in Table 9 as Exemplary compound Nos. 112, 113, 114 and 118 as the charge transfer substance 3 illustrated in FIG. 3, thereby producing four different photoreceptors for electrophotography.

First, about 1.1 g of a polyalylate resin represented by the following structural formula (VIIIc), about 0.15 g of N,N-3,5-xylyl-3,4-xylyl-3,4,9,10-perylenetetracarboxylimide and about 0.05 g of an antioxidant (BHQ) were dissolved in methylene chloride so as to prepare a coating liquid, with the imide compound being partially dispersed.

(VIIIc)

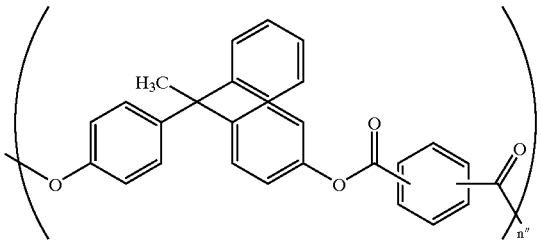

In the above formula, n" represents an integer of about 100 to 10000, depending upon the polymer synthesis condition.

The coating liquid was applied using an applicator on the conductive support 1 formed of an aluminum substrate whose surface had been subjected to an alumite treatment (alumite layer thickness: about 7 $\mu$m) and dried thereon so as to obtain the photosensitive layer 40 which had a thickness of about 20 $\mu$m. Thus, the photosensitive layers 40 of a single layer structure were formed, thereby producing the four different photoreceptors for electrophotography.

The electrophotographic characteristics of the obtained photoreceptors were evaluated using an electrostatic recording paper test device ("SP-428": produced by Kawaguchi Denki Co., Ltd.). An exposure $E_{100}$ (lux.s) required for lowering the potential from about +700 V to about +100 V with a white light irradiation (irradiation: about 5 lux) was measured under conditions of applied voltage: about +5.5 kV and static: No. 3. Then, in the 10000th cycle of the non copy aging test, the decrease in the sensitivity $E_{100}$ (lux.s) was evaluated. The results are shown in Table 29 below.

TABLE 29

| Cpd | $E_{100}$(lux · s) | |
|---|---|---|
| No. | First cycle | 10000th cycle |
| Cpd. No. 112 | 2.1 | 2.2 |
| Cpd. No. 113 | 2.2 | 2.3 |
| Cpd. No. 114 | 2.1 | 2.2 |
| Cpd. No. 118 | 2.0 | 2.1 |

The results shown in Table 29 above indicated that each of the photoreceptors for electrophotography according to the present example had good sensitivity and superior repeatability also when positively charged.

As described in detail above, the bishydrazone compounds of the present invention having a benzofuran backbone are novel compounds. Moreover, the bishydrazone compounds of the present invention can be very easily produced at a very high yield in accordance with the method of the present invention for producing the bishydrazone compound and the method of the present invention for producing the intermediate thereof.

The photoreceptors for electrophotography of the present invention which contains the bishydrazone compounds of the present invention in the photosensitive layer thereof has high sensitivity and chargeability, are nontoxic, free from the resource-concerned problems, highly transparent, light in weight, superior in film formation, both positively or negatively chargeable, easy to produce, and the photosensitivity thereof is scarcely lowered in repeated use.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A photoreceptor for electrophotography, comprising a photosensitive layer provided on a conductive support, the photosensitive layer containing a bishydrazone compound as a charge transfer substance represented by the following general formula (Ia):

(Ia)

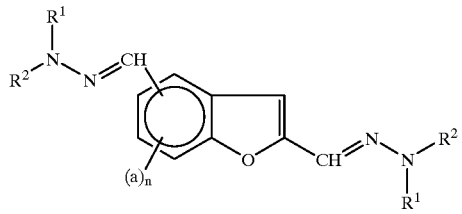

where:

$R^1$ and $R^2$ each is a substituted or unsubstituted aryl group, a substituted or unsubstituted aralkyl group, a heterocyclic group, or an alkyl group which has 1 to 4 carbon atoms;

"a" is an alkyl group which has 1 to 3 carbon atoms, an alkoxy group which has 1 to 3 carbon atoms, a dialkylamino group which has 1 to 3 carbon atoms, a halogen atom, or a hydrogen atom; and n is an integer of 1 to 3, wherein, if n is 2 or greater, a plurality of "a" substituents may be identical to or different from one another, or the substituents may form a ring.

2. A photoreceptor according to claim 1, wherein the bishydrazone compound represented by the general formula (Ia) is a compound represented by the following general formula (IIa):

(IIa)

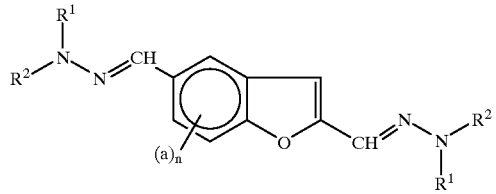

3. A photoreceptor according to claim 1, wherein the bishydrazone compound represented by the general formula (Ia) is a compound represented by the following general formula (IIIa):

(IIIa)

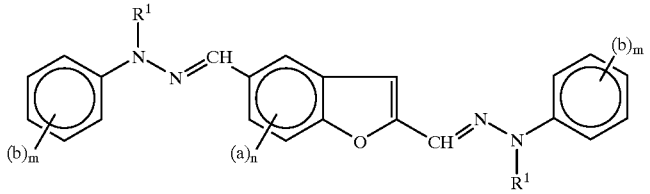

where:

"b" is an alkyl group which has 1 to 3 carbon atoms, an alkoxy group which has 1 to 3 carbon atoms, a dialkylamino group which has 1 to 3 carbon atoms, a halogen atom, or a hydrogen atom;

and m is an integer of 1 to 5, wherein, if m is 2 or greater, a plurality of "b" substituents may be identical to or different from one another, or the substituents may form a ring.

4. A photoreceptor according to claim 1, wherein:

the photosensitive layer is formed in a layered structure of a charge generation layer containing a charge generation substance and a charge transfer layer containing a charge transfer substance; and the charge transfer substance contains the bishydrazone compound.

5. A photoreceptor according to claim 1, wherein:

the photosensitive layer is a single layer containing a charge generation substance and a charge transfer substance; and the charge transfer substance contains the bishydrazone compound.

6. A photoreceptor for electrophotography, comprising a photosensitive layer provided on a conductive support, the photosensitive layer containing a bishydrazone compound as a charge transfer substance represented by the following general formula (Ib):

(Ib)

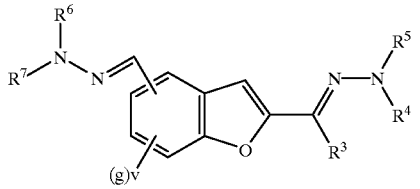

where:

$R^4$, $R^5$, $R^6$ and $R^7$ each is a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms, or $R^4$ and $R^5$ or $R^6$ and $R^7$ may form a ring structure via an atom, an atomic group, a substituted or unsubstituted alkylene group, a substituted or unsubstituted vinylene group, or a bivalent linking group;

$R^3$ is a substituted or unsubstituted aryl group, a substituted or unsubstituted heterocyclic group, a substituted or unsubstituted aralkyl group, a substituted or unsubstituted alkyl group which has 1 to 5 carbon atoms, a substituted or unsubstituted fluoroalkyl group which has 1 to 5 carbon atoms, or a substituted or unsubstituted perfluoroalkyl group which has 1 to 5 carbon atoms;

"g" is a substituted or unsubstituted alkyl group which has 1 to 3 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and v is an integer of 1 to 3, wherein, if v is 2 or greater, a plurality of "g" substituents may be identical to or different from one another, or the substituents may form a ring.

7. A photoreceptor according to claim 6, wherein the bishydrazone compound represented by the general formula (Ib) is a compound represented by the following general formula (IIb):

(IIb)

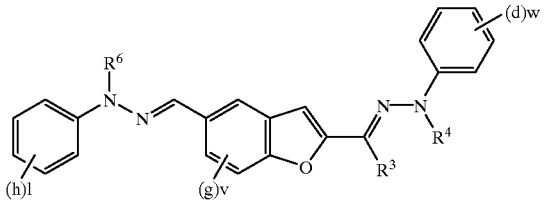

where:

"h" and "d" each is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and l and w each is an integer of 1 to 5, wherein, if l is 2 or greater, a plurality of "h" substituents may be identical to or different from one another, or the substituents may form a ring and, if w is 2 or greater, a plurality of "d" substituents may be identical to or different from one another, or the substituents may form a ring.

8. A photoreceptor according to claim 6, wherein the bishydrazone compound represented by the general formula (Ib) is a compound represented by the following general formula (IIIb):

(IIIb)

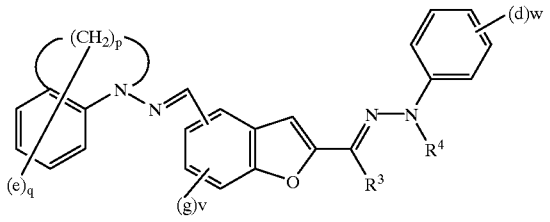

where:

"e" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

q is an integer of 1 to 14, wherein, if q is 2 or greater, a plurality of "e" substituents may be identical to or different from one another, or the substituents may form a ring; and p is an integer of 2 to 5.

9. A photoreceptor according to claim 6, wherein the bishydrazone compound represented by the general formula (Ib) is a compound represented by the following general formula (IVb):

(IVb)

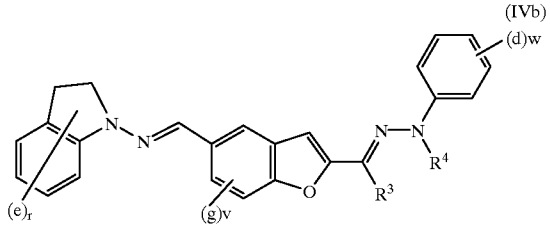

where:

"e" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and r is an integer of 1 to 8, wherein, if r is 2 or greater, a plurality of "e" substituents may be identical to or different from one another, or the substituents may form a ring.

10. A photoreceptor according to claim 6, wherein the bishydrazone compound represented by the general formula (Ib) is a compound represented by the following general formula (Vb):

(Vb)

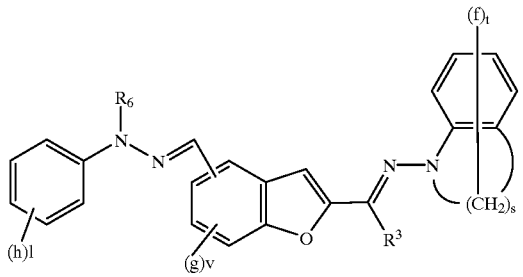

where:

"f" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

t is an integer of 1 to 14, wherein, if t is 2 or greater, a plurality of "f" substituents may be identical to or different from one another, or the substituents may form a ring; and s is an integer of 2 to 5.

11. A photoreceptor according to claim 6, wherein the bishydrazone compound represented by the general formula (Ib) is a compound represented by the following general formula (VIb):

(VIb)

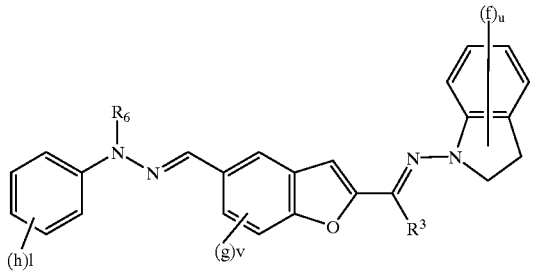

where:

"f" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and u is an integer of 1 to 8, wherein, if u is 2 or greater, a plurality of "f" substituents may be identical to or different from one another, or the substituents may form a ring.

12. A photoreceptor according to claim 6, wherein the bishydrazone compound represented by the general formula (Ib) is a compound represented by the following general formula (VIIb):

(VIIb)

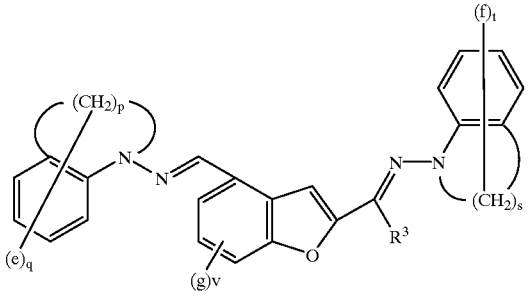

where:

"e" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

q is an integer of 1 to 14, wherein, if q is 2 or greater, a plurality of "e" substituents may be identical to or different from one another, or the substituents may form a ring;

p is an integer of 2 to 5;

"f" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

t is an integer of 1 to 14, wherein, if t is 2 or greater, a plurality of "f" substituents may be identical to or different from one another, or the substituents may form a ring; and s is an integer of 2 to 5.

13. A photoreceptor according to claim 6, wherein the bishydrazone compound represented by the general formula (Ib) is a compound represented by the following general formula (VIIIb):

(VIIIb)

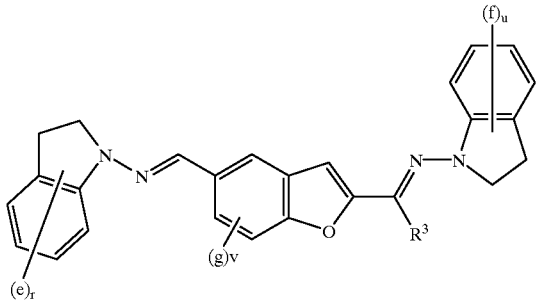

where:

"e" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom;

r is an integer of 1 to 8, wherein, if r is 2 or greater, a plurality of "e" substituents may be identical to or different from one another, or the substituents may form a ring;

"f" is a substituted or unsubstituted alkyl group which has 1 to 5 carbon atoms, a substituted or unsubstituted fluoroalkyl group which has 1 to 5 carbon atoms, a substituted or unsubstituted perfluoroalkyl group which has 1 to 5 carbon atoms, an alkoxy group which has 1 to 3 carbon atoms, a dialkylamino group which has 1 to 3 carbon atoms, a halogen atom, or a hydrogen atom; and u is an integer of 1 to 8, wherein, if u is 2 or greater, a plurality of "f" substituents may be identical to or different from one another, or the substituents may form a ring.

14. A photoreceptor according to claim 6, wherein the bishydrazone compound represented by the general formula (Ib) is a compound represented by the following general formula (IXb):

(IXb)

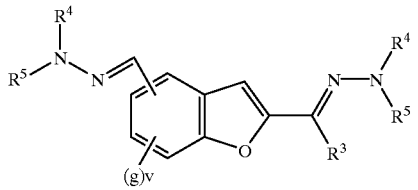

15. A photoreceptor according to claim 6, wherein:

the photosensitive layer is formed in a layered structure of a charge generation layer containing a charge generation substance and a charge transfer layer containing a charge transfer substance; and the charge transfer substance contains the bishydrazone compound.

16. A photoreceptor according to claim 6, wherein:

the photosensitive layer is a single layer containing a charge generation substance and a charge transfer substance; and the charge transfer substance contains the bishydrazone compound.

17. A photoreceptor for electrophotography, comprising a photosensitive layer provided on a conductive support, the photosensitive layer containing a cyclic bishydrazone compound as a charge transfer substance represented by the following general formula (Ic):

(Ic)

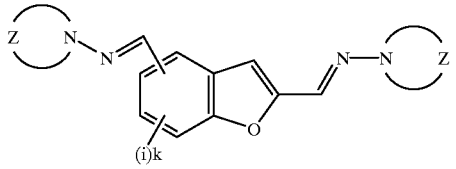

where:

"Z" is a substituted or unsubstituted heterocycle, a substituted or unsubstituted atomic group which has a bivalent group for forming a condensed heterocycle;

"i" is an alkyl group which has 1 to 3 carbon atoms, an alkoxy group which has 1 to 3 carbon atoms, a dialkylamino group which has 1 to 3 carbon atoms, a halogen atom, or a hydrogen atom; and k is an integer of 1 to 3, wherein, if k is 2 or greater, a plurality of "i" substituents may be identical to or different from one another, or the substituents may form a ring.

18. A photoreceptor according to claim 17, wherein the cyclic bishydrazone compound represented by the general formula (Ic) is a compound represented by the following general formula (IIc):

(IIc)

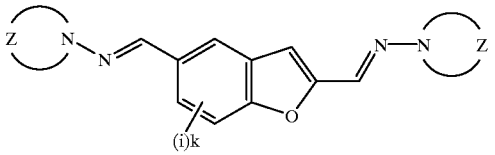

19. A photoreceptor according to claim 17, wherein the cyclic bishydrazone compound represented by the general formula (Ic) is a compound represented by the following general formula (IIIc):

(IIIc)

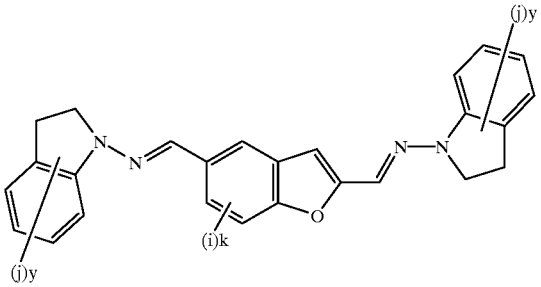

where:

"j" is an alkyl group which has 1 to 3 carbon atoms, an alkoxy group which has 1 to 3 carbon atoms, a dialkylamino group which has 1 to 3 carbon atoms, a halogen atom, or a hydrogen atom; and y is an integer of 1 to 8, wherein, if y is 2 or greater, a plurality of "j" substituents may be identical to or different from one another, or the substituents may form a ring.

20. A photoreceptor according to claim 17, wherein the cyclic bishydrazone compound represented by the general formula (Ic) is a compound represented by the following general formula (IVc):

(IVc)

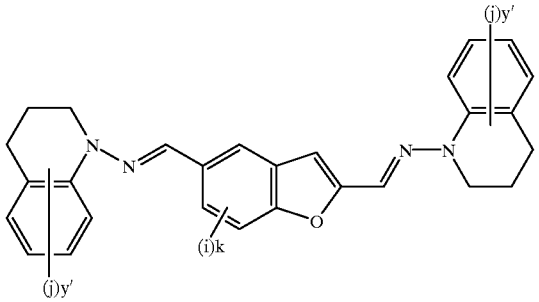

where:

"j" is an alkyl group which has 1 to 3 carbon atoms, an alkoxy group which has 1 to 3 carbon atoms, a dialkylamino group which has 1 to 3 carbon atoms, a halogen atom, or a hydrogen atom; and y' is an integer of 1 to 10, wherein, if y' is 2 or greater, a plurality of "j" substituents may be identical to or different from one another, or the substituents may form a ring.

21. A photoreceptor according to claim 17, wherein:

the photosensitive layer is formed in a layered structure of a charge generation layer containing a charge generation substance and a charge transfer layer containing a charge transfer substance; and the charge transfer substance contains the cyclic bishydrazone compound.

22. A photoreceptor according to claim 17, wherein:

the photosensitive layer is a single layer containing a charge generation substance and a charge transfer substance; and the charge transfer substance contains the cyclic bishydrazone compound.

* * * * *